US007571684B2

(12) United States Patent
Forbes

(10) Patent No.: US 7,571,684 B2
(45) Date of Patent: Aug. 11, 2009

(54) RAIL ROAD FREIGHT CAR WITH DAMPED SUSPENSION

(75) Inventor: James W. Forbes, Campbellville (CA)

(73) Assignee: National Steel Car Limited, Hamilton, Ontario (CA)

( * ) Notice: Subject to any disclaimer, the term of this patent is extended or adjusted under 35 U.S.C. 154(b) by 0 days.

(21) Appl. No.: 11/853,581

(22) Filed: Sep. 11, 2007

(65) Prior Publication Data

US 2008/0127852 A1 Jun. 5, 2008

Related U.S. Application Data

(60) Continuation of application No. 11/125,118, filed on May 10, 2005, now Pat. No. 7,267,059, which is a division of application No. 10/210,797, filed on Aug. 1, 2002, now Pat. No. 6,895,866, which is a continuation-in-part of application No. 09/920,437, filed on Aug. 1, 2001, now Pat. No. 6,659,016.

(51) Int. Cl.
*B61F 3/00* (2006.01)

(52) U.S. Cl. ..... 105/198.2; 105/198.5

(58) Field of Classification Search ..... 105/167, 105/168, 157.1, 165, 170, 182.1, 185, 190.1, 105/193, 197.05, 197.2, 218.1, 218.2, 219, 105/220, 223, 198.2, 198.4, 198.5
See application file for complete search history.

(56) References Cited

U.S. PATENT DOCUMENTS

| | | | |
|---|---|---|---|
| 378,926 | A | 3/1888 | Fish |
| 477,767 | A | 6/1892 | Miller |
| 692,086 | A | 1/1902 | Stephenson |
| 792,943 | A | 6/1905 | Stephenson |
| 895,157 | A | 8/1908 | Bush |
| 931,658 | A | 8/1909 | Stephenson |
| 941,691 | A | 11/1909 | Anderson |
| 1,060,370 | A | 4/1913 | Shallenberger et al. |
| 1,083,831 | A | 1/1914 | Holdaway et al. |
| 1,229,374 | A | 6/1917 | Youngblood |

(Continued)

FOREIGN PATENT DOCUMENTS

| | | |
|---|---|---|
| AT | 245610 | 3/1966 |

(Continued)

OTHER PUBLICATIONS

ASF Trucks "Good for the Long Run", American Steel Foundries, date unknown.

(Continued)

*Primary Examiner*—Mark T Le
(74) *Attorney, Agent, or Firm*—Hahn, Loeser & Parks, LLP

(57) ABSTRACT

An auto rack rail road freight car is provided for carrying low density, relatively high value, relatively fragile lading. The car has trucks that have multiple dampers in a four corner arrangement in the sideframes. The dampers may include damper wedges having primary and secondary wedge angles. The spring groups in the side frames are relatively soft, giving a low vertical bounce natural frequency. In an articulated embodiment, differentially placed ballast is mounted in a biased arrangement to load the coupler end trucks to encourage a dynamic response similar to the dynamic response of the internal trucks.

28 Claims, 32 Drawing Sheets

U.S. PATENT DOCUMENTS

| | | | |
|---|---|---|---|
| 1,316,553 | A | 9/1919 | Barber |
| 1,410,979 | A | 3/1922 | Westlake |
| 1,535,799 | A | 4/1925 | Adams |
| 1,608,665 | A | 11/1926 | Pehrson |
| 1,695,085 | A | 12/1928 | Cardwell |
| 1,727,715 | A | 9/1929 | Kassler |
| 1,744,277 | A | 1/1930 | Melcher |
| 1,745,321 | A | 1/1930 | Brittain, Jr. |
| 1,745,322 | A | 1/1930 | Brittain, Jr. |
| 1,754,111 | A | 4/1930 | Latshaw et al. |
| 1,823,884 | A | 9/1931 | Brittain, Jr. |
| 1,841,066 | A | 1/1932 | Simning et al. |
| 1,855,903 | A | 4/1932 | Brittain, Jr. |
| 1,859,265 | A | 5/1932 | Brittain, Jr. et al. |
| 1,865,220 | A | 6/1932 | Starbuck |
| 1,894,534 | A | 1/1933 | Dolan |
| 1,902,823 | A | 3/1933 | Bender |
| 1,953,103 | A | 4/1934 | Buckwalter |
| 1,967,808 | A | 7/1934 | Buckwalter |
| 2,009,149 | A | 7/1935 | Pierce |
| 2,009,771 | A | 7/1935 | Goodwin |
| 2,053,990 | A | 9/1936 | Goodwin |
| 2,106,345 | A | 1/1938 | Frede |
| 2,129,408 | A | 9/1938 | Davidson |
| 2,132,001 | A | 10/1938 | Dean |
| 2,147,014 | A | 2/1939 | Demarest |
| 2,155,615 | A | 4/1939 | Rice |
| 2,257,109 | A | 9/1941 | Davidson |
| 2,324,267 | A | 7/1943 | Oelkers |
| 2,333,921 | A | 11/1943 | Flesch |
| 2,352,693 | A | 7/1944 | Davidson |
| 2,367,510 | A | 1/1945 | Light |
| 2,389,840 | A | 11/1945 | Bruce |
| 2,404,278 | A | 7/1946 | Dath |
| 2,408,866 | A | 10/1946 | Marquardt |
| 2,424,936 | A | 7/1947 | Light |
| 2,432,228 | A | 12/1947 | Delano |
| 2,434,583 | A | 1/1948 | Pierce |
| 2,434,838 | A | 1/1948 | Cottrell |
| 2,446,506 | A | 8/1948 | Barrett et al. |
| 2,456,635 | A | 12/1948 | Heater |
| 2,458,210 | A | 1/1949 | Schlegel, Jr. |
| 2,497,460 | A | 2/1950 | Leese |
| 2,528,473 | A | 10/1950 | Kowalik |
| 2,551,064 | A | 5/1951 | Spenner |
| 2,570,159 | A | 10/1951 | Schlegel, Jr. |
| 2,613,075 | A | 10/1952 | Barrett |
| 2,650,550 | A | 9/1953 | Pierce |
| 2,659,318 | A | 11/1953 | Steins et al. |
| 2,661,702 | A | 12/1953 | Kowalik |
| 2,669,943 | A | 2/1954 | Spenner |
| 2,687,100 | A | 8/1954 | Dath |
| 2,688,938 | A | 9/1954 | Kowalik |
| 2,693,152 | A | 11/1954 | Bachman |
| 2,697,989 | A | 12/1954 | Shafer |
| 2,717,558 | A | 9/1955 | Shafer |
| 2,727,472 | A | 12/1955 | Forssell |
| 2,737,907 | A | 3/1956 | Janeway |
| 2,751,856 | A | 6/1956 | Maatman |
| 2,762,317 | A | 9/1956 | Gunnar |
| 2,777,400 | A | 1/1957 | Forssell |
| 2,827,987 | A | 3/1958 | Williams |
| 2,853,958 | A | 9/1958 | Neumann |
| 2,865,306 | A | 12/1958 | Bock et al. |
| 2,872,987 | A | 2/1959 | Lester |
| 2,883,944 | A | 4/1959 | Couch |
| 2,911,923 | A | 11/1959 | Bachman et al. |
| 2,913,998 | A | 11/1959 | Lich |
| 2,929,339 | A | 3/1960 | Schueder et al. |
| 2,931,318 | A | 4/1960 | Travilla |
| 2,959,262 | A | 11/1960 | Parker et al. |
| 2,968,259 | A | 1/1961 | Lich |
| 3,017,840 | A | 1/1962 | Fairweather |
| 3,024,743 | A | 3/1962 | Werner et al. |
| 3,026,819 | A | 3/1962 | Cope |
| 3,099,230 | A | 7/1963 | Podesta |
| 3,102,497 | A | 9/1963 | Bergstrand et al. |
| 3,119,350 | A | 1/1964 | Bellingher |
| 3,173,382 | A | 3/1965 | Ryan |
| 3,205,836 | A | 9/1965 | Wojcikowski |
| 3,218,990 | A | 11/1965 | Weber |
| 3,221,669 | A | 12/1965 | Baker et al. |
| 3,230,900 | A | 1/1966 | Ruprecht et al. |
| 3,240,167 | A | 3/1966 | Kullgren et al. |
| 3,272,550 | A | 9/1966 | Peterson |
| 3,274,955 | A | 9/1966 | Thomas |
| 3,285,197 | A | 11/1966 | Tack |
| 3,302,589 | A | 2/1967 | Williams |
| 3,323,472 | A | 6/1967 | Boone et al. |
| 3,352,255 | A | 11/1967 | Ernest |
| 3,358,614 | A | 12/1967 | Barber |
| 3,370,552 | A | 2/1968 | Kullgren et al. |
| 3,381,629 | A | 5/1968 | Jones |
| 3,405,661 | A | 10/1968 | James et al. |
| 3,426,704 | A | 2/1969 | Blunden |
| 3,461,814 | A | 8/1969 | Brown et al. |
| 3,461,815 | A | 8/1969 | Brown et al. |
| 3,516,706 | A | 6/1970 | Bruce |
| 3,517,620 | A | 6/1970 | Weber |
| 3,547,049 | A | 12/1970 | Sanders |
| 3,559,589 | A | 2/1971 | Williams |
| 3,575,117 | A | 4/1971 | Tack |
| 3,670,660 | A | 6/1972 | Weber et al. |
| 3,678,863 | A | 7/1972 | Pringle |
| 3,687,086 | A | 8/1972 | Barber |
| 3,699,897 | A | 10/1972 | Sherrick |
| 3,713,710 | A | 1/1973 | Wallace |
| 3,714,905 | A | 2/1973 | Barber |
| 3,802,353 | A | 4/1974 | Korpics |
| 3,834,320 | A | 9/1974 | Tack |
| 3,844,226 | A | 10/1974 | Brodeur et al. |
| 3,855,942 | A | 12/1974 | Mulcahy |
| 3,857,341 | A | 12/1974 | Neumann |
| 3,871,276 | A | 3/1975 | Allen et al. |
| 3,880,089 | A | 4/1975 | Wallace et al. |
| 3,885,942 | A | 5/1975 | Moore et al. |
| 3,897,736 | A | 8/1975 | Tack et al. |
| 3,901,163 | A | 8/1975 | Neumann et al. |
| 3,905,305 | A | 9/1975 | Cope et al. |
| 3,920,231 | A | 11/1975 | Harrison et al. |
| 3,927,621 | A | 12/1975 | Skeltis et al. |
| 3,965,825 | A | 6/1976 | Sherrick |
| 3,977,332 | A | 8/1976 | Bullock |
| 3,995,563 | A | 12/1976 | Blunden |
| 3,995,564 | A | 12/1976 | Cordani |
| 3,995,720 | A | 12/1976 | Wiebe |
| 4,003,318 | A | 1/1977 | Bullock et al. |
| 4,034,681 | A | 7/1977 | Neumann et al. |
| 4,067,260 | A | 1/1978 | Finsterwald |
| 4,072,112 | A | 2/1978 | Wiebe |
| 4,078,501 | A | 3/1978 | Neumann et al. |
| 4,084,514 | A | 4/1978 | Bullock |
| 4,103,623 | A | 8/1978 | Radwill |
| 4,109,585 | A | 8/1978 | Brose |
| 4,109,586 | A | 8/1978 | Briggs et al. |
| 4,109,934 | A | 8/1978 | Paton et al. |
| 4,119,042 | A | 10/1978 | Naves et al. |
| 4,119,043 | A | 10/1978 | Naves et al. |
| 4,128,062 | A | 12/1978 | Roberts |
| 4,136,620 | A | 1/1979 | Scheffel et al. |
| 4,148,469 | A | 4/1979 | Geyer |
| 4,149,472 | A | 4/1979 | Naves et al. |
| 4,151,801 | A | 5/1979 | Scheffel et al. |
| 4,167,907 | A | 9/1979 | Mulcahy et al. |

4,179,995 A 12/1979 Day
4,186,914 A 2/1980 Radwill et al.
4,191,107 A 3/1980 Ferris et al.
4,192,240 A 3/1980 Korpics
4,196,672 A 4/1980 Bullock
4,230,047 A 10/1980 Wiebe
4,233,403 A 11/1980 Menson et al.
4,233,909 A 11/1980 Adams et al.
4,236,457 A 12/1980 Cope
4,237,793 A 12/1980 Holden et al.
4,239,007 A 12/1980 Kleykamp et al.
4,242,966 A 1/1981 Holt et al.
4,244,297 A 1/1981 Monselle
4,244,298 A * 1/1981 Hawthorne et al. ..... 105/198.4
4,254,712 A 3/1981 O'Neil
4,254,713 A 3/1981 Clafford
4,256,041 A 3/1981 Kemper et al.
4,265,182 A 5/1981 Neff et al.
4,274,339 A 6/1981 Cope
4,274,340 A 6/1981 Neumann et al.
4,276,833 A 7/1981 Bullock
4,295,429 A 10/1981 Wiebe
4,311,098 A 1/1982 Irwin
4,316,417 A 2/1982 Martin
4,332,201 A 6/1982 Pollard et al.
4,333,403 A 6/1982 Tack et al.
4,336,758 A 6/1982 Radwill
RE31,008 E 8/1982 Barber
4,342,266 A 8/1982 Cooley
4,351,242 A 9/1982 Irwin
4,356,775 A 11/1982 Paton et al.
4,357,880 A 11/1982 Weber
4,363,276 A 12/1982 Neumann
4,363,278 A 12/1982 Mulcahy
4,370,933 A 2/1983 Mulcahy
4,373,446 A 2/1983 Cope
4,413,569 A 11/1983 Mulcahy
4,416,203 A 11/1983 Sherrick
4,426,934 A 1/1984 Geyer
4,434,720 A 3/1984 Mulcahy et al.
4,483,253 A 11/1984 List
RE31,784 E 1/1985 Wiebe
4,491,075 A 1/1985 Neumann
4,512,261 A 4/1985 Horger
4,526,109 A 7/1985 Dickhart
4,537,138 A 8/1985 Bullock
RE31,988 E 9/1985 Wiebe
4,552,074 A 11/1985 Mulcahy et al.
4,554,875 A 11/1985 Schmitt et al.
4,574,708 A 3/1986 Solomon
4,590,864 A 5/1986 Przybylinski
4,637,319 A 1/1987 Moehling et al.
4,660,476 A 4/1987 Franz
4,671,714 A 6/1987 Bennett
4,674,411 A 6/1987 Schindehutte
4,674,412 A 6/1987 Mulcahy et al.
4,676,172 A 6/1987 Bullock
4,751,882 A 6/1988 Wheatley et al.
4,759,669 A 7/1988 Robertson et al.
4,765,251 A 8/1988 Guins
4,785,740 A 11/1988 Grandy
4,813,359 A 3/1989 Marulic et al.
4,825,775 A 5/1989 Stein et al.
4,825,776 A 5/1989 Spencer
4,870,914 A 10/1989 Radwill
4,915,031 A * 4/1990 Wiebe ..... 105/198.2
4,929,132 A 5/1990 Yeates et al.
4,936,226 A 6/1990 Wiebe
4,938,152 A 7/1990 List
4,942,824 A 7/1990 Cros
4,947,760 A 8/1990 Dawson et al.
4,953,471 A 9/1990 Wronkiewicz et al.
4,966,081 A 10/1990 Dominguez et al.
4,974,521 A 12/1990 Eungard
4,986,192 A 1/1991 Wiebe
5,000,097 A 3/1991 List
5,001,989 A 3/1991 Mulcahy et al.
5,009,521 A 4/1991 Wiebe
5,027,716 A 7/1991 Weber et al.
5,046,431 A 9/1991 Wagner
5,072,673 A * 12/1991 Lienard ..... 105/198.2
5,081,935 A 1/1992 Pavlick
5,086,708 A 2/1992 McKeown et al.
5,095,823 A 3/1992 McKeown
5,107,773 A 4/1992 Daley et al.
5,111,753 A 5/1992 Zigler et al.
5,138,954 A 8/1992 Mulcahy
5,140,912 A 8/1992 Hesch
5,174,218 A 12/1992 List
5,176,083 A 1/1993 Bullock
5,226,369 A 7/1993 Weber
5,235,918 A 8/1993 Durand et al.
5,237,933 A 8/1993 Bucksbee
5,239,932 A 8/1993 Weber
5,241,913 A 9/1993 Weber
5,271,335 A 12/1993 Bogenschutz
5,271,511 A 12/1993 Daugherty et al.
5,320,046 A 6/1994 Hesch
5,327,837 A 7/1994 Weber
5,331,902 A 7/1994 Hawthorne et al.
5,392,717 A 2/1995 Hesch et al.
5,404,826 A 4/1995 Rudibaugh et al.
5,410,968 A 5/1995 Hawthorne et al.
5,417,163 A 5/1995 Lienard
RE34,963 E 6/1995 Eungard
5,438,934 A 8/1995 Goding
5,450,799 A 9/1995 Goding
5,452,665 A 9/1995 Wronkiewicz et al.
5,463,964 A 11/1995 Long et al.
5,481,986 A 1/1996 Spencer et al.
5,503,084 A 4/1996 Goding et al.
5,509,358 A 4/1996 Hawthorne et al.
5,511,489 A 4/1996 Bullock
5,511,491 A 4/1996 Hesch et al.
5,515,792 A 5/1996 Bullock et al.
5,524,551 A 6/1996 Hawthorne et al.
5,540,157 A 7/1996 Andersson et al.
5,544,591 A 8/1996 Taillon
5,555,817 A 9/1996 Taillon et al.
5,555,818 A 9/1996 Bullock
5,560,589 A 10/1996 Gran et al.
5,562,045 A 10/1996 Rudibaugh et al.
5,572,931 A 11/1996 Lazar et al.
5,596,936 A 1/1997 Bullock et al.
5,613,445 A 3/1997 Rismiller
5,622,115 A 4/1997 Ehrlich et al.
5,632,208 A 5/1997 Weber
5,647,283 A 7/1997 McKisic
5,657,698 A 8/1997 Black et al.
5,666,885 A 9/1997 Wike
5,685,228 A 11/1997 Ehrlich et al.
5,685,229 A 11/1997 Ohara et al.
5,690,033 A 11/1997 Andre
5,722,327 A 3/1998 Hawthorne et al.
5,735,216 A 4/1998 Bullock et al.
5,743,192 A 4/1998 Saxton et al.
5,746,137 A 5/1998 Hawthorne et al.
5,749,301 A 5/1998 Wronkiewicz et al.
5,765,486 A 6/1998 Black et al.
5,782,187 A 7/1998 Black et al.
5,794,537 A 8/1998 Zaerr et al.
5,794,538 A 8/1998 Pitchford
5,799,582 A 9/1998 Rudibaugh et al.
5,802,982 A 9/1998 Weber
5,832,836 A 11/1998 Ehrlich et al.
5,845,584 A 12/1998 Bullock et al.

| | | | | |
|---|---|---|---|---|
| 5,850,795 | A | 12/1998 | Taillon | |
| 5,857,414 | A | 1/1999 | Thoman et al. | |
| 5,875,721 | A | 3/1999 | Wright et al. | |
| 5,918,547 | A | 7/1999 | Bullock et al. | |
| 5,921,186 | A | 7/1999 | Hawthorne et al. | |
| 5,924,366 | A | 7/1999 | Trainer et al. | |
| 5,943,961 | A | 8/1999 | Rudibaugh et al. | |
| 5,967,053 | A | 10/1999 | Toussaint et al. | |
| 5,979,335 | A | 11/1999 | Saxton et al. | |
| 5,992,330 | A | 11/1999 | Gilbert et al. | |
| 6,125,767 | A | 10/2000 | Hawthorne et al. | |
| 6,142,081 | A | 11/2000 | Long et al. | |
| 6,173,655 | B1 | 1/2001 | Hawthorne | |
| 6,178,894 | B1 | 1/2001 | Leingang | |
| 6,186,075 | B1 | 2/2001 | Spencer | |
| 6,196,134 | B1 | 3/2001 | Stecker | |
| 6,227,122 | B1 | 5/2001 | Spencer | |
| 6,269,752 | B1 | 8/2001 | Taillon | |
| 6,276,283 | B1 | 8/2001 | Weber | |
| 6,283,040 | B1 | 9/2001 | Lewin | |
| 6,338,300 | B1 | 1/2002 | Landrot | |
| 6,347,588 | B1 | 2/2002 | Leingang | |
| 6,371,033 | B1 | 4/2002 | Oliver et al. | |
| 6,374,749 | B1 * | 4/2002 | Duncan et al. | 105/198.5 |
| 6,422,155 | B1 | 7/2002 | Heyden et al. | |
| 6,425,334 | B1 | 7/2002 | Wronkiewicz et al. | |
| 6,446,561 | B1 | 9/2002 | Khattab | |
| 6,591,759 | B2 | 7/2003 | Bullock | |
| 6,631,685 | B2 | 10/2003 | Hewitt | |
| 6,659,016 | B2 | 12/2003 | Forbes | |
| 6,672,224 | B2 | 1/2004 | Weber et al. | |
| 6,688,236 | B2 | 2/2004 | Taillon | |
| 6,691,625 | B2 | 2/2004 | Duncan | |
| 6,701,850 | B2 | 3/2004 | McCabe et al. | |
| 6,895,866 | B2 | 5/2005 | Forbes | |
| 7,255,048 | B2 | 8/2007 | Forbes | |
| 7,263,931 | B2 | 9/2007 | Forbes | |
| 2003/0024429 | A1 | 2/2003 | Forbes | |
| 2003/0037696 | A1 | 2/2003 | Forbes | |
| 2003/0041772 | A1 | 3/2003 | Forbes | |
| 2003/0097955 | A1 | 5/2003 | Bullock | |
| 2003/0129037 | A1 | 7/2003 | Forbes | |

FOREIGN PATENT DOCUMENTS

| | | |
|---|---|---|
| CA | 714822 | 8/1965 |
| CA | 2153137 | 6/1995 |
| CA | 2191613 | 11/1996 |
| CA | 2090031 | 4/1997 |
| CA | 2034125 | 7/2000 |
| CA | 2100004 | 1/2004 |
| CH | 329987 | 5/1958 |
| CH | 371475 | 10/1963 |
| DE | 473036 | 2/1929 |
| DE | 664933 | 9/1938 |
| DE | 688777 | 2/1940 |
| DE | 1180392 | 10/1964 |
| DE | 2318369 | 10/1974 |
| EP | 0264731 | 4/1988 |
| EP | 0347334 | 12/1989 |
| EP | 0444362 | 9/1991 |
| EP | 0494323 | 7/1992 |
| EP | 1053925 | 11/2000 |
| FR | 1095600 | 6/1955 |
| GB | 2045188 | 10/1980 |
| IT | 324559 | 2/1935 |
| JP | 58-39558 | 3/1983 |
| JP | 63-279966 | 11/1988 |
| JP | 4-143161 | 5/1992 |
| WO | 00/13954 | 3/2000 |

OTHER PUBLICATIONS

"ASF User's Guide, Freight Car Truck Design", American Steel Foundries, ASF 652, date unknown.

American Steel Foundries Information: Super Service Ridemaster, American Steel Foundries, date unknown. Motion Control M976 Upgrade Kit, source unknown, date unknown. ASF Motion Control Truck System with Super Service Ridemaster & D5 Springs, drawing No. AR-3421, ASF-Keystone, Inc., Jul. 14, 2003. Assembly ASF-Pennsy Adapter Plus Pad & Adapter, drawing No. 43317, ASF-Keystone, Inc., Jul. 10, 2003.

"AdapterPlus", Pennsy Corporation, Internet—PENNSY.com, Ver. 9807, date unknown.

Association of American Railroads, Sep. 1996, Rownd, K. et al., "Improved Ride Quality for Transportation of Finished Automobiles by Rail", Technology Digest TD 96-021.

Association of American Railroads, Sep. 1996, Rownd, K. et al., "Over-the-Road Tests Demonstrate Improved Ride Quality for Transportation of Finished Automobiles", Technology Digest TD 96-022.

Association of American Railroads, Sep. 1997, Burnett, S. et al., "Improved Vehicle Dynamics Model for Tri-Level Auto-Rack Railcars", Technology Digest TD 97-038.

Association of American Railroads, Sep. 1997, Rownd, K. et al., "Improved Ride Quality for Rail Transport of Finished Automobiles", Technology Digest TD 97-039.

Association of American Railroads, Jun. 1998, Rownd, K. et al., "Use of Modified Suspensions to Improve Ride Quality in Bi-Level Auto-Racks", Technology Digest TD 98-014.

Association of American Railroads, Oct. 1998, Rownd, K. et al., "Improved Ride Quality for Transportation of Finished Autos by Tri-Level Autorack", Technology Digest TD 98-025.

Association of American Railroads, Oct. 1998, Rownd, K. et al., "Advanced Suspensions Meet Performance Standards for Bi-Level Auto-Racks Cars", Technology Digest TD 98-032.

Association of American Railroads, Jun. 1999, Rownd, K. et al., "Evaluation of End-of-Car Cushioning Designs Using the TOES Model", Technology Digest TD 99-019.

Association of American Railroads, Jun. 1999, Rownd, K. et al., "Advanced Suspensions Meet Ride Quality Performance Standards for Tri-Level Auto-Racks Cars", Technology Digest TD 99-020.

Association of American Railroads, Aug. 1999, Rownd, K. et al., "Improving the Economy of Bulk- Commodity Service Through Improved Suspensions", Technology Digest TD 99-027.

Association of American Railroads, Jul. 2000, Rownd, K. et al., "Improving the Economics of Bulk-Commodity Service: ASF Bulk Truck", Technology Digest TD 00-011.

Association of American Railroads, Jul. 2000, Rownd, K. et al., "Improving the Economics of Bulk- Commodity Service—S2E Standard Car Truck", Technology Digest TD 00-012.

Association of American Railroads Mechanical Division Manual of Standards and Recommended Practices Journal "Roller Bearing Adapters for Freight Cars", date unknown, pp. H-35 to H-42. Revised 1998.

Barber S-2-D Product Bulletin, undated.

"Barber Change Brings Choices", Standard Car Truck Company, date unknown.

"Barber Friction Wedge Matrix", Standard Car Truck Company, date unknown.

1984 Car and Locomotive Cyclopedia, 5th ed., (Omaha: Simmons-Boardman Books, Inc. 1984) pp. 512-513.

1997 Car and Locomotive Cyclopedia, 6th ed., Section 1, (Simmons-Boardman Books, Inc., Omaha) pp. 7-24.

1997 Car and Locomotive Cyclopedia, 6th ed., Section 6: Couplers & Draft Gear, (Omaha: Simmons-Boardman Books, Inc., 1997) pp. 640-702.

1997 Car and Locomotive Cyclopedia, 6th ed., (Simmons-Boardman Books, Inc., Omaha) p. 834.

1997 Car and Locomotive Cyclopedia, 6th ed., Section 7: Bearings (Omaha: Simmons-Boardman Books, Inc.) pp. 739-749, 811-822.

1997 Car and Locomotive Cyclopedia, 6th ed. (Omaha: Simmons-Boardman Books, Inc. 1997) pp. 705-770. Section 7: Trucks, Wheels,Axles & Bearings, pp. 705-720, 724, 726, 735-736, 739-751.
1961 Car Builders Cyclopedia, 21st ed., "Car Trucks: Freight: Modified Conventional" (New York: Simmons-Boardman Publishing Corporation, 1961) pp. 846-847.
Railway Age, "Comprehensive Railroad Dictionary" (New York: Simmons-Boardman Publishing Corporation, p. 142.
Nov. 1998 Railway Age, pp. 47, 51, 53 and 62.
Jul. 2003 Railway Age, "A Dynamic Relationship" pp. 37-38.
"Barber Stabilized Truck—Suspension Performance properties", Standard Car Truck Company, Mar. 14, 2000.
"Barber Stabilized Trucks Presentation", Standard Car Truck Company, Oct. 10, 2000.
Buckeye SC-R-VII, Buckeye Steel Castings, date unknown.
Buckeye XC-R, Buckeye Steel Castings, date unknown.
C.L. Combes et al., Car Builder's Cyclopedia of American Practice, Encyclopedia, 1961, p. 868, 21st edition, Simmons-Boardman Publishing Corporation, New York, USA.
"Narrow Pedestal Side Frame Trucks", Timken Roller Bearing Company, date unknown.
Photographs of experimental multi-unit articulated railroad flat car with short travel draft gear and reduced slack couplers developed by Canadian pacific Railways, date unknown.
"Roller Bearing Adapters for Freight Cars", Association of American Railroads Mechanical Division Manual of Standards and Recommended Practices Journal, Revised 1989, pp. H-35 to H-42, date unknown.
Standard Car Truck Company, Truck Information Package 2000: Iron Friction Wedge Replacement Guide, Standard Car Truck Company, 2000. Lifeguard Friction Wedge Replacement Guide, Standard Car Truck Company, 2000. TwinGuard Friction Wedge Replacement Guide, Standard Car Truck Company, 2000. Product Bulletin, Barber TwinGuard, Standard Car Truck Company, date unknown. Barber Split Wedge, Standard Car Truck Company, date unknown. Barber Split Wedge Replacement Guide, Standard Car Truck Company, 2000.
Standard Car Truck Company, Truck Information Package 2000 (cont'd): Barber 905-SW Split Wedge Friction Casting, Standard Car Truck Company, 2000. Barber 905-SW Split Wedge Pocket Insert, Standard Car Truck Company, 2000. Barber 905-SW Split Wedge Insert Application Guide, Standard Car Truck Company, 2000.
"Timken "AP" Bearing Assembly", Timken Roller Bearing Company, date unknown.
"User's Manual for NUCARS, Version 2.0, SD-043", pp. 5-39 to 5-40.
1937 Car and Locomotive Cyclopedia, "Self-Aligning Spring Plankless Double Truss Trucks" (New York: Simmons-Boardman Publishing Corporation, 1937) pp. 892-893.
1966 Car and Locomotive Cyclopedia, "ASF Freight Car Trucks" (New York: Simmons-Boardman Publishing Corporation, 1966) pp. 818-819.
1966 Car and Locomotive Cyclopedia, 1st ed., "Barber Stabilized Truck" (New York: Simmons- Boardman Publishing Corporation, 1966) p. 827.
1970 Car and Locomotive Cyclopedia, 2nd ed., (New York: Simmons-Boardman Publishing Corporation, 1970) p. 816.
1974 Car and Locomotive Cyclopedia, 3rd ed., "For new directions in shock and motion protection, keep looking to Lord" (New York: Simmons-Boardman Publishing Corporation, 1966) pp. S13-36, S13-37.
1980 Car and Locomotive Cyclopedia, Simmons-Boardman Books, Inc., 4th ed., Section 13.
1980 Car and Locomotive Cyclopedia, pp. 669-750. Section 13: Truck and Journal Bearings, pp. 669-682, 699-703, 706-709, 712-719, 722-726, 734-735.
1984 Car and Locomotive Cyclopedia, 5th ed., (Omaha: Simmons-Boardman Books, Inc. 1984) p. 488, 489, 496, 500 and 526.
U.S. Appl. No. 09/658,856, filed Sep. 11, 2000, Auto Rack Rail Road Car with Reduced Slack.
U.S. Appl. No. 09/920,437, filed Aug. 1, 2001, Rail Road Freight Car with Resilient Suspension.
U.S. Appl. No. 10/210,797, filed Aug. 1, 2002, Rail Road Freight Car with Damped Suspension.
U.S. Appl. No. 10/210,853, filed Aug. 1, 2002, Rail Road Car Truck with Rocking Sideframe.
U.S. Appl. No. 10/355,374, filed Jan. 31, 2003, Rail Road Car and Truck Therefor.
U.S. Appl. No. 10/357,318, filed Feb. 3, 2003, Rail Road Car Truck with Bearing Adapter and Method.
U.S. Appl. No. 10/366,094, filed Feb. 12, 2003, Rail Road Car with Reduced Slack.
U.S. Appl. No. 10/703,790, filed Nov. 6, 2003, Rail Road Freight Car with Resilient Suspension.
U.S. Appl. No. 10/745,926, filed Dec. 24, 2003, Rail Road Car Truck.
U.S. Appl. No. 10/888,788, filed Jul. 8, 2004, Rail Road Car Truck and Fittings Therefor.
U.S. Appl. No. 10/990,153, filed Nov. 16, 2004, Rail Road Car with Reduced Slack.
U.S. Appl. No. 11/002,222, filed Dec. 3, 2004, Rail Road Car Truck and Bolster Therefor.
U.S. Appl. No. 11/019,664, filed Dec. 23, 2004, Rail Road Car Truck and Bearing Adapter Fittings Threrfor.
U.S. Appl. No. 11/099,083, filed Apr. 5, 2005, Rail Road Car with Truck Bearing Adapter and Method.
U.S. Appl. No. 11/125,118, filed May 10, 2005, Rail Road Freight Car with Damped Suspension.
U.S. Appl. No. 11/153,913, filed Jun. 16, 2005, Truck Bolster.
U.S. Appl. No. 11/189,095, filed Jul. 25, 2005, Rail Road Freight Car with Resilient Suspension.

* cited by examiner 570
610
578
582
580
604
576
574
600
588
586
10c
614
592
572
594
10d
620
622
602
612
608
606
616
596

RAIL ROAD FREIGHT CAR WITH DAMPED SUSPENSION

This application incorporates by reference U.S. patent application Ser. No. 11/125,118 filed May 10, 2005, now U.S. Pat. No. 7,267,059; U.S. patent application Ser. No. 10/210,797 filed Aug. 1, 2002, now U.S. Pat. No. 6,895,866; and U.S. patent application Ser. No. 09/920,437 filed Aug. 1, 2001, now U.S. Pat. No. 6,659,016.

FIELD OF THE INVENTION

This invention relates to the field of rail road freight cars.

BACKGROUND OF THE INVENTION

This invention can be used with the invention described in my co-pending U.S. patent application Ser. No. 09/920,437 filed Aug. 1, 2001, now U.S. Pat. No. 6,659,016.

Auto rack rail road cars are used to transport automobiles. Typically, auto-rack rail road cars are loaded in the "circus loading" manner, by driving vehicles into the cars from one end, and securing them in places with chocks, chains or straps. When the trip is completed, the chocks are removed, and the cars are driven out.

Automobiles are a high value, relatively fragile type of lading. Damage due to dynamic loading in the railcar may tend to arise principally in two ways. First, there are the longitudinal input loads transmitted through the draft gear due to train line action or shunting. Second, there are vertical, rocking and transverse dynamic responses of the rail road car to track perturbations as transmitted through the rail car suspension. It would be desirable to improve ride quality to lessen the chance of damage occurring.

In the context of longitudinal train line action, damage most often occurs from two sources (a) slack run-in and run out; (b) humping or flat switching. Rail road car draft gear have been designed against slack run-out and slack run-in during train operation, and also against the impact as cars are coupled together. Historically, common types of draft gear, such as that complying with, for example, AAR specification M-901-G, have been rated to withstand an impact at 5 m.p.h. (8 km/h) at a coupler force of 500,000 Lbs. (roughly $2.2\times10^6$ N). Typically, these draft gear have a travel of 2¾ to 3¼ inches in buff before reaching the 500,000 Lbs. load, and before "going solid". The term "going solid" refers to the point at which the draft gear exhibits a steep increase in resistance to further displacement. If the impact is large enough to make the draft gear "go solid" then the force transmitted, and the corresponding acceleration imposed on the lading, increases sharply. While this may be acceptable for ores, coal or grain, it is undesirably severe for more sensitive lading, such as automobiles or auto parts, rolls of paper, fresh fruit and vegetables and other high value consumer goods such as household appliances or electronic equipment. Consequently, from the relatively early days of the automobile industry there has been a history of development of longer travel draft gear to provide lading protection for relatively high value, low density lading, in particular automobiles and auto parts, but also farm machinery, or tractors, or highway trailers.

Historically, the need for slack was related, at least in part, to the difficulty of using a steam locomotive to "lift" (that is, move from a standing start) a long string of rail road cars with journal bearings, particularly in cold weather. For practical purposes, presently available diesel-electric locomotives are capable of lifting a unit train of one type of cars having little or no slack. Given the availability of locomotives that develop continuous high torque from a standing start, it is possible to re-examine the issue of slack action from basic principles. By eliminating, or reducing, the accumulation of slack, the use of short travel buff gear may tend to reduce the relative longitudinal motion between adjacent rail road cars, and may tend to reduce the associated velocity differentials and accelerations between cars. The use of short travel, or ultra-short travel, buff gear also has the advantage of eliminating the need for relatively expensive, and relatively complicated EOCC units, and the fittings required to accommodate them.

In terms of dynamic response through the trucks, there are a number of loading conditions to consider. First, there is a direct vertical response in the "vertical bounce" condition. This may typically arise when there is a track perturbation in both rails at the same point, such as at a level crossing or at a bridge or tunnel entrance where there may be a relatively sharp discontinuity in track stiffness. A second "rocking" loading condition occurs when there are alternating track perturbations, typically such as used formerly to occur with staggered spacing of 39 ft rails. This phenomenon is less frequent given the widespread use of continuously welded rails, and the generally lower speeds, and hence lower dynamic forces, used for the remaining non-welded track. A third loading condition arises from elevational changes between the tracks, such as when entering curves in which case a truck may have a tendency to warp. A fourth loading condition arises from truck "hunting", typically at higher speeds, where the truck oscillates transversely between the rails. During hunting, the trucks tend most often to deform in a parallelogram manner. Fifth, lateral perturbations in the rails sometimes arise where the rails widen or narrow slightly, or one rail is more worn than another, and so on.

There are both geometric and historic factors to consider related to these loading conditions. One historic factor is the near universal usage of the three-piece style of freight car truck in North America. While other types of truck are known, the three piece truck is overwhelmingly dominant in freight service in North America. The three piece truck relies on a primary suspension in the form of a set of springs trapped in a "basket" between the truck bolster and the side frames. For wheel load equalisation, a three piece truck uses one set of springs, and the side frames pivot about the truck bolster ends in a manner like a walking beam. The 1980 *Car& Locomotive Cyclopedia*, states at page 669 that the three piece truck offers "interchangeability, structural reliability and low first cost but does so at the price of mediocre ride quality and high cost in terms of car and track maintenance". It would be desirable to retain many or all of these advantages while providing improved ride quality.

In terms of rail road car truck suspension loading regimes, the first consideration is the natural frequency of the vertical bounce response. The static deflection from light car (empty) to maximum laded gross weight (full) of a rail car at the coupler tends to be typically about 2 inches. In addition, rail road car suspensions have a dynamic range in operation, including a reserve travel allowance.

In typical historical use, springs were chosen to suit the deflection under load of a full coal car, or a full grain car, or fully loaded general purpose flat car. In each case, the design lading tended to be very heavy relative to the rail car weight. For example, the live load for a 286,000 lbs. car may be of the order of five times the weight of the dead sprung load (i.e., the weight of the car, including truck bolsters but less side frames, axles and wheels). Further, in these instances, the lading may not be particularly sensitive to abusive handling. That is, neither coal nor grain tends to be badly damaged by poor ride quality. As a result, these cars tend to have very stiff suspensions, with a dominant natural frequency in vertical bounce mode of about 2 Hz. when loaded, and about 4 to 6 Hz. when empty. Historically, much effort has been devoted to making freight cars light for at least two reasons. First, the weight to be back hauled empty is kept low, reducing the fuel cost of the backhaul. Second, as the ratio of lading to car weight increases, a higher proportion of hauling effort goes into hauling lading, rather than hauling the railcar.

By contrast, an autorack car, or other type of car for carrying relatively high value, low density lading such as auto parts, electronic consumer goods, or white goods more generally, has the opposite loading profile. A two unit articulated autorack car may have a light car (i.e., empty) weight of 165,000 lbs., and a lading weight when fully loaded of only 35-40,000 lbs., per car body unit. That is, not only may the weight of the lading be less than the sprung weight of the rail road car unit, it may be less than 40% of the car weight. The lading typically has a high, or very high, ratio of value to weight. Unlike coal or grain, automobiles are relatively fragile, and hence more sensitive to a gentle (or a not so gentle) ride. As a relatively fragile, high value, high revenue form of lading, it may be desirable to obtain superior ride quality to that suitable for coal or grain.

One way to improve ride quality is to increase the dead sprung weight of the rail road car body. Another way to improve ride quality is to decrease the spring rate. Decreasing the spring rate involves further considerations. Historically the deck height of a flat car tended to be very closely related to the height of the upper flange of the center sill. This height was itself established by the height of the cap of the draft pocket. The size of the draft pocket was standardised on the basis of the coupler chosen, and the allowable heights for the coupler knuckle. The deck height usually worked out to about inches above top of rail. For some time auto rack cars were designed to a 19 ft height limit. To maximise the internal loading space, it has been considered desirable to lower the main deck as far as possible, particularly in tri-level cars. Since the lading is relatively light, the rail car trucks have tended to be light as well, such as 70 Ton trucks, as opposed to 100, 110 or 125 Ton trucks for coal, ore, or grain cars at 263,000, 286,000 or 315,000 lbs. gross weight on rail. Since the American Association of Railroads (AAR) specifies a minimum clearance of 5" above the wheels, the combination of low deck height, deck clearance, and minimum wheel height set an effective upper limit on the spring travel, and reserve spring travel range available. If softer springs are used, the remaining room for spring travel below the decks may well not be sufficient to provide the desired reserve height. In consequence, the present inventor proposes, contrary to lowering the main deck, that the main deck be higher than 42 inches to allow for more spring travel.

As noted above, many previous auto rack cars have been built to a 19 ft height. Another major trend in recent years has been the advent of "double stack" intermodal container cars capable of carrying two shipping containers stacked one above the other in a well or to other freight cars falling within the 20 ft 2 in. height limit of AAR plate H. Many main lines have track clearance profiles that can accommodate double stack cars. Consequently, it is now possible to use auto rack cars built to the higher profile of the double stack intermodal container cars.

While decreasing the primary vertical bounce natural frequency appears to be advantageous for auto rack rail road cars generally, including single car unit auto rack rail road cars, articulated auto rack cars may also benefit not only from adding ballast, but from adding ballast preferentially to the end units near the coupler end trucks. As explained more fully in the description below, the interior trucks of articulated cars tend to be more heavily burdened than the end trucks, primarily because the interior trucks share loads from two adjacent car units, while the coupler end trucks only carry loads from one end of one car unit. It would be advantageous to even out this loading so that the trucks have roughly similar vertical bounce frequencies.

Three piece trucks currently in use tend to use friction dampers, sometimes assisted by hydraulic dampers such as can be mounted, for example, in the spring set. Friction damping has most typically been provided by using spring loaded blocks, or snubbers, mounted with the spring set, with the friction surface bearing against a mating friction surface of the columns of the side frames, or, if the snubber is mounted to the side frame, then the friction surface is mounted on the face of the truck bolster. There are a number of ways to do this. In some instances, as shown at p. 847 of the 1984 *Car & Locomotive Cyclopedia* lateral springs are housed in the end of the truck bolster, the lateral springs pushing horizontally outward on steel shoes that bear on the vertical faces of the side columns of the side frames. This provides roughly constant friction (subject to the wear of the friction faces), without regard to the degree of compression of the main springs of the suspension.

In another approach, as shown at p. 715 of the 1997 *Car & Locomotive Cyclopedia*, one of the forward springs in the main spring group, and one of the rearward springs in the main spring group bear upon the underside, or short side, of a wedge. One of the long sides, typically an hypotenuse of a wedge, engages a notch, or seat, formed near the outboard end of the truck bolster, and the third side has the friction face that abuts, and bears against, the friction face of the side column (either front or rear, as the case may be), of the side frame. The action of this pair of wedges then provides damping of the various truck motions. In this type of truck the friction force varies directly with the compression of the springs, and increases and decreases as the truck flexes. In the vertical bounce condition, both friction surfaces work in the same direction. In the warping direction (when one wheel rises or falls relative to the other wheel on the same side, thus causing the side frame to pivot about the truck bolster) the friction wedges work in opposite directions against the restoring force of the springs.

The "hunting" phenomenon has been noted above. Hunting generally occurs on tangent (i.e., straight) track as railcar speed increases. It is desirable for the hunting threshold to occur at a speed that is above the operating speed range of the rail car. During hunting the side frames tend to want to rotate about a vertical axis, to a non-perpendicular angular orientation relative to the truck bolster sometimes called "parallelogramming" or lozenging. This will tend to cause angular deflection of the spring group, and will tend to generate a squeezing force on opposite diagonal sides of the wedges, causing them to tend to bear against the side frame columns. This diagonal action will tend to generate a restoring moment working against the angular deflection. The moment arm of this restoring force is proportional to half the width of the wedge, since half of the friction plate lies to either side of the centreline of the side frame. This tends to be a relatively weak moment connection, and the wedge, even if wider than normal, tends to be positioned over a single spring in the spring group.

Typically, for a truck of fixed wheelbase length, there is a trade-off between wheel load equalisation and resistance to hunting. Where a car is used for carrying high density commodities at low speeds, there may tend to be a higher emphasis on maintaining wheel load equalisation. Where a car is light, and operates at high speed there will be a greater emphasis on avoiding hunting. In general, the parallelogram deformation of the truck in hunting is deterred by making the truck laterally more stiff. One approach to discouraging hunting is to use a transom, typically in the form of a channel running from between the side frames below the spring baskets. Another approach is to use a frame brace.

One way to address the hunting issue is to employ a truck having a longer wheelbase, or one whose length is proportionately great relative to its width. For example, at present two axle truck wheelbases may range from about 5'-3" to 6'-0". However, the standard North America track gauge is 4'-8½", giving a wheelbase to track width ratio possibly as small as 1.12. At 6'-0" the ratio is roughly 1.27. It would be preferable to employ a wheelbase having a longer aspect ratio relative to the track gauge. As described herein, one aspect of the present invention employs a truck with a longer wheelbase, preferably about 80 or 86 inches, giving a ratio of 1.42 or 1.52. This increase in wheelbase length may tend also to be benign in terms of wheel loading equalisation.

In a typical spring seat and spring group arrangement, the side frame window may typically be of the order of 21 inches in height from the spring seat base to the underside of the overarching compression member, and the width of the side frame window between the wear plates on the side frame columns is typically about 18", giving a side frame window that is taller than wide in the ratio of about 7:6. Similarly, the bottom spring seat has a base that is typically about 18 inches long to correspond to the width of the side frame window, and about 16 inches wide in the transverse direction, that is being longer than wide. It may be advantageous to make the side frame windows wider, and the spring seat correspondingly longer to accommodate larger diameter long travel springs with a softer spring rate. At the same time, lengthening the wheel base of the truck may also be advantageous since it is thought that a longer wheelbase may ameliorate truck hunting performance, as noted above. Such a design change is counter-intuitive since it may generally be desired to keep truck size small, and widening the unsupported window span may not have been considered desirable heretofore.

Another way to raise the hunting threshold is to increase the parallelogram stiffness between the bolster and the side frames. It is possible, as described herein, to employ pairs of wedges, of comparable size to those previously used, the two wedges being placed side by side and each individually supported by a different spring, or being the outer two wedges in a three deep spring group, to give a larger moment arm to the restoring force and to the damping associated with that force.

The use of multiple variable friction force dampers in which the wedges are mounted over members of the spring group, is shown in U.S. Pat. No. 3,714,905 of Barber, issued Feb. 6, 1973. The damper arrangement shown by Barber is not apparently presently available in the market, and does not seem ever to have been made available commercially.

Notably, the damper wedges shown in Barber appear to have relatively sharply angled wedges, with an included angle between the friction face (i.e., the face bearing against the side frame column) and the sliding face (i.e., the angled face seated in the damper pocket formed in the bolster, typically the hypotenuse) of roughly 35 degrees. The angle of the third, or opposite, horizontal side face, namely the face that seats on top of the vertically oriented spring, is the complementary angle, in this example, being about 55 degrees. It should be noted that as the angle of the wedge becomes more acute, (i.e., decreasing from about 35 degrees) the wedge may have an undesirable tendency to jam in the pocket, rather than slide.

Barber, above, shows a spring group of variously sized coils with four relatively small corner coils loading the four relatively sharp angled dampers. From the relative sizes of the springs illustrated, it appears that Barber was contemplating a spring group of relatively traditional capacity—a load of about 80,000 lbs., at a "solid" condition of 3 1/16 inches of travel, for example, and an overall spring rate for the group of about 25,000 lbs/inch, to give 2 inches of overall rail car static deflection for about 200,000 lbs live load.

Apparently keeping roughly the same relative amount of damping overall as for a single damper, Barber appears to employ individual B331 coils (k=538 lb/in, (+/−)) under each friction damper, rather than a B432 coil (k=1030 lb/in, (+/−)) as might typically have been used under a single damper for a spring group of the same capacity. As such, it appears that Barber contemplated that springs accounting for somewhat less than 15% of the overall spring group stiffness would underlie the dampers.

These spring stiffnesses might typically be suitable for a rail road car carrying iron ore, grain or coal, where the lading is not overly fragile, and the design ratio of live load to dead sprung load is typically greater than 3:1. It might not be advantageous for a rail road car for transporting automobiles, auto parts, consumer electronics or other white goods of relatively low density and high value where the design ratio of live load to dead sprung load may be well less than 2:1, and quite possibly lying in the range of 0.4:1 to 1:1.

It has been noted that the frictional force produced by friction damper wedges differs depending on whether the damper is being loaded, or unloaded. In the terminology employed, the damper is being "loaded" when the bolster is moving downward in the sideframe window, since the spring force is increasing, and hence the load, or force on the damper is increasing. Similarly, the damper is being "unloaded" when the bolster is moving upward toward the top of the sideframe window, since the force in the springs, and hence the load in the wedges, is decreasing.

The equations can be written as

While loading:

$$F_d = \mu_c F_s \frac{(\mathrm{Cot}(\Phi) - \mu_s)}{1 + (\mu_s - \mu_c)\mathrm{Cot}(\Phi) + \mu_s \mu_c)}$$

While unloading:

$$F_d = \mu_c F_s \frac{(\mathrm{Cot}(\Phi) + \mu_s)}{1 + (\mu_s - \mu_c)\mathrm{Cot}(\Phi) + \mu_s \mu_c)}$$

Where:

$F_d$ = friction force on the sideframe column $F_s$ = force in the spring $\mu_s$ friction coefficient of the angled face on the bolster $\mu_c$ is the coefficient of friction against the sideframe column $\Phi$ is the included angle between the angled face on the bolster and the friction face bearing against the column For a given angle, a friction load factor, $C_f$ can be determined as $C_f = F_d/F_s$. This load factor $C_f$ will tend to be different depending on whether the bolster is moving up or down. A graph of upward and downward load factors as a function of wedge angle is shown in FIG. 7 based on a $\mu_s$ of 0.2 and a $\mu_c$ of 0.4, values which are thought to be roughly representative of service conditions.

When the wheels encounter a perturbation in the rail, their reaction to the perturbation will tend to transmit a force through the suspension into the rail road car body. The force transmitted will tend to be the sum of the spring force plus the friction force in the dampers. For a relatively gentle ride, it is desirable that the damping force as the wheels move up relative to the car body not be excessive, and that the damping be stronger when the car body is moving upward relative to the wheels.

With a relatively sharply angled wedge, as typified by wedges in the 30-35 degree range such as appear to be shown by Barber, and as employed in wedges known to be commonly in use, the load factor may tend to be significantly higher when the bolster is moving downward relative to the side frame than when the bolster is moving upward. It may be desirable to lessen, or reverse this relationship, as may tend to occur for angles above about 40 to 45 degrees. (See FIG. 7).

In the past, spring groups have been arranged such that the spring loading under the dampers has been proportionately small. That is, the dampers have typically been seated on side spring coils, as shown in the AAR standard spring groupings shown in the 1997 *Car & Locomotive Cyclopedia* at pages 743-746, in which the side spring coils, inner and outer as may be, are often B321, B331, B421, B422, B432, or B433 springs as compared to the main spring coils, such that the springs under the dampers have lower spring rates than the other coil combinations in the other positions in the spring group. As such, the dampers may be driven by less than 15% of the total spring stiffness of the group generally.

In U.S. Pat. No. 5,046,431 of Wagner, issued Sep. 10, 1991, the standard inboard-and-outboard gib arrangement on the truck bolster was replaced by a single central gib mounted on the side frame column for engaging the shoulders of a vertical channel defined in the end of the truck bolster. In doing this, the damper was split into inboard and outboard portions, and, further, the inboard and outboard portions, rather than lying in a common transverse vertical plane, were angled in an outwardly splayed orientation.

Wagner's gib and damper arrangement may not necessarily be desirable in obtaining a desired level of ride quality. In obtaining a soft ride it may be desirable that the truck be relatively soft not only in the vertical bounce direction, but also in the transverse direction, such that lateral track perturbations can be taken up in the suspension, rather than be transmitted to the car body, (and hence to the lading), as may tend undesirably to happen when the gibs bottom out (i.e., come into hard abutting contact with the side frame) at the limit of horizontal travel.

The present inventor has found it desirable that there be an allowance for lateral travel of the truck bolster relative to the wheels of the order of 1 to 1½ inches to either side of a neutral central position. Wagner does not appear to have been concerned with this issue. On the contrary, Wagner appears to show quite a tight gib clearance, with relatively little travel before solid contact. Furthermore, transverse displacement of the truck bolster relative to the side frame is typically resiliently resisted by the horizontal shear in the spring groups, and by the pendulum motion of the side frames rocking on the crowns of the bearing adapters, these two components being combined like springs in series. Wagner's canted dampers appear to make lateral translation of the bolster stiffer, rather than softer. This may not be advantageous for relatively fragile lading. In the view of the present inventor, while it is advantageous to increase resistance to the hunting phenomenon, it may not be advantageous to do so at the expense of increasing lateral stiffness.

It is desirable that a relatively larger portion of the spring effort be used to load the dampers, with the employment of a larger damper wedge angle. As such, the same magnitude of damping force may tend to be achieved with a combination of relatively softer springs than previously used, with a larger included angle in the wedges. Alternatively, a greater damping force than before may be achieved with wedges having a relatively modest angle with springs of the same stiffness as before, the included angle being chosen in the 45 to 65 degree range. The opportunity to vary wedge angle and spring stiffness thus gives an opportunity to tune the amount of damping in some measure. In addition, it would be advantageous to use a larger included angle in the wedge, both for these reasons, and because wedges with a larger included angle may tend to be less prone to jamming and may result in more favourable dynamic behaviour as indicated by FIG. 7.

In the damper groups themselves, it is thought that parallelogram deflection of the truck such that the truck bolster is not perpendicular to the side frame, as during hunting, may tend to cause the dampers to try to twist angularly in the damper seats. In that situation one corner of the damper may tend to be squeezed more tightly than the other. As a result, the tighter corner may try to retract relative to the less tight corner, causing the damper wedge to squirm and rotate somewhat in the pocket. This tendency to twist may also tend to reduce the squaring, or restoring force that tends to move the truck back into a condition in which the truck bolster is square relative to the side frames.

Consequently, it may be desirable to discourage this twisting motion by limiting the freedom to twist, as, for example, by introducing a groove or ridge, or keyway, or channel feature to govern the operation of the spring in the damper pocket. It may also be advantageous to use a split wedge to discourage twisting, such that one portion of the wedge can move relative to the other, thus finding a different position in a linear sense without necessarily forcing the other portion to twist. Further still, it may be advantageous to employ a means for encouraging a laterally inboard portion of the damper, or damper group, to be biased to its most laterally inboard position, and a laterally outboard portion of the damper, or the damper group, to be biased to its most laterally outboard position. In that way, the moment arm of the restoring force may tend to remain closer to its largest value. One way to do this, as described in the description of the invention, below, is to add a secondary angle to the wedge.

In the terminology herein, wedges have a primary angle $\Phi$, namely the included angle between (a) the sloped damper pocket face mounted to the truck bolster, and (b) the side frame column face, as seen looking from the end of the bolster toward the truck center. This is the included angle described above. A secondary angle is defined in the plane of angle $\Phi$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper.

The secondary angle $\beta$ is defined as the lateral rake angle seen when looking at the damper parallel to the plane of angle $\Phi$. As the suspension works in response to track perturbations, the wedge forces acting on the secondary angle will tend to urge the damper either inboard or outboard according to the angle chosen. Inasmuch as the tapered region of the wedge may be quite thin in terms of vertical through-thickness, it may be desirable to step the sliding face of the wedge (and the co-operating face of the bolster seat) into two or more portions. This may be particularly so if the angle of the wedge is large.

Split wedges and two part wedges having a chevron, or chevron like, profile when seen in the view of the secondary angle can be used. Historically, split wedges have been deployed as a pair over a single spring, the split tending to permit the wedges to seat better, and to remain better seated, under twisting condition than might otherwise be the case. The chevron profile of a solid wedge may tend to have the same intent of preventing rotation of the sliding face of the wedge relative to the bolster in the plane of the primary angle of the wedge. Split wedges and compound profile wedges can be employed in pairs as described herein.

In a further variation, where a single broad wedge is used, with a compound or other profile, it may be desirable to seat the wedge on two or more springs in an inboard-and-outboard orientation to create a restoring moment such as might not tend to be achieved by a single spring alone. That is, even if a single large wedge is used, the use of two, spaced apart springs may tend to generate a restoring moment if the wedge tries to twist, since the deflection of one spring may then be greater that the other.

When the dampers are placed in pairs, either immediately side-by-side or with spacing between the pairs, the restoring moment for squaring the truck will tend not only to be due to the increase in compression to one set of springs due to the extra tendency to squeeze the dampers downward in the pocket, but due to the difference in compression between the springs that react to the extra squeezing of one diagonal set of dampers and the springs that act against the opposite diagonal pair that will tend to be less tightly squeezed.

The bolster is typically permitted to travel laterally to either side relative to the side frames, and for the side frames to have limited angular rotation about an axis parallel to the longitudinal axis of the rail car more generally. It is desirable that after an initial perturbation, the bolster return to a central, angularly squared position. An increase in the normal force at the friction face, as discussed, may tend to return the side frames to a "square" condition relative to the truck bolster. In sideways displacement, return of the truck to a centered position may tend to cease when the friction in the dampers matches the lateral restoring force in the spring groups. This tendency may be reduced by the tendency of the springs to return to a laterally centered position as the truck works in the vertical bounce and warp conditions. However, it may be desirable to enhance this restoring tendency. In the view of the present inventor it may be advantageous to install some, or all of the springs in the inner and outer rows of the spring group at a slight anhedral angle relative to each other, so that they form a symmetrical V.

SUMMARY OF THE INVENTION

In an aspect of the invention there is a rail road freight car having at least one rail car unit. The rail road freight car is supported by three piece rail car trucks for rolling motion along rail road tracks. At least a first rail car truck of the three piece rail car trucks has a rigid truck bolster and a pair of first and second side frame assemblies. The truck bolster has first and second ends. The first rail car truck has a suspension including first and second spring groups mounted between the first and second ends of the truck bolster and the first and second side frames respectively. The rail car truck suspension has a natural vertical bounce frequency of less than 4.0 Hz. when the rail road freight car is unloaded. A first set of friction dampers is mounted between the truck bolster and the first side frame assembly. A second set of friction dampers is mounted between the truck bolster and the second side frame assembly. The first set of friction dampers includes at least a first friction damper and a second friction damper. The first and second friction dampers are independently biased, and the second friction damper is mounted more laterally outboard than the first friction damper.

In an additional feature of that aspect of the invention, the set of dampers includes at least third and fourth friction dampers. The third and fourth friction dampers are independently biased, and the third friction damper is mounted more laterally outboard than the fourth friction damper. The third friction damper is longitudinally spaced relative to the first friction damper, and the fourth friction damper is longitudinally spaced relative to the second friction damper. In another additional feature, the suspension is at rest on a straight track, a transverse vertical plane bisects the truck bolster to define a plane of symmetry, and the first, second. third and fourth friction dampers are arranged in a symmetrical formation relative to the transverse vertical plane.

In yet another additional feature, a longitudinal vertical plane intersects the side frame and the first, third, second and fourth dampers are symmetrically arranged in a symmetrical formation relative to the longitudinal vertical plane. In still another additional feature, the four dampers are arranged in a formation that is both longitudinally and transversely symmetrical.

In a further additional feature, the first damper has a first friction face. The second damper has a second friction face. The first friction face lies in a first plane. The second friction face lies in a second plane, and the first and second planes have mutually parallel normal vectors. In yet a further additional feature, the first damper has a first friction face. The second damper has a second friction face, and the first and second friction faces are coplanar. In still a further additional feature, the first and second dampers sit side-by-side. In another additional feature, the first and second dampers are transversely spaced from each other. In still another additional feature, the first and second dampers are separated by a land, and a spring of one of the spring groups acts against the land.

In yet another additional feature, the natural vertical bounce frequency is less than 3 Hz when the rail road car is unladen. In still yet another additional feature, the first and second spring groups each have a vertical bounce spring rate, and the vertical bounce spring rate is less than 20,000 lbs per inch, per spring group. In an additional feature, the first and second spring groups each have a vertical bounce spring rate, and the vertical bounce spring rate is less than 12,000 lbs per inch, per spring group.

In another additional feature, the side frames have wear plates facing the bolster ends. The sets of friction dampers are mounted in pockets defined in the ends of the bolsters, and the friction dampers have friction faces bearing against the wear plates of the side frames. In yet another additional feature, the first and second friction dampers bear on a common wear plate. In still another additional feature, the wear plate presents an uninterrupted surface to the first and second dampers.

In a further additional feature, the first and second dampers each include an angled wedge seated in one of the pockets of the bolster. In yet a further additional feature, the angled wedge has a first surface slidingly engaged in a first pocket of the pockets of the bolster. The first surface is inclined at a primary angle defined between the first surface and the friction face thereof. The primary angle is greater than 35 degrees. The pocket has a mating inclined surface. In still a further feature, the wedge first surface has a secondary angle cross-wise to the first angle.

In still yet a further additional feature, the first damper is biased laterally inboard and the second damper is biased laterally outboard. In another additional feature, a friction discouraging material is applied to enhance sliding of the first damper relative to the bolster pocket. In yet another additional feature, at least one of the dampers is a split damper. In still another additional feature, the split damper is laterally asymmetrically biased in a direction chosen from (a) laterally inboard; and (b) laterally outboard. In still yet another additional feature, the angled surface is stepped. In a further additional feature, the wedge has an inclined chevron cross-section. The chevron has asymmetric wings. In another additional feature, the wedge has an inclined chevron cross-section, one wing of the chevron lying at a steeper angle than the other. In yet another additional feature, the wedge has a pair of first and second inclined flanks. One of the flanks is steeper than the other.

In still another additional feature, the first spring group has an overall vertical bounce spring rate, $k_1$. A portion of the spring group provides biasing for the dampers. The portion has a summed vertical spring rate, $k_2$, that is at least 20% of the overall vertical bounce spring rate. In still yet another additional feature, the ratio of $k_2$:$k_1$ is at least as great as 1/4. In another additional feature, the ratio of $k_2$:$k_1$ is at least as great as 1/3. In yet another additional feature, the ratio of $k_2$:$k_1$ is at least as great as 4/9. In another additional feature, the spring groups include coil springs and first and second dampers seat on coils having an outer diameter of greater than 7½ inches. In still another additional feature. the spring groups include coil springs and the first and second dampers seat on coils having an outer diameter of greater than 5 inches. In yet another additional feature, the side frames are mounted to a wheelset, and the truck bolster has at least one inch of lateral travel to either side relative to the wheelset. In a further additional feature, the first side frame is swingingly mounted on wheel bearings, and the first side frame, by itself: has a transverse swinging natural frequency of less than 1.4 Hz. In still a further additional feature, the side frames are mounted on a wheelset. The first truck has a natural frequency for lateral displacement of the truck bolster relative to the wheelset; and the natural frequency for lateral displacement is less than 1.0 Hz.

In yet a further additional feature, the first truck has an AAR rating of at least "70 Ton". In still a further additional feature, the first truck has a capacity chosen from the set of rail road freight car truck capacities consisting of (a) 70 Ton; (b) 70 Ton Special; (c) 100 Ton; (d) 110 Ton; and (e) 125 Ton. In another additional feature. the first truck has a wheelset having wheels of greater than 33 inches in diameter.

In a further additional feature, each of the side frames has a pair of side frame columns. The side frame columns have bearing surfaces for engaging the friction dampers. A bolster window is defined therebetween. The bolster window has a height and a width. The width is measured between the friction faces and the width is greater than the depth. In another additional feature, the width is at least 8/7 as large as the depth. In still another additional feature, the width is at least 24 inches. In yet another additional feature, the first and second side frames each respectively have a spring seat for receiving, respectively. The first and second spring groups, and the spring seat has a transverse width of greater than 15 inches. In still yet another additional feature, the spring seat has a length of at least 24 inches.

In a further additional feature, at least one rail car unit has ballasting supported by the first truck. In yet a further additional feature, the rail road car is an articulated rail road car. In still a further additional feature, the rail car unit is an end car unit of the articulated rail road car. The end car unit has a coupler end and an articulated connector end, and the first rail car truck supports the coupler end of the end car unit. In another additional feature, the end car unit, when empty, has a weight distribution asymmetrically biased toward the first truck. In yet another additional feature, the end car unit has ballasting distributed asymmetrically heavily toward the coupler end thereof. In still another additional feature, the rail car unit has a deck carried above the first truck upon which lading can be carried. In a further additional feature, the deck is surmounted by a housing for protection the lading. In yet a further additional feature, the housing has doors giving access to the deck. In still a further additional feature, the deck is a circus-loading deck upon which wheeled vehicles can be conducted. In another additional feature, the rail road freight car is an auto-rack rail road car.

In yet another additional feature, the rail car unit has at least a first coupler end, and a coupler mounted thereat. The coupler has less than 25/32" of slack. In still another additional feature, the rail car unit has at least a first end, and a coupler mounted thereat. The couplers are chosen from the set of coupler families consisting of (a) AAR Type F couplers; (b) AAR Type H couplers; and (c) AAR Type CS couplers. In still yet another additional feature, the rail car unit has at least a first coupler end, draft gear mounted thereat and a coupler mounted to the draft gear. The draft gear has a deflection of less 25 than 2½ inches at 500,000 lbs buff load. In a further additional feature, the rail car unit has at least a first coupler end, draft gear mounted thereat and a coupler mounted to the draft gear. The draft gear has a deflection of less than 1 inch at 700,000 lbs buff load.

In another aspect of the invention there is a railroad three piece freight car truck. The truck has a rigid truck bolster and a pair of first and second side frame assemblies. The truck bolster has first and second ends. A resilient suspension includes first and second spring groups mounted between the first and second ends of the truck bolster and the first and second side frames respectively. The resilient suspension of the first of the trucks has a vertical bounce spring rate of less than 20,000 lbs per spring group. A first set of friction dampers is mounted between the truck bolster and the first side frame assembly. A second set of friction dampers is mounted between the truck bolster and the second side frame assembly. The set of friction dampers includes at least a first friction damper and a second friction damper. The first and second friction dampers are independently biased, and the first friction damper is mounted more laterally outboard than the second friction damper.

In another aspect of the invention there is a rail road freight car three piece truck. The truck has a bolster, a pair of first and second side frames, a pair of first and second spring groups, and a wheelset. The sideframes are mounted to the wheelset, and the bolster is mounted transversely relative to the side frames. The spring groups are mounted in the sideframes. The bolster has first and second ends resiliently supported by the first and second spring groups. Each of the spring groups has a vertical spring rate of less than 20,000 lbs/in. A first set of friction dampers is mounted to act between the first end of the truck bolster and the first side frame, and a second set of friction dampers is mounted to act between the second end of the bolster and the second side frame. Each of the sets of friction dampers include four dampers arranged in a four cornered layout.

In another aspect of the invention there is a railroad freight car three piece truck for rolling along rail road tracks. The tracks have a gauge width. The three piece truck has a bolster, a pair of first and second side frames, a pair of first and second spring groups, and a pair of first and second axles each having wheels mounted at opposite ends thereof. The wheelset has a longitudinal wheelbase and a transverse track width corresponding to the gauge width. The wheelbase is at least 1.3 times as great as the gauge width. The side frames are mounted to the wheelset, and the bolster is mounted transversely relative to the side frames. The spring groups are mounted in the sideframes. The bolster has first and second ends resiliently supported by the first and second spring groups. A first set of friction dampers is mounted to act between the first end of the truck bolster and the first side frame, and a second set of friction dampers is mounted to act between the second end of the bolster and the second side frame. Each of the sets of friction dampers include. four individually sprung dampers arranged in a four cornered layout.

In another aspect of the invention there is a railroad freight car three piece truck. The truck has a bolster, a pair of first and second side frames, a pair of first and second spring groups, and a wheelset. The side frames are mounted to the wheelset, and the bolster is mounted transversely relative to the side frames. The spring groups are mounted in the side frames. The bolster has first and second ends resiliently supported by the first and second spring groups. A first set of friction dampers is mounted to act between the first end of the truck bolster and the first side frame, and a second set of friction dampers is mounted to act between the second end of the bolster and the second side frame. Each of the sets of friction dampers include four individually sprung dampers arranged in a four cornered layout. The four dampers include a first transversely inboard damper and a first transversely outboard damper, seated in respective first and second damper pockets. The first transversely inboard damper is biased to a transversely inboard position in the first damper pocket, and the first transversely outboard damper is biased to 5 a transversely outboard position in the second damper pocket.

In another aspect of the invention there is a railroad freight car three piece truck. The truck has a bolster, a pair of first and second side frames, a pair of first and second spring groups, and a wheelset. The side frames are mounted to the wheelset, and the bolster is mounted transversely relative to the side frames. The spring groups are mounted in the side frames. The bolster has first and second ends resiliently supported by the first and second spring groups. A first set of friction dampers is mounted to act between the first end of the truck bolster and the first side frame, and a second set of friction dampers is mounted to act between the second end of the bolster and the second side frame. Each of the sets of friction dampers include four individually sprung dampers arranged in a four cornered layout. The dampers are wedge shaped. The wedge shapes have a primary angle of greater than 35 degrees.

In another aspect of the invention there is a railroad freight car three piece truck. The truck has a bolster, a pair of first and second side frames, a pair of first and second spring groups, and a wheelset. The side frames are mounted to the wheelset, and the bolster is mounted transversely relative to the side frames. The spring groups are mounted in the side frames. The bolster has first and second ends resiliently supported by the first and second spring groups. A first set of friction dampers is mounted to act between the first end of the truck bolster and the first side frame. A second set of friction dampers is mounted to act between the second end of the bolster and the second side frame. Each of the sets of friction dampers include four dampers arranged in a four cornered layout. Each of the bolster ends has a set of damper pockets for receiving the first and second sets of the dampers. The dampers are damper wedges having a spring loaded base portion, a friction face for engaging a friction wear plate, and a sliding face for engaging the damper pockets. The wedges have a primary wedge angle between the friction face and the sliding face of greater than 35 degrees.

In another aspect of the invention there is a railroad freight car three piece truck. The truck has a bolster, a pair of first and second side frames, a pair of first and second spring groups, and a wheelset. The side frames are mounted to the wheelset, and the bolster is mounted transversely relative to the side frames. The spring groups are mounted in the side frames. The bolster has first and second ends resiliently supported by the first and second spring groups. A first set of friction dampers are mounted to act between the first end of the truck bolster and the first side frame, and a second set of friction dampers are mounted to act between the second end of the bolster and the second side frame. Each of the sets of friction dampers include four dampers arranged in a four cornered layout. The dampers are wedge shaped. The wedge shapes have a primary angle of greater than 35 degrees.

In another aspect of the invention there is a rail road freight car three piece truck. The truck has a bolster, a pair of first and second side frames, a pair of first and second spring groups, and a wheelset. The side frames are mounted to the wheelset, and the bolster is mounted transversely relative to the side frames. The spring groups are mounted in the side frames. The bolster has first and second ends resiliently supported by the first and second spring groups. Each of the spring groups have an overall vertical spring rate. Each of the spring groups include a plurality of springs. A first set of friction dampers are mounted to act between the first end of the truck bolster and the first side frame, and a second set of friction dampers are mounted to act between the second end of the bolster and the second side frame. Each of the sets of friction dampers are sprung on damper loading members of plurality of springs of the spring groups. The damper loading member of each of the spring groups account for at least 25% of the vertical spring rate of each of the spring groups.

In another aspect of the invention there is a railroad freight car. The freight car has a rail road car body carried on rail road car trucks for rolling motion along rail road car tracks. The rail road car body has a deck for carrying lading, and side sills running alongside the deck. The body has a first end and a second end. The body has a coupler mounted to at least the first end of the body. A main bolster is mounted to the body adjacent to the first end of the body longitudinally inboard of the coupler. The main bolster extends transversely between the side sills. The main bolster has first and second arms extending laterally outboard from a centreplate. The centreplate is mounted to a first of the rail road car trucks on a vertical axis defining a truck center. The first rail road car truck has wheels spaced laterally outboard a half track gauge width distance from the truck center. The arms of the main bolster has a wheel clearance portion extending laterally away from the truck center over a range of distance bracketing the halftrack gauge width distance. The wheel clearance portion of the main bolster lying at least 7 inches higher than the first height.

In another aspect of the invention there is a railroad freight car. The freight car has a rail road car body carried on rail road car trucks for rolling motion along rail road car tracks. The rail road car body has a deck for carrying lading, and side sills running alongside the deck. The body has a first end and a second end. The body has a coupler mounted to at least the first end of the body. A main bolster is mounted to the body adjacent to the first end of the body longitudinally inboard of the coupler. The main bolster has first and second arms extending laterally outboard from a center plate. The first rail road car truck has wheels for running along the rail road track. The arms of the main bolster has a wheel clearance relief defined therein. The arms of the bolster has a first depth of section at the clearance relief and a second depth of section laterally outboard of the clearance relief. The second depth of section are greater than the first depth of section.

In another aspect of the invention there is a three piece rail road car truck. The truck has a first rail car truck having a truck bolster and a pair of first and second side frame assemblies. The truck bolster has first and second ends. First and second spring groups are mounted between the first and second ends of the truck bolster and the first and second side frames respectively. A first set of friction dampers are mounted between the truck bolster and the first side frame assembly. A second set of friction dampers are mounted between the truck bolster and the second side frame assembly. The first set of friction dampers include at least a first friction damper. The first spring group has at least a first spring and a second spring. The first friction damper is sprung on the first and second springs. The first spring is mounted laterally outboard relative to the first spring.

DETAILED DESCRIPTION OF THE INVENTION

Figure 1A:
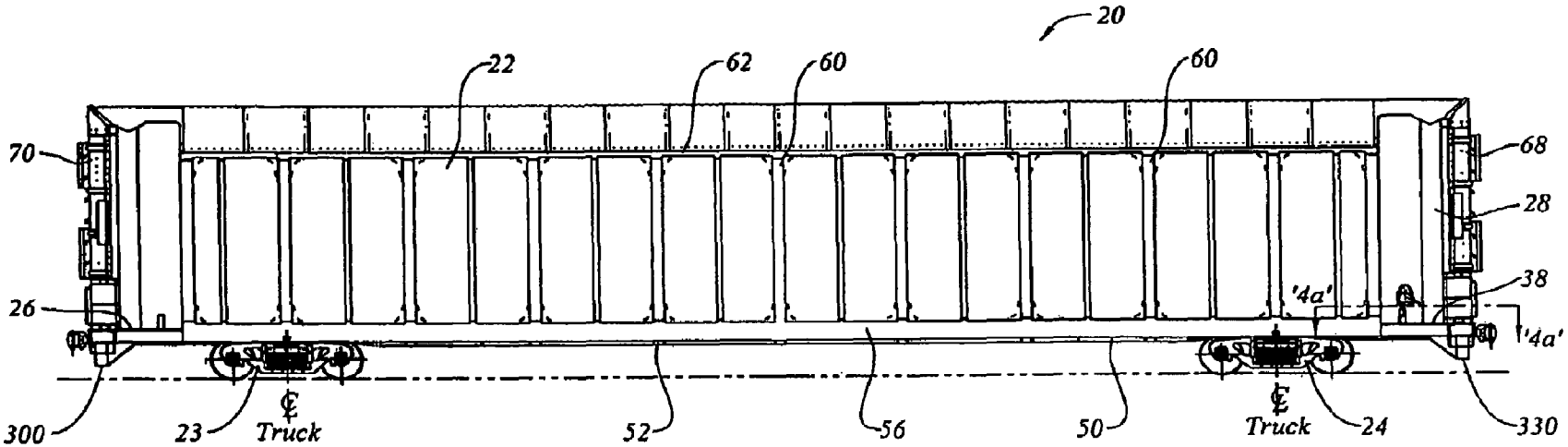
FIG. 1*a* shows a side view of a single unit auto rack rail road car.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit, indicated as CL—Rail Car. The term "longitudinally inboard", or "longitudinally outboard" is a distance taken relative to a mid-span lateral section of the car, or car unit. Pitching motion is angular motion of a rail car unit about a horizontal axis perpendicular to the longitudinal direction. Yawing is angular motion about a vertical axis. Roll is angular motion about the longitudinal axis.

Reference is made in this description to rail car trucks and in particular to three piece rail road freight car trucks. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs, "70 Ton" corresponds to 220,000 lbs, "100 Ton" corresponds to 263,000 lbs, and "125 Ton" corresponds to 315,000 lbs. In each case the load limit per truck is then half the maximum gross car weight on rail. Two other types of truck are the "110 Ton" truck for 286,000 Lbs GWR and the "70 Ton Special" low profile truck sometimes used for auto rack cars. Given that the rail road car trucks described herein tend to have both longitudinal and transverse axes of symmetry, a description of one half of an assembly may generally also be intended to describe the other half as well, allowing for differences between right hand and left hand parts.

Figure 1B:
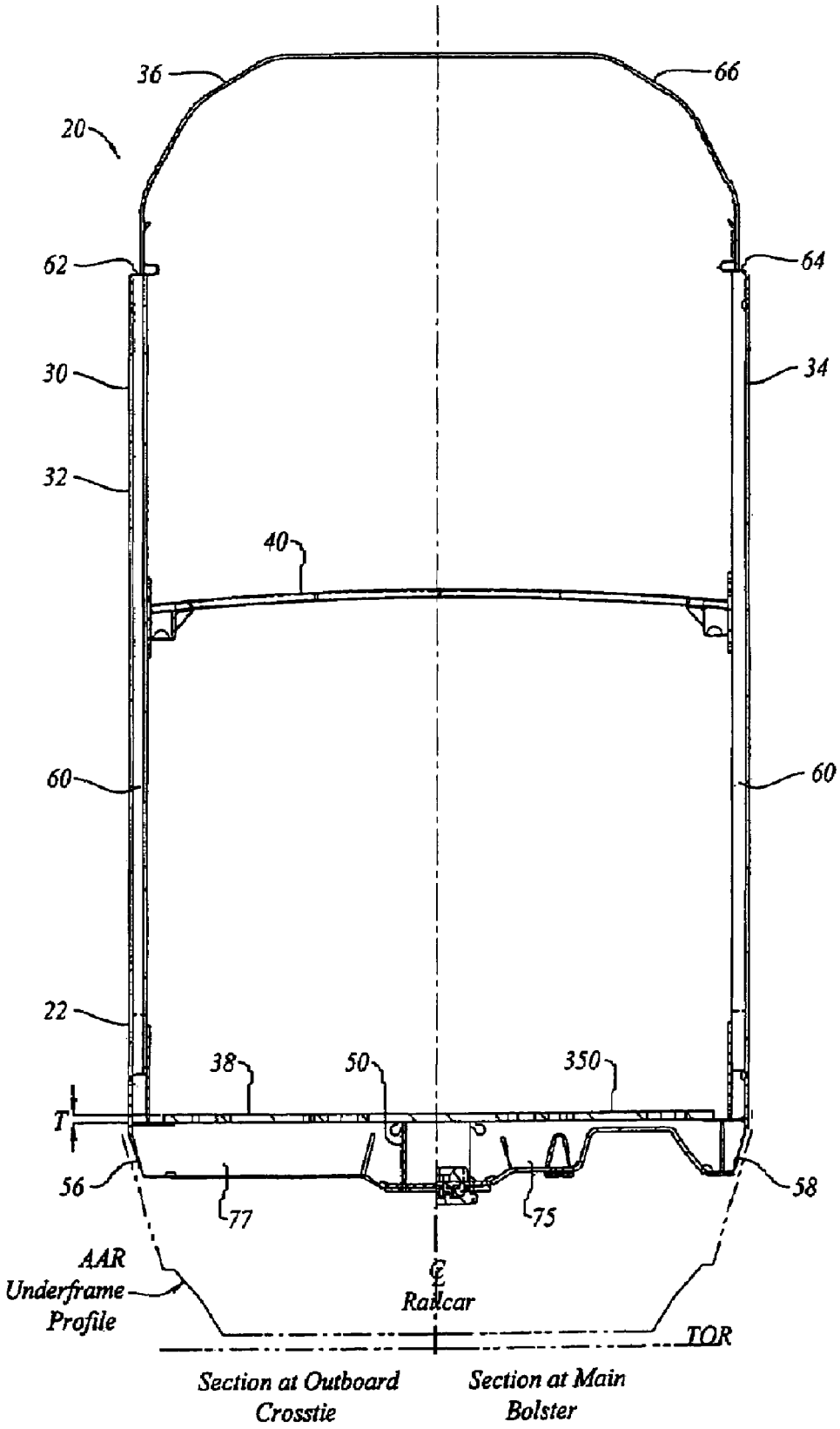
FIG. 1*b* shows a cross-sectional view of the auto-rack rail road car of FIG. 1*a* in a bi-level configuration, one half section of FIG. 1*b* being taken through the main bolster and the other half taken looking at the cross-tie outboard of the main bolster.

FIGS. 1*a*, 2*a*, 2*b*, 3*a*, and 3*b*, show different types of rail road freight cars in the nature of auto rack rail road cars, all sharing a number of similar features. FIG. 1*a* (side view) shows a single unit autorack rail road car, indicated generally as 20. It has a rail car body 22 supported for rolling motion in the longitudinal direction (i.e., along the rails) upon a pair of three-piece rail road freight car trucks 23 and 24 mounted at main bolsters at either of the first and second ends 26, 28 of rail car body 22. Body 22 has a housing structure 30, including a pair of left and right hand sidewall structures 32, 34 and an over-spanning canopy, or roof 36 that co-operate to define an enclosed lading space. Body 22 has staging in the nature of a main deck 38 running the length of the car between first and second ends 26, 28 upon which wheeled vehicles, such as automobiles can be conducted by circus-loading. Body 22 can have staging in either a bi-level configuration, as shown in FIG. 1*b*, in which a second, or upper deck 40 is mounted above main deck 38 to permit two layers of vehicles to be carried; or a tri-level configuration with a mid-level deck, similar to deck 40, and a top deck, also similar to deck 40, are mounted above each other, and above main deck 38 to permit three layers of vehicles to be carried. The staging, whether bi-level or tri-level, is mounted to the sidewall structures 32, 34. Each of the decks defines a roadway, trackway, or pathway, by which wheeled vehicles such as automobiles can be conducted between the ends of rail road car 20.

A through center sill 50 extends between ends 26, 28. A set of cross-bearers 52 extend to either side of center sill 50, terminating at side sills 56, 58 that run the length of car 20 parallel to outer sill 50. Main deck 38 is supported above cross-bearers 52 and between side sills 56, 58. Sidewall structures 32, 34 each include an array of vertical support members, in the nature of posts 60, that extend between side sills 56, 58, and top chords 62, 64. A corrugated sheet roof 66 extends between top chords 62 and 64 above deck 38 and such other decks as employed. Radial arm doors 68, 70 enclose the end openings of the car, and are movable to a closed position to inhibit access to the interior of car 20, and to an open position to give access to the interior. Each of the decks has bridge plate fittings (not shown) to permit bridge plates to be positioned between car 20 and an adjacent car when doors 68 or 70 are opened to permit circus loading of the decks. Both ends of car 20 have couplers and draft gear for connecting to adjacent rail road cars.

Two—Unit Articulated Auto Rack Car

Figure 2B:
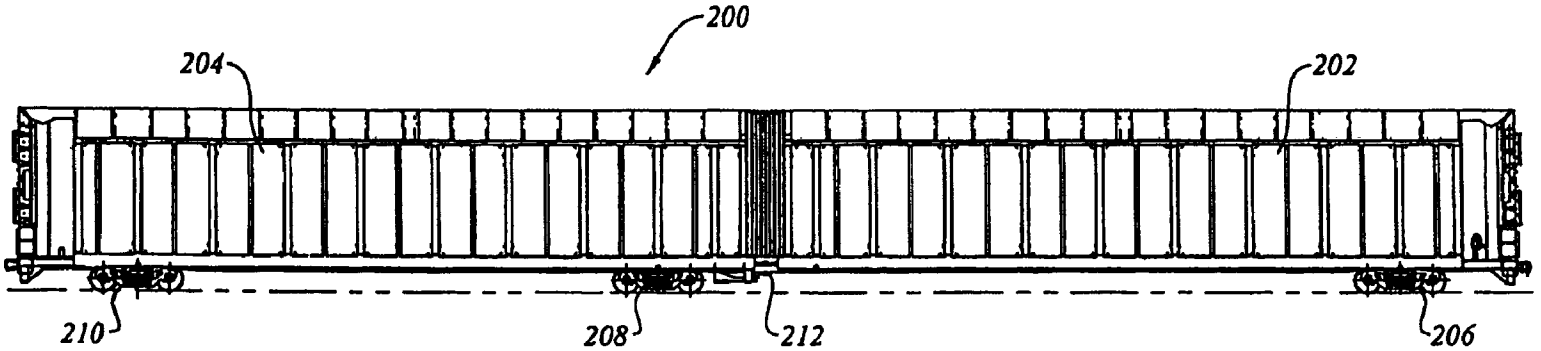
FIG. 2*b* shows a side view of an alternate auto rack rail road car to that of FIG. 2*a*, having a cantilevered articulation.
Figure 2A:
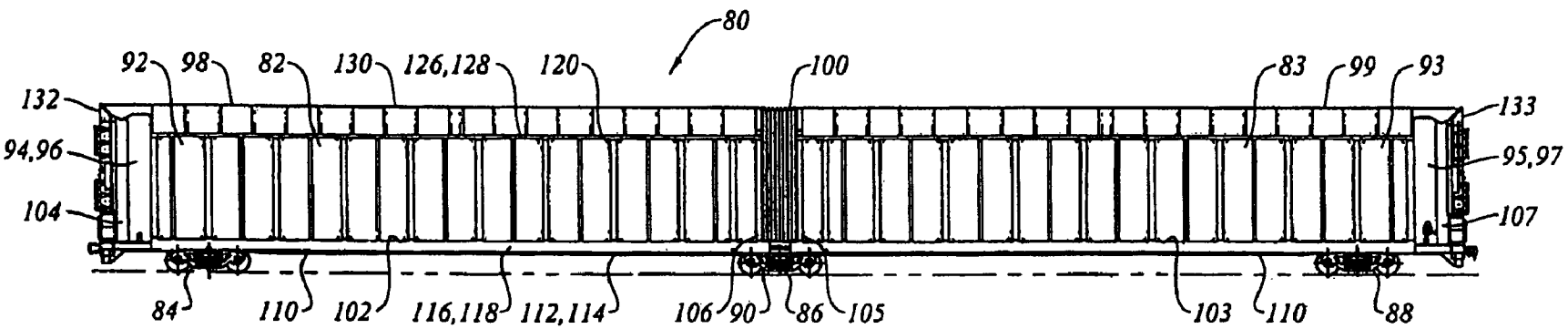
FIG. 2*a* shows a side view of a two unit articulated auto rack rail road car.

Similarly, FIG. 2*a* shows a two unit articulated auto rack rail road car, indicated generally as 80. It has a first rail car unit body 82, and a second rail car unit body 85, both supported for rolling motion in the longitudinal direction (i.e., along the rails) upon rail car trucks 84, 86 and 88. Rail car trucks 84 and 88 are mounted at main bolsters at respective coupler ends of the first and second rail car unit bodies 83 and 84. Truck 86 is mounted beneath articulated connector 90 by which bodies 83 and 84 are joined together. Each of bodies 83 and 84 has a housing structure 92, 93, including a pair of left and right hand sidewall structures 94, 96 (or 95, 97) and a canopy, or roof 98 (or 99) that define an enclosed lading space. A bellows structure 100 links bodies 82 and 83 to discourage entry by vandals or thieves.

Each of bodies 82, 83 has staging in the nature of a main deck similar to deck 38 running the length of the car unit between first and second ends 104, 106 (105, 107) upon which wheeled vehicles, such as automobiles can be conducted. Each of bodies 82, 83 can have staging in either a bi-level configuration, as shown in FIG. 1*b*, or a tri-level configuration. Other than brake fittings, and other minor fittings, car unit bodies 82 and 83 are substantially the same, differing in that car body 82 has a pair of female sidebearing arms adjacent to articulated connector 90, and car body 83 has a co-operating pair of male side bearing arms adjacent to articulated connector 90.

Each of car unit bodies 82 and 83 has a through center sill 110 that extends between the first and second ends 104, 106 (105, 107). A set of cross-bearers 112, 114 extend to either side of center sill 110, terminating at side sills 116, 118. Main deck 102 (or 103) is supported above cross-bearers 112, 114 and between side sills 116, 118. Sidewall structures 94, 96 and 95, 97 each include an array of vertical support members, in the nature of posts 120, that extend between side sills 116, 118, and top chords 126, 128. A corrugated sheet roof 130 extends between top chords 126 and 128 above deck 102 and such other decks as may be employed.

Radial arm doors 132, 134 enclose the coupler end openings of car bodies 82 and 83 of rail road car 80, and are movable to respective closed positions to inhibit access to the interior of rail road car 80, and to respective open positions to give access to the interior thereof. Each of the decks has bridge plate fittings (upper deck fittings not shown) to permit bridge plates to be positioned between car 80 and an adjacent auto rack rail road car when doors 132 or 134 are opened to permit circus loading of the decks.

Figures 1C, 1D:
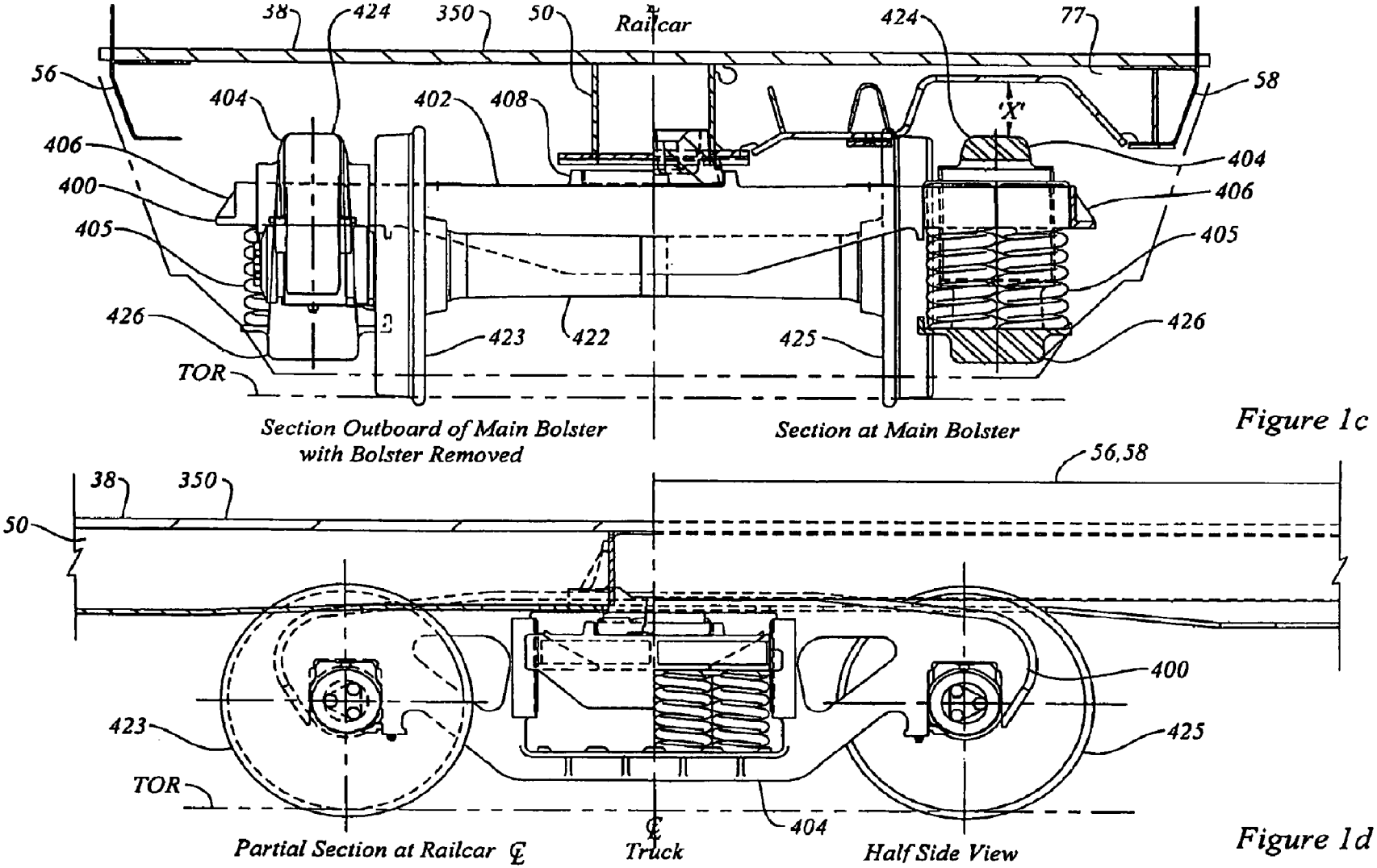
FIG. 1*c* shows a half sectioned partial end view of the rail road car of FIG. 1*a* illustrating the wheel clearance below the main deck, half of the section being taken through the main bolster, the other half section being taken outboard of the truck with the main bolster removed for clarity.
FIG. 1*d* shows a partially sectioned side view of the rail road car of FIG. 1*c* illustrating the relationship of the truck, the bolster and the wheel clearance, below the main deck.

For the purposes of this description, the cross-section of FIG. 1*b* can be considered typical also of the general structure of the other railcar unit bodies described below, whether 82, 85, 202, 204, 142, 144, 146, 222, 224 or 226. It should be noted that FIG. 1*b* shows a stepped section in which the right hand portion shows the main bolster 75 and the left hand section shows a section looking at the cross-tie 77 outboard of the main bolster. The sections of FIGS. 1*b* and 1*e* are typical of the sections of the end units described herein at their coupler end trucks, such as trucks 232, 148, 84, 88, 210, 206. The upward recess in the main bolster 75 provides vertical clearance for the side frames (typically 7" or more). That is, the clearance 'X' in FIG. 1*c* is about 7 inches in one embodiment between the side frames and the bolster for an unladen car at rest.

As may be noted, the web of main bolster 75 has a web rebate 79 and a bottom flange that has an inner horizontal portion 69, an upwardly stepped horizontal portion 71 and an outboard portion 73 that deepens to a depth corresponding to the depth of the bottom flange of side sill 58. Horizontal portion 69 is carried at a height corresponding generally to the height of the bottom flange of side sill 58, and portion 71 is stepped upwardly relative to the height of the bottom flange of side sill 58 to provide greater vertical clearance for the side frame of truck 23 or 24 as the case may be.

Three or More Unit Articulated Auto Rack Car

Figure 3B:
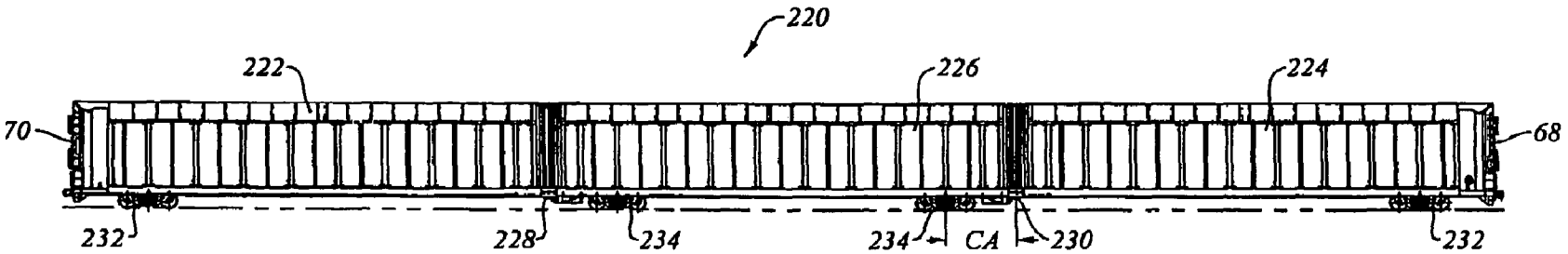
FIG. 3*b* shows a side view of an alternate three unit auto rack rail road car to the articulated rail road unit car of FIG. 3*b*, having cantilevered articulations.
Figure 3A:
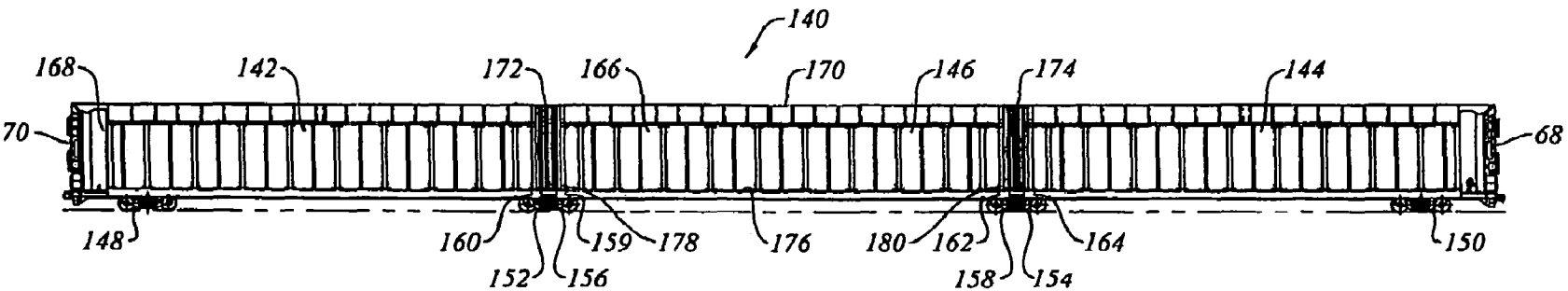
FIG. 3*a* shows a side view of a three unit auto rack rail road car.

FIG. 3*a* shows a three unit articulated autorack rail road car, generally as 140. It has a first end rail car unit body 142, a second end rail car unit body 144, and an intermediate rail car unit body 146 between rail car unit bodies 142 and 144. Rail car unit bodies 142, 144 and 146 are supported for rolling motion in the longitudinal direction (i.e., along the rails) upon rail car trucks 148, 150, 152, and 154. Rail car trucks 148 and 150 are "coupler end" trucks mounted at main bolsters at respective coupler ends of the first and second rail car bodies 142 and 144. Trucks 152 and 154 are "interior" or "intermediate" trucks mounted beneath respective articulated connectors 156 and 158 by which bodies 142 and 144 are joined to body 146. For the purposes of this description, body 142 is the same as body 82, and body 144 is the same as body 83. Rail car body 146 has a male end 159 for mating with the female end 160 of body 142, and a female end 162 for mating with the male end 164 of rail car body 144.

Body 146 has a housing structure 166 like that of FIG. 1*b*, that includes a pair of left and right hand sidewall structures 168 and a canopy, or roof 170 that co-operate to define an enclosed lading space. Bellows structures 172 and 174 link bodies 142, 146 and 144, 146 respectively to discourage entry by vandals or thieves.

Body 146 has staging in the nature of a main deck 176, similar to deck 38, running the length of the car unit between first and second ends 178, 180 defining a roadway upon which wheeled vehicles, such as automobiles can be conducted. Body 146 can have staging in either a bi-level configuration or a tri-level configuration, to cooperate with the staging of bodies 142 and 144.

Other than brake fittings, and other ancillary features, car bodies 142 and 144 are substantially the same, differing to the extent that car body 142 has a pair of female sidebearing arms adjacent to articulated connector 156, and car body 144 has a co-operating pair of male side bearing arms adjacent to articulated connector 158.

Other articulated auto-rack cars of greater length can be assembled by using a pair of end units, such as male and female end units 82 and 83, and any number of intermediate units, such as intermediate unit 146, as may be suitable. In that sense, rail road car 140 is representative of multi-unit articulated rail road cars generally.

Alternate Configurations

Alternate configurations of multi-unit rail road cars are shown in FIGS. 2*b* and 3*b*. In FIG. 2*b*, a two unit articulated auto-rack rail road car is indicated generally as 200. It has first and second rail car unit bodies 202, 204 supported for rolling motion in the longitudinal direction by three rail road car trucks, 206, 208 and 210 respectively. Rail car unit bodies 202 and 204 are joined together at an articulated connector 212. In this instance, while rail car bodies 202 and 204 share the same basic structural features of rail car body 22, in terms of a through center sill, cross-bearers, side sills, walls and canopy, and vehicles decks, rail car body 202 is a "two-truck" body, and rail car body 204 is a single truck body. That is, rail car body 202 has main bolsters at both its first, coupler end, and at its second, articulated connector end, the main bolsters being mounted over trucks 206 and 208 respectively. By contrast, rail car body 204 has only a single main bolster, at its coupler end, mounted over truck 210. Articulated connector 212 is mounted to the end of the respective center sills of rail car bodies 202 and 204, longitudinally outboard of rail car truck 208. The use of a cantilevered articulation in this manner, in which the pivot center of the articulated connector is offset from the nearest truck center, is described more fully in my co-pending U.S. patent application Ser. No. 09/614,815 for a Rail Road Car with Cantilevered Articulation filed Jul. 12, 2000, incorporated herein by reference, now U.S. Pat. No. 7,047,889, and may tend to permit a longer car body for a given articulated rail road car truck center distance as therein described.

Figure 3C:
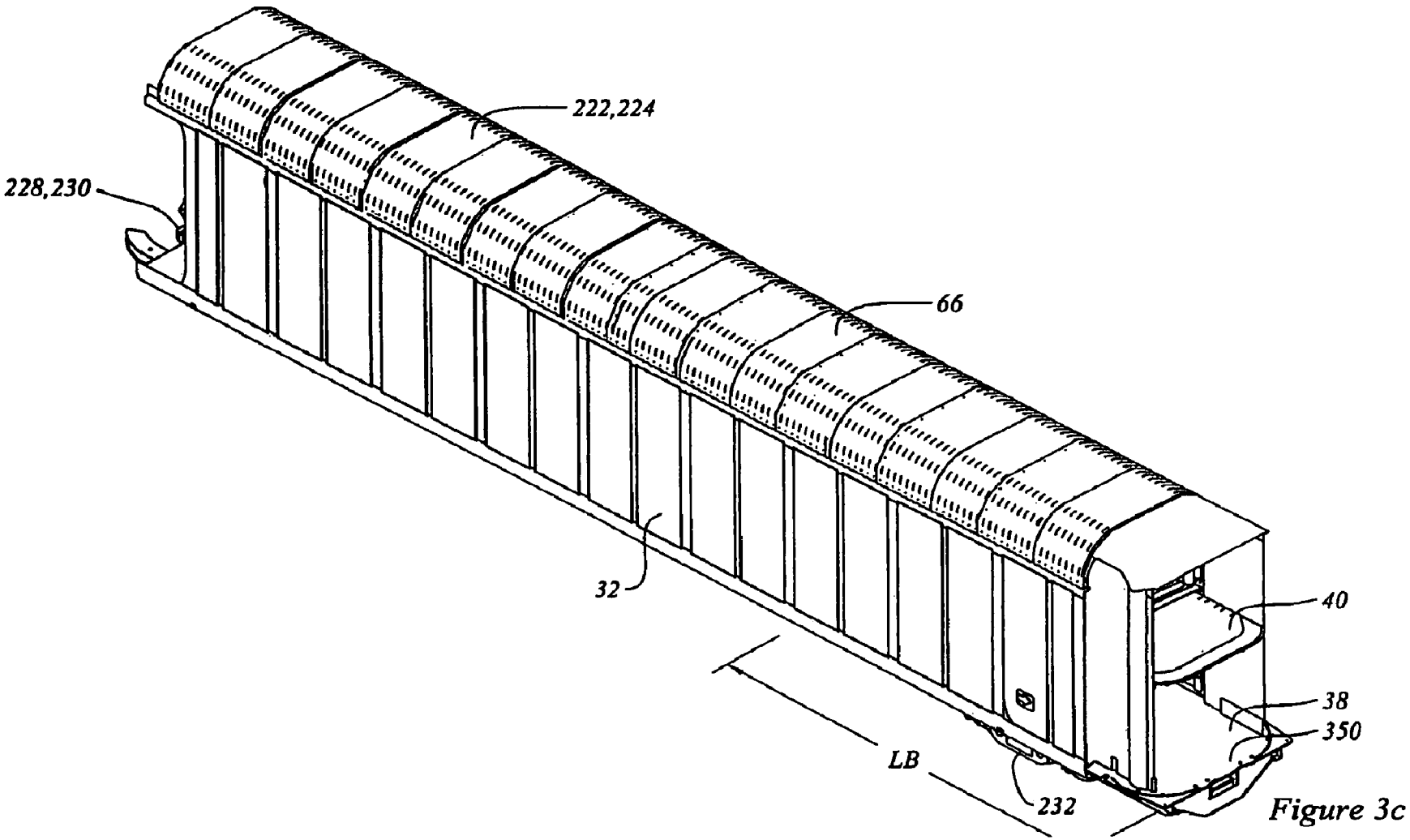
FIG. 3*c* shows an isometric view of an end unit of the three unit auto rack rail road car of FIG. 3*b;*

FIG. 3*b* shows a three-unit articulated rail road car 220 having first end unit 222, second end unit 224, and intermediate unit 226, with cantilevered articulated connectors 228 and 230. End units 222 and 224 are single truck units of the same construction as car body 204. Intermediate unit 226 is a two truck unit having similar construction to car body 202, but having articulated connectors at both ends, rather than having a coupler end. FIG. 3*c* shows an isometric view of end unit 224 (or 222). Analogous five pack articulated rail road cars having cantilevered articulations can also be produced. Many alternate configurations of multi-unit articulated rail road cars employing cantilevered articulations can be assembled by re-arranging, or adding to, the units illustrated.

In each of the foregoing descriptions, each of rail road cars 20, 80, 140, 200 and 220 has a pair of first and second coupler ends by which the rail road car can be releasably coupled to other rail road cars, whether those coupler ends are part of the same rail car body, or parts of different rail car bodies of a multi-unit rail road car joined by articulated connections, draw-bars, or a combination of articulated connections and drawbars.

Figure 4A:
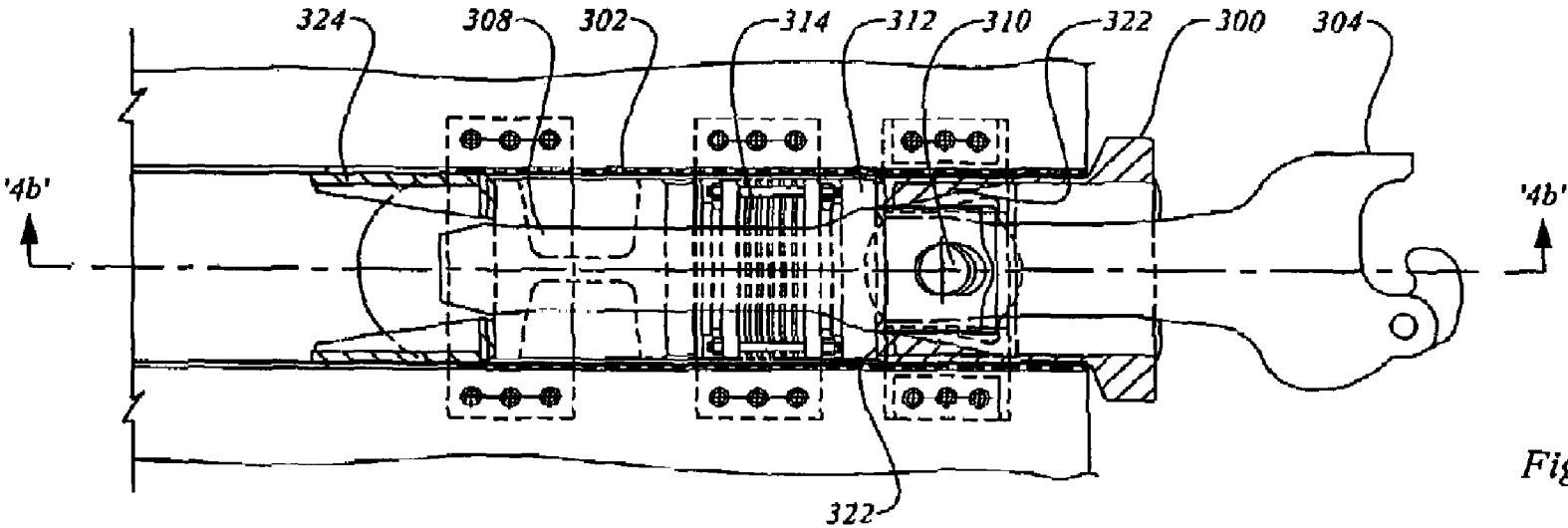
FIG. 4*a* is a partial side sectional view of the draft pocket of the coupler end of any of the rail road cars of FIGS. 1*a*, 2*a*, 2*b*, 3*a*, or 3*b* taken on '4*a*-4*a*' as indicated in FIG. 1*a;*
Figure 4B:
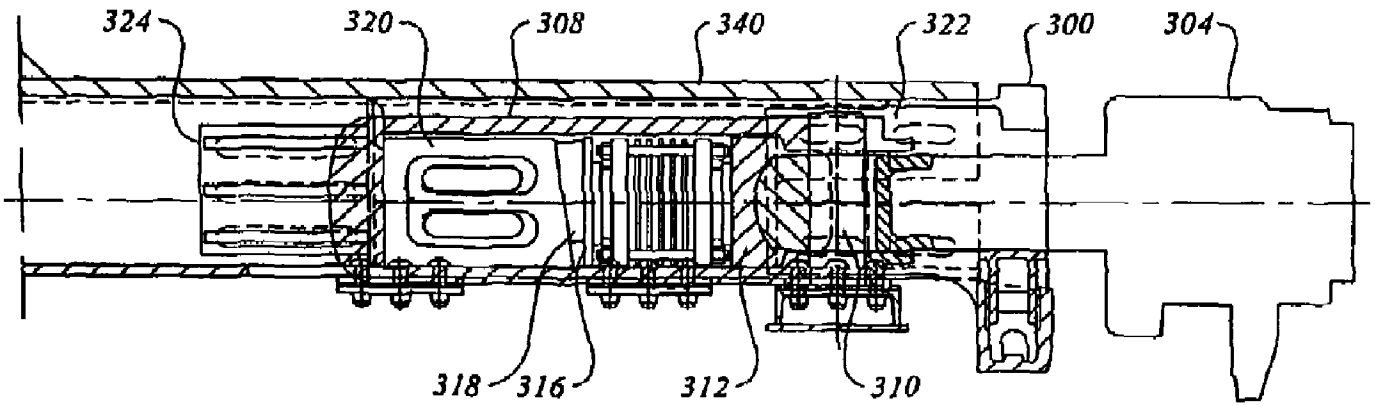
FIG. 4*b* shows a top view of the draft gear at the coupler end of FIG. 4*a* taken on '4*b*-4*b*' of FIG. 4*a;*

FIGS. 4*a* and 4*b* show the draft gear at a first coupler end 300 of rail road car 20, coupler end 300 being representative of either of the coupler ends and draft gear arrangement of rail road car 20, and of rail road cars 80, 140, 200 and 220 more generally. Coupler pocket 302 houses a coupler indicated as 304. It is mounted to a coupler yoke 308, joined together by a pin 310. Yoke 308 houses a coupler follower 312, a draft gear 314 held in place by a shim (or shims, as required) 316, a wedge 318 and a filler block 320. Fore and aft draft gear stops 322, 324 are welded inside coupler pocket 302 to retain draft gear 314, and to transfer the longitudinal buff and draft loads through draft gear 314 and on to coupler 304. In the preferred embodiment, coupler 304 is an AAR Type F70DE coupler, used in conjunction with an AAR Y45AE coupler yoke and an AAR Y47 pin. In the preferred embodiment, draft gear 314 is a Mini-BuffGear such as manufactured Miner Enterprises Inc., or by the Keystone Railway Equipment Company, of 3420 Simpson Ferry Road, Camp Hill, Pa. As taken together, this draft gear and coupler assembly yields a reduced slack, or low slack, short travel, coupling as compared to an AAR Type E coupler with standard draft gear or hydraulic EOCC device. As such it may tend to reduce overall train slack. In addition to mounting the Mini-BuffGear directly to the draft pocket, that is, coupler pocket 302, and hence to the structure of the rail car body of rail road car 20, (or of the other rail road cars noted above) the construction described and illustrated is free of other long travel draft gear, sliding sills and EOCC devices, and the fittings associated with them.

Mini-BuffGear has between ⅝ and ¾ of an inch displacement travel in buff at a compressive force greater than 700,000 Lbs. Other types of draft gear can be used to give an official rating travel of less than 2½ inches under M-901-G, or if not rated, then a travel of less than 2.5 inches under 500,000 Lbs. buff load. For example, while Mini-BuffGear is preferred, other draft gear is available having a travel of less than 1¾ inches at 400,000 Lbs., one known type has about 1.6 inches of travel at 400,000 Lbs., buff load. It is even more advantageous for the travel to be less than 1.5 inches at 700,000 Lbs. buff load and, as in the embodiment of FIGS. 4*a* and 4*b*, preferred that the travel be at least as small as 1" inches or less at 700,000 Lbs. buff load.

Similarly, while the AAR Type F70DE coupler is preferred, other types of coupler having less than the 25/32" (that is, less than about ¾") nominal slack of an AAR Type E coupler generally or the 20/32" slack of an AAR E50ARE coupler can be used. In particular, in alternative embodiments with appropriate housing changes where required, AAR Type F79DE and Type F73BE (members of the Type F Family), with or without top or bottom shelves; AAR Type CS; or AAR Type H couplers can be used to obtain reduced slack relative to AAR Type E couplers.

In each of the autorack rail car embodiments described above, each of the car units has a weight, that weight being carried by the rail car trucks with which the car is equipped. In each of the embodiments of articulated rail cars described above there is a number of rail car units joined at a number of articulated connectors, and carried for rolling motion along railcar tracks by a number of railcar trucks. In each case the number of articulated car units is one more than the number of articulations, and one less than the number of trucks. In the event that in alternate embodiments some of the cars units are joined by draw bars the number of articulated connections will be reduced by one for each draw bar added, and the number of trucks will increase by one for each draw bar added. Typically articulated rail road cars have only articulated connections between the car units. All cars described have releasable couplers mounted at their opposite ends.

In each embodiment described above, where at least two car units are joined by an articulated connector, there are end trucks (e.g. 150, 232) inset from the coupler ends of the end car units, and intermediate trucks (e.g. 154, 234) that are mounted closer to, or directly under, one or other of the articulated connectors (e.g. 156, 230). In a car having cantilevered articulations, such as shown in FIG. 2*b* or 3*b*, the articulated connector is mounted at a longitudinal offset distance (the cantilever arm CA) from the truck center. In each case, each of the car units has an empty weight, and also a design full weight. The full weight is usually limited by the truck capacity, whether 70 ton, 100 ton, 110 ton (286,000 lbs.) or 125 ton. In some instances, with low density lading, the volume of the lading is such that the truck loading capacity cannot be reached without exceeding the volumetric capacity of the car body.

The dead sprung weight of a rail car unit is generally taken as the body weight of the car unit, including any ballast, as described below, plus that portion of the weight of the truck borne by the springs, (most typically taken as being the weight of the truck bolsters). The unsprung weight of the trucks is, primarily, the weight of the side frames, the axles and the wheels, plus ancillary items such as the brakes, springs, and axle bearings and bearing adapters. The unsprung weight of a three piece truck may generally be about 8800 lbs. The live load is the weight of the lading. The sum of (a) the live load; (b) the dead sprung load; and (c) the unsprung weight of the trucks is the gross railcar weight on rail.

In each of the embodiments described above, each of the rail car units has a weight and a weight distribution of the dead sprung weight of the carbody which determines the dead sprung load carried by each truck. In each of the embodiments described above, the sum of the sprung weights of all of the car bodies of an articulated car is designated as WO. (The sprung mass, MO, is the sprung weight WO divided by the gravitational constant, g. In each case where a weight is given herein, it is understood that conversion to mass can be readily made in this way, particularly as when calculating natural frequencies). For a single unit, symmetrical rail road car, such as car 20, the weight on both trucks is equal. In all of the articulated auto rack rail road car embodiments described above, the distributed sprung weight on any end truck, is at least ⅔, and no more than ⅘ of the nearest adjacent interior truck, such as an interior truck next closest to the nearest articulated connector. It is advantageous that the dead sprung weight be in the range of 4/5 to 6/5 of the dead sprung weight carried by the interior truck, and it is preferred that the dead sprung weight be in the range of 90% to 110% of the interior truck. It is also desirable that the dead sprung weight on any truck, WDS, fall in the range of 90% to 110% of the value obtained by dividing WO by the total number of trucks of the rail road car. Similarly, it is desirable that the dead sprung weight plus the live load carried by each of the trucks be roughly similar such that the overall truck loading is about the same. In any case, for the embodiments described above, the design live load for one truck, such as an end truck, can be taken as being at least 60% of the design live load of the next adjacent truck, such as an internal truck. In terms of overall dead and live loads, in each of the embodiments described the overall sprung load of the end truck is at least 70% of the nearest adjacent internal truck, advantageously 80% or more, and preferably 90% of the nearest adjacent internal truck.

Inasmuch as the car weight would generally be more or less evenly distributed on a lineal foot basis, and as such the interior trucks would otherwise reach their load capacities before the coupler end trucks, weight equalisation may be achieved in the embodiments described above by adding ballast to the end car units. That is, the dead sprung weight distribution of the end car units is biased toward the coupler end, and hence toward the coupler end truck (e.g. 84, 88, 206, 210, 150, 232). For example, in the embodiments described above, a first ballast member is provided in the nature of a main deck plate 350 of unusual thickness T that forms part of main deck 38 of the rail car unit. Plate 350 extends across the width of the end car unit, and from the longitudinally outboard end of the deck a distance LB. In the embodiment of FIGS. 3*b* and 3*c* for example, the intermediate or interior truck 234 may be a 70 ton truck near its sprung load limit of about 101,200 lbs., on the basis of its share of loads from rail car units 222 and 226 (or, symmetrically 224 and 226 as the case may be), while, without ballast, end trucks 232 would be at a significantly smaller sprung load, even when rail car 220 is fully loaded. In this case, thickness T can be 1½ inches, the width can be 112 inches, and the length LB can be 312 inches, giving a weight of roughly 15,220 lbs., centered on the truck center of end truck 232. This gives a dead load of end car unit 222 of roughly 77,000 lbs., a dead sprung load on end truck 232 of about 54,000 lbs., and a total sprung load on truck 232 can be about 84,000 lbs. By comparison, center car unit 226 has a dead sprung load of about 60,000 lbs., with a dead sprung load on interior truck 234 of about 55,000 lbs., and yielding a total sprung load on interior truck 234 of 101,000 lbs when car 220 is fully loaded. In this instance as much as a further 17,000 lbs. (+/−) of additional ballast can be added before exceeding the "70 Ton" gross weight on rail limit for the coupler end truck, 232. Ballast can also be added by increasing the weight of the lower flange or webs of the center sill, also advantageously reducing the center of gravity of the car.

Similar weight distributions can be made for other capacities of truck whether 100 Ton, 110 Ton or 125 Ton. Although any of these sizes of trucks can be used, it is preferable to use a truck with a larger wheel diameter. That is, while 33 inch wheels (or even 28" wheels in a 70 Ton Special") can be used, wheels larger than 33 inches in diameter are preferred such as 36 inch or 38 inch wheels.

Figure 5A:
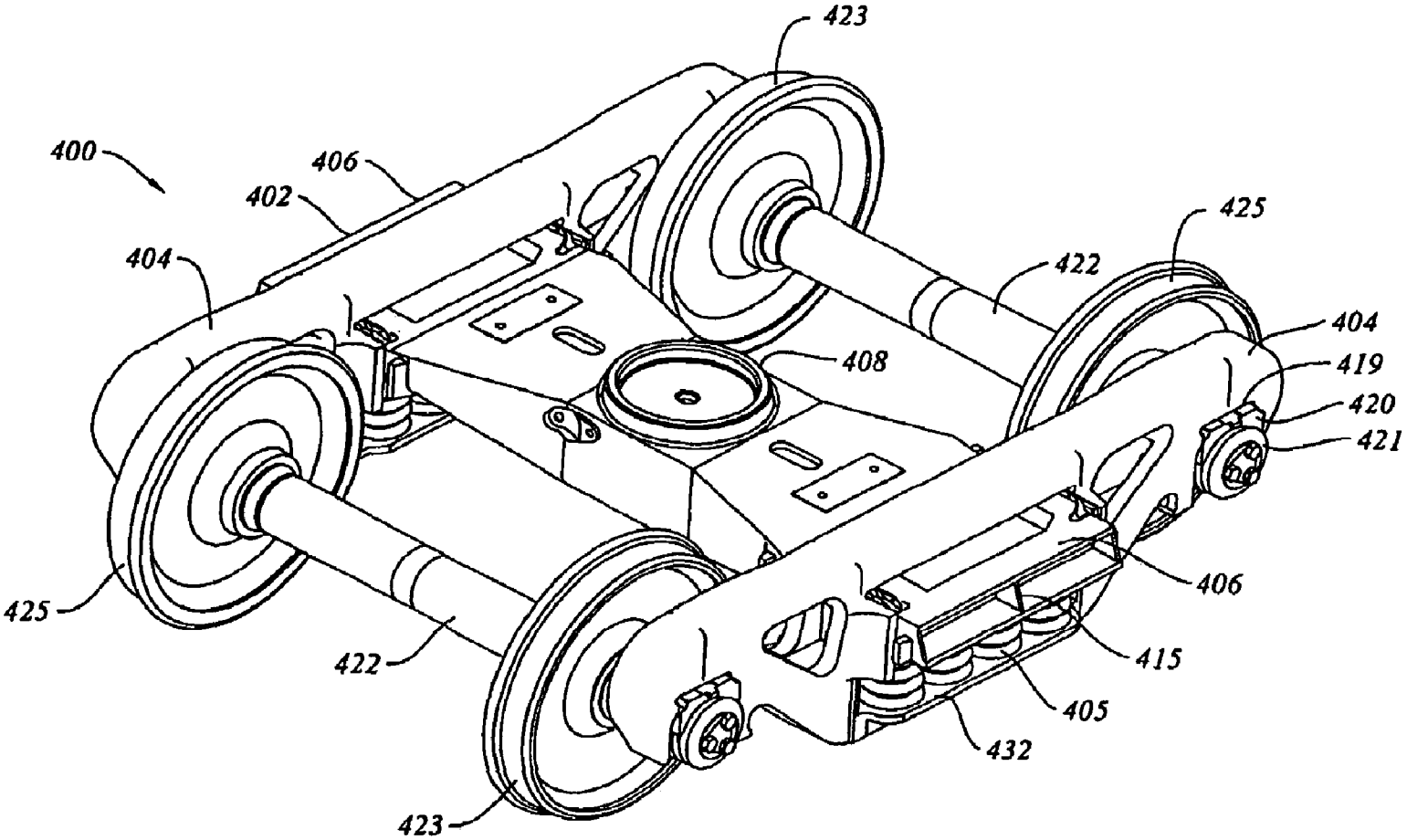
FIG. 5*a* shows an isometric view of a three piece truck for the auto rack rail road cars of FIGS. 1*a*, 2*a*, 2*b*, 3*a* or 3*b;*
Figure 5B:
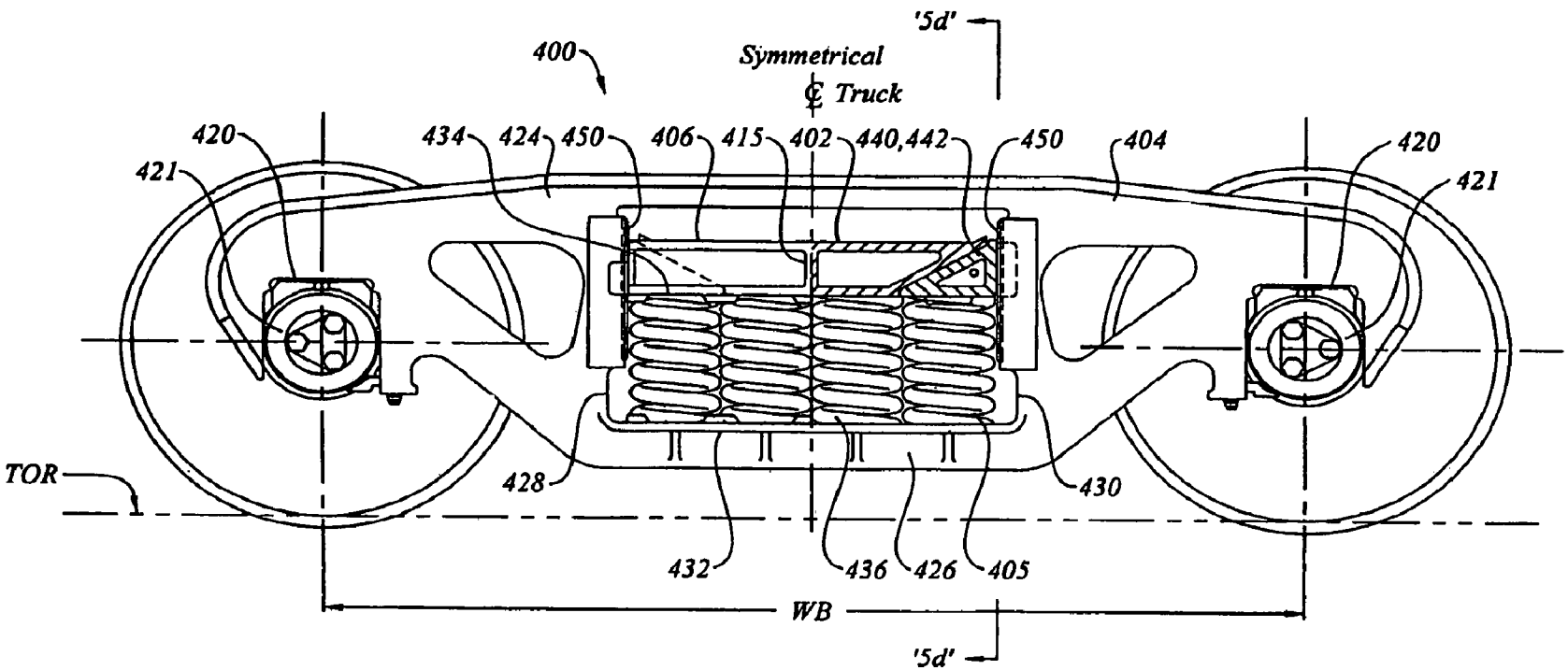
FIG. 5*b* shows a side view of the three piece truck of FIG. 5*a;*
Figure 5C:
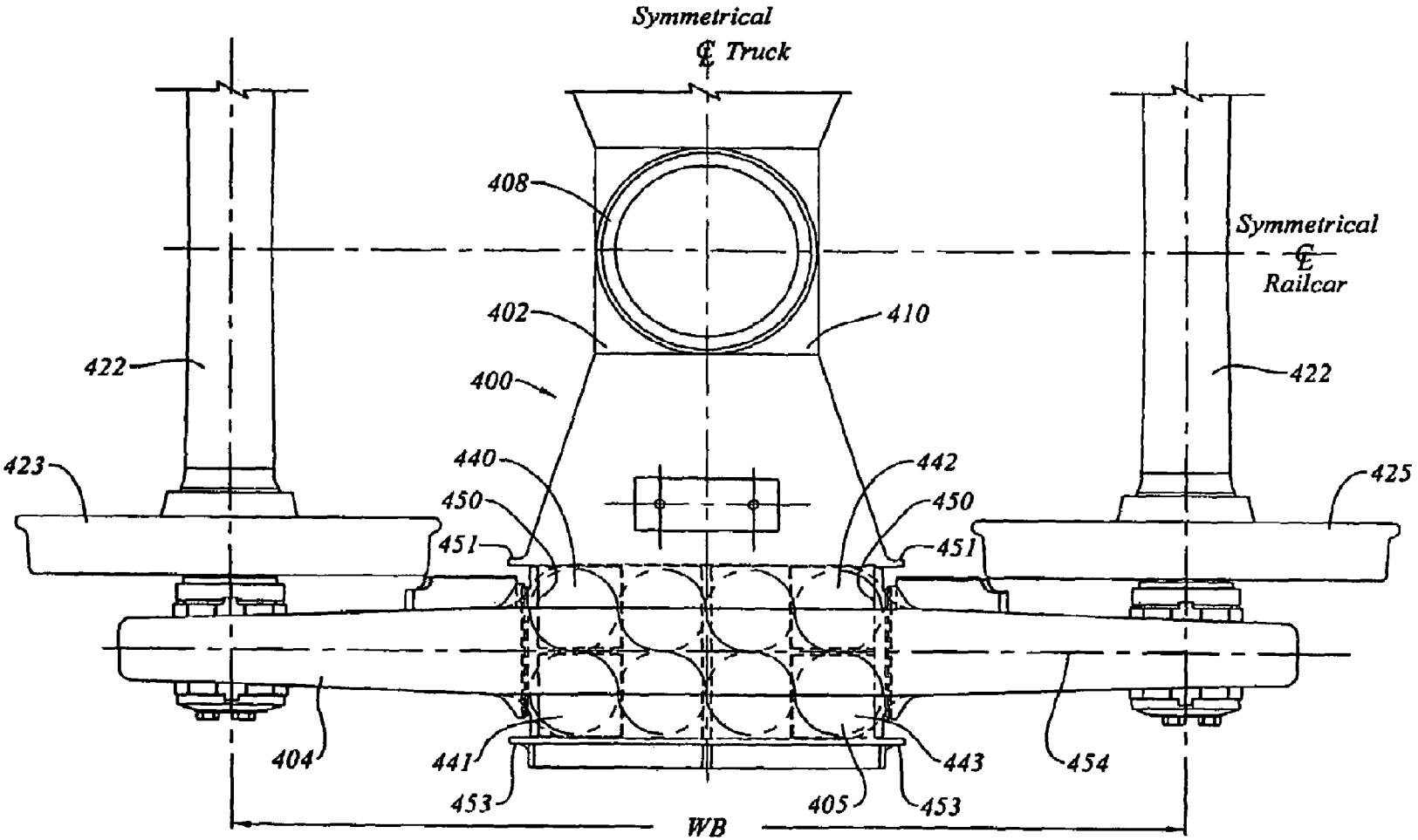
FIG. 5*c* shows a top view of half of the three piece truck of FIG. 5*b;*

FIGS. 5*a*, 5*b*, 5*c*, 5*d* and 5*e* all relate to a three piece truck 400 for use with the rail road cars of FIGS. 1*a*, 2*a*, 2*b*, 3*a* or 3*b*. FIGS. 1*c* and 1*d* show the relationship of this truck to the deck level of these rail road cars. Truck 400 has three major elements, those elements being a truck bolster 402, symmetrical about the truck longitudinal centreline, and a pair of first and second side frames, indicated as 404. Only one side frame is shown in FIG. 5*c* given the symmetry of truck 400. Three piece truck 400 has a resilient suspension (a primary suspension) provided by a spring groups 405 trapped between each of the distal (i.e., transversely outboard) ends of truck bolster 402 and side frames 404.

Truck bolster 402 is a rigid, fabricated beam having a first end for engaging one side frame assembly and a second end for engaging the other side frame assembly (both ends being indicated as 406). A center plate or center bowl 408 is located at the truck center. An upper flange 410 extends between the two ends 406, being narrow at a central waist and flaring to a wider transversely outboard termination at ends 406. Truck bolster 402 also has a lower flange 412 and two fabricated webs 414 extending between upper flange 410 and lower flange 412 to form an irregular, closed section box beam. Additional webs 415 are mounted between the distal portions of upper flange 410 and 414 where bolster 402 engages one of the spring groups 405. The transversely distal region of truck bolster 402 also has friction damper seats 416, 418 for accommodating friction damper wedges as described further below.

Side frame 404 is a casting having bearing seats 419 into which bearing adapters 420, bearings 421, and a pair of axles 422 mount. Each of axles 422 has a pair of first and second wheels 423, 425 mounted to it in a spaced apart position corresponding to the width of the track gauge of the track upon which the rail car is to operate. Side frame 404 also has a compression member, or upper beam member 424, a tension member, or lower beam member 426, and vertical side columns 428 and 430, each lying to one side of a vertical transverse plane 425 bisecting truck 400 at the longitudinal station of the truck center. A generally rectangular opening is defined by the co-operation of the upper and lower beam members 424, 426 and vertical columns 428, 430, into which the distal end of truck bolster 402 can be introduced. The distal end of truck bolster 402 can then move up and down relative to the side frame within this opening. Lower beam member 426 has a bottom or lower spring seat 432 upon which spring group 405 can seat. Similarly, an upper spring seat 434 is provided by the underside of the distal portion of bolster 402 to engages the upper end of spring group 405. As such, vertical movement of truck bolster 402 will tend to compress or release the springs in spring group 405.

In the embodiment of FIG. 5*a*, spring group 405 has two rows of springs 436, a transversely inboard row and a transversely outboard row, each row having four large (8 inch+/−) diameter coil springs giving vertical bounce spring rate constant, k, for group 405 of less than 10,000 lbs/inch. This spring rate constant can be in the range of 6000 to 10,000 lbs/in., and is advantageously in the range of 7000 to 9500 lbs/in, giving an overall vertical bounce spring rate for the truck of double these values, preferably in the range of 14000 to 18,500 lbs/in for the truck. The spring array can include nested coils of outer springs, inner springs, and inner-inner springs depending on the overall spring rate desired for the group, and the apportionment of that stiffness. The number of springs, the number of inner and outer coils, and the spring rate of the various springs can be varied. The spring rates of the coils of the spring group add to give the spring rate constant of the group, typically being suited for the loading for which the truck is designed.

Each side frame assembly also has four friction damper wedges arranged in first and second pairs of transversely inboard and transversely outboard wedges 440, 441, 442 and 443 that engage the sockets, or seats 416, 418 in a four-cornered arrangement. The corner springs in spring group 405 bear upon a friction damper wedge 440, 441, 442 or 443.

Each of vertical columns 428, 430 has a friction wear plate 450 having transversely inboard and transversely outboard regions against which the friction faces of wedges 440, 441, 442 and 443 can bear, respectively. Bolster gibs 451 and 453 lie inboard and outboard of wear plate 450 respectively. Gibs 451 and 453 act to limit the lateral travel of bolster 402 relative to side frame 404. The deadweight compression of the springs under the dampers will tend to yield a reaction force working on the bottom face of the wedge, trying to drive the wedge upward along the inclined face of the seat in the bolster, thus urging, or biasing, the friction face against the opposing portion of the friction face of the side frame column. In one embodiment, the springs chosen can have an undeflected length of 15 inches, and a dead weight deflection of about 3 inches.

Figure 5D:
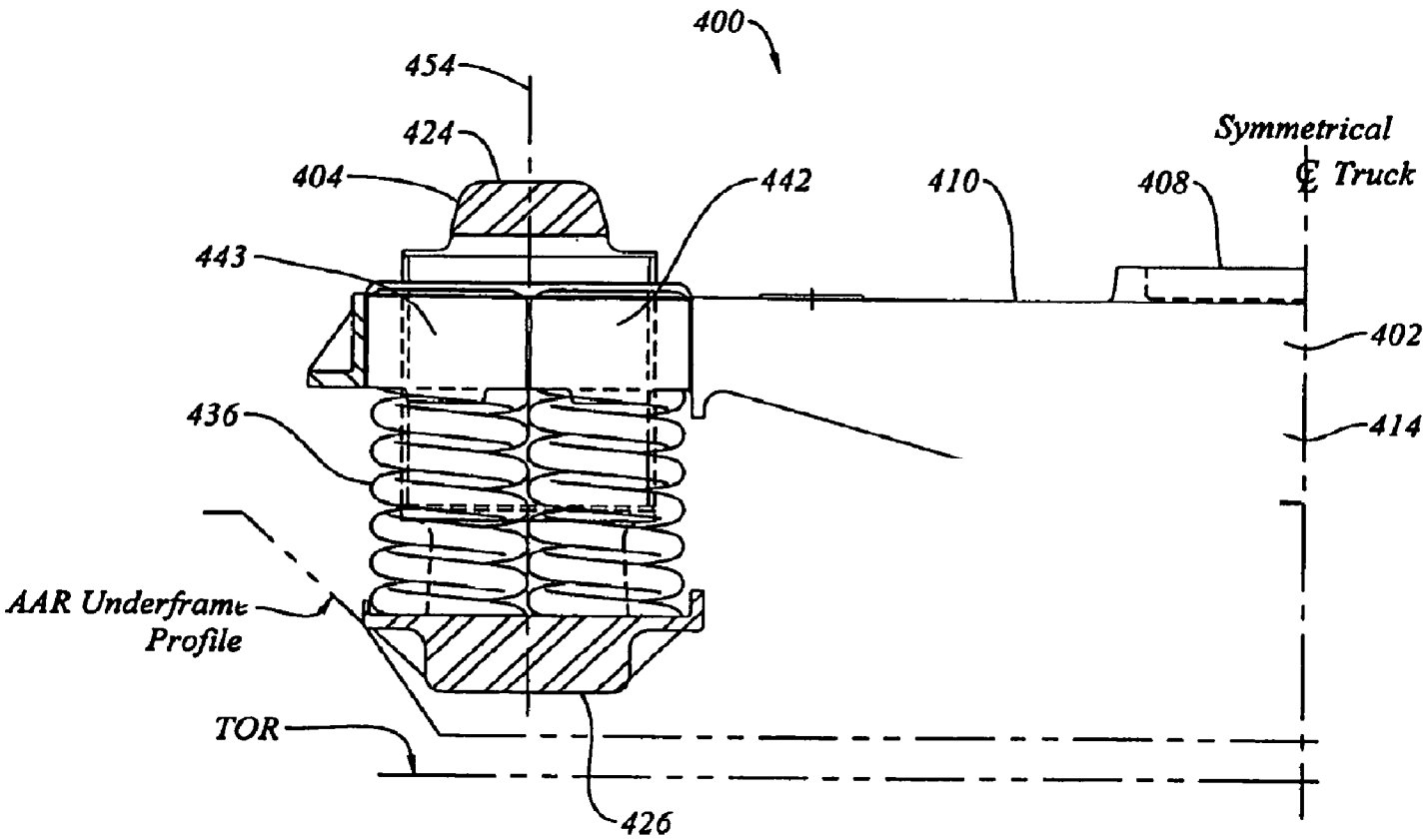
FIG. 5*d* shows a partial section of the three piece truck of FIG. 5*b* taken on '5*d*-5*d'*.
Figure 5E:
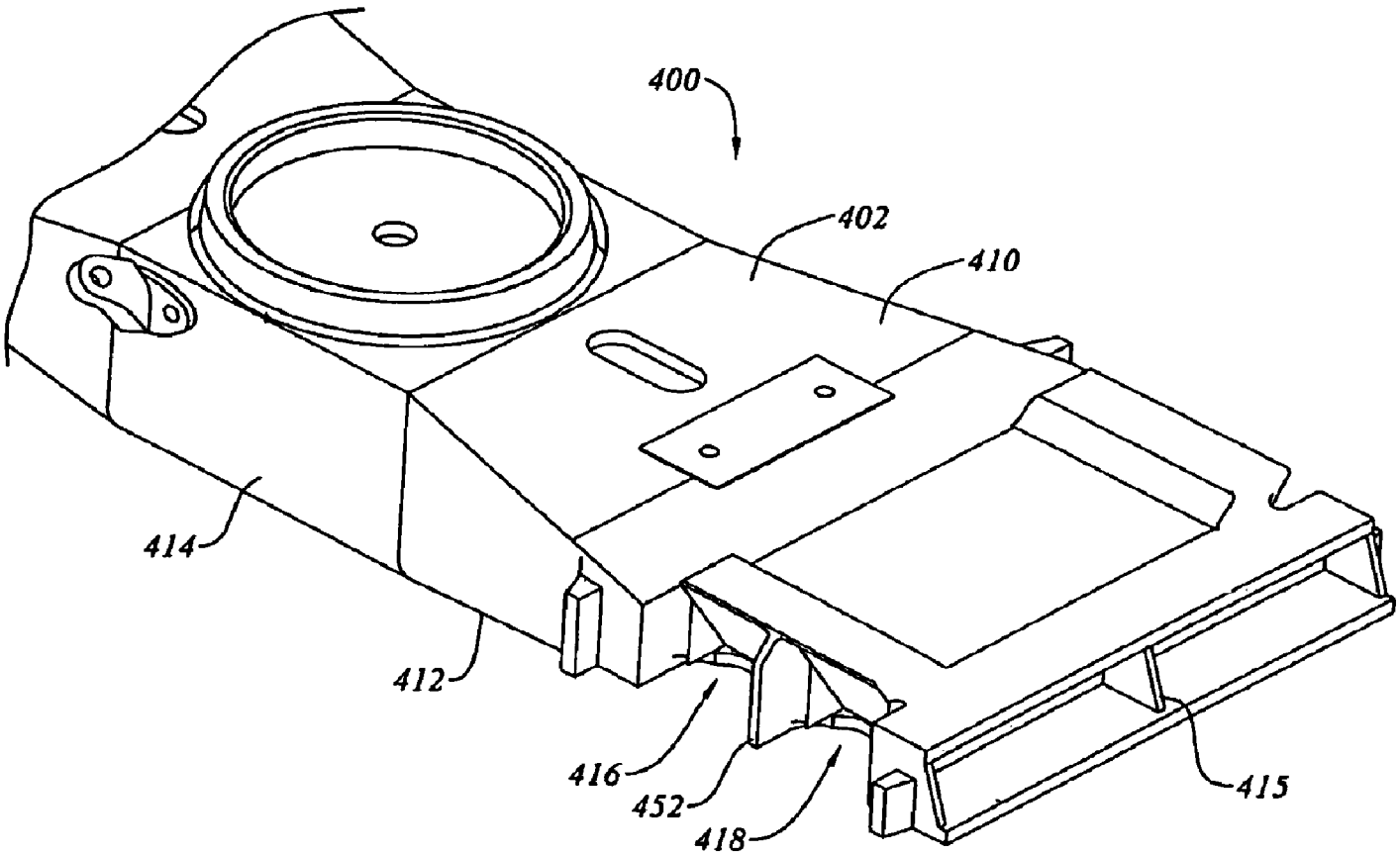
FIG. 5*e* shows a partial isometric view of the truck bolster of the three piece truck of FIG. 5*a* showing friction damper seats.
Figure 5F:
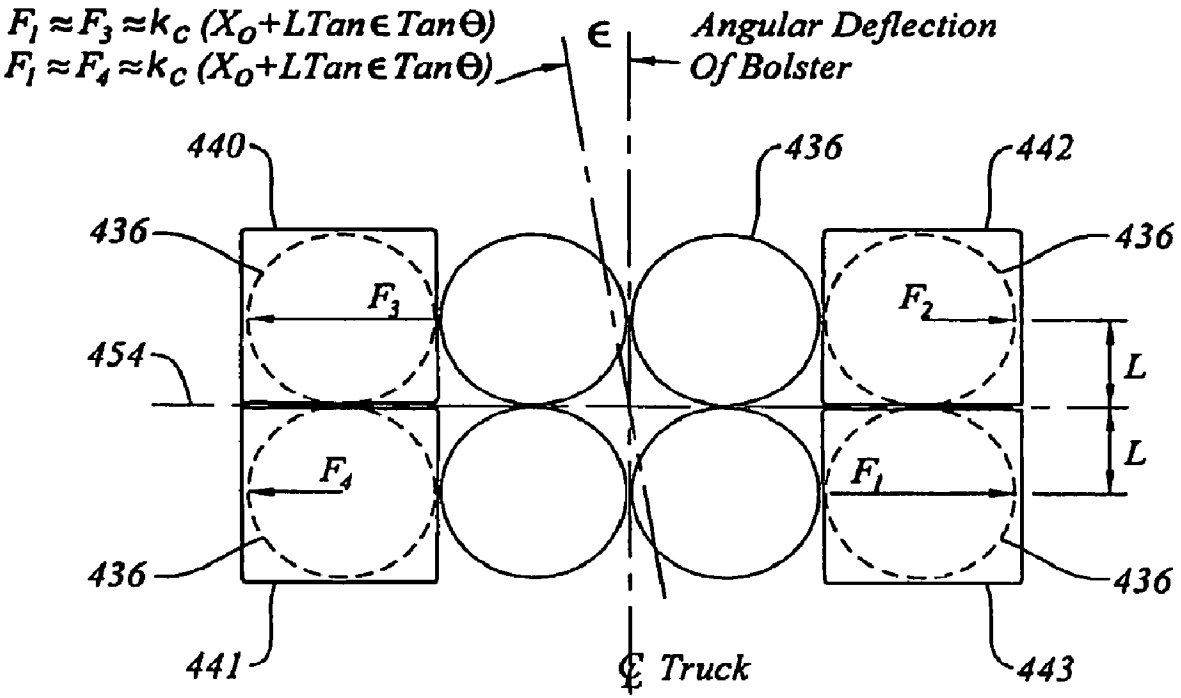
FIG. 5*f* shows a force schematic for dampers in the side frame of the truck of FIG. 5*a.*

As seen in the top view of FIG. 5*c*, and in the schematic sketch of FIG. 5*f* the side-by-side friction dampers have a relatively wide averaged moment arm L to resist angular deflection of the side frame relative to the truck bolster in the parallelogram mode. This moment arm is significantly greater than the effective moment arm of a single wedge located on the spring group (and side frame) centre line. Further, the use of independent springs under each of the wedges means that whichever wedge is jammed in tightly, there is always a dedicated spring under that specific wedge to resist the deflection. In contrast to older designs, the overall damping face width is greater because it is sized to be driven by relatively larger diameter (e.g., 8 in +/−) springs, as compared to the smaller diameter of, for example, AAR B 432 out or B 331 side springs, or smaller. Further, in having two elements side-by-side the effective width of the damper is doubled, and the effective moment arm over which the diagonally opposite dampers work to resist parallelogram deformation of the truck in hunting and curving greater than it would have been for a single damper.

In the illustration of FIG. 5*e*, the damper seats are shown as being segregated by a partition 452. If a longitudinal vertical plane 454 is drawn through truck 400 through the center of partition 452, it can be seen that the inboard dampers lie to one side of plane 454, and the outboard dampers lie to the outboard side of plane 454. In hunting then, the normal force from the damper working against the hunting will tend to act in a couple in which the force on the friction bearing surface of the inboard pad will always be fully inboard of plane 454 on one end, and fully outboard on the other diagonal friction face. For the purposes of conceptual visualisation, the normal force on the friction face of any of the dampers can be idealised as an evenly distributed pressure field whose effect can be approximated by a point load whose magnitude is equal to the integrated value of the pressure field over its area, and that acts at the centroid of the pressure field. The center of this distributed force, acting on the inboard friction face of wedge 440 against column 428 can be thought of as a point load offset transversely relative to the diagonally outboard friction face of wedge 443 against column 430 by a distance that is notionally twice dimension 'L' shown in the conceptual sketch of FIG. 5*f*. In the example, this distance is about one full diameter of the large spring coils in the spring set. It is a significantly greater effective moment arm distance than found in typical friction damper wedge arrangements. The restoring moment in such a case would be, conceptually, $MR=[(F1+F3)-(F2+F4)]L$. As indicated by the formulae on the conceptual sketch of FIG. 5*f*, the difference between the inboard and outboard forces on each side of the bolster is proportional to the angle of deflection $\epsilon$ of the truck bolster relative to the side frame, and since the normal forces due to static deflection x0 may tend to cancel out, $MR=4kc\ Tan(\epsilon)$ $Tan(\theta)L$, where $\theta$ is the primary angle of the damper, and kc is the vertical spring constant of the coil upon which the damper sits and is biased.

Figure 7:
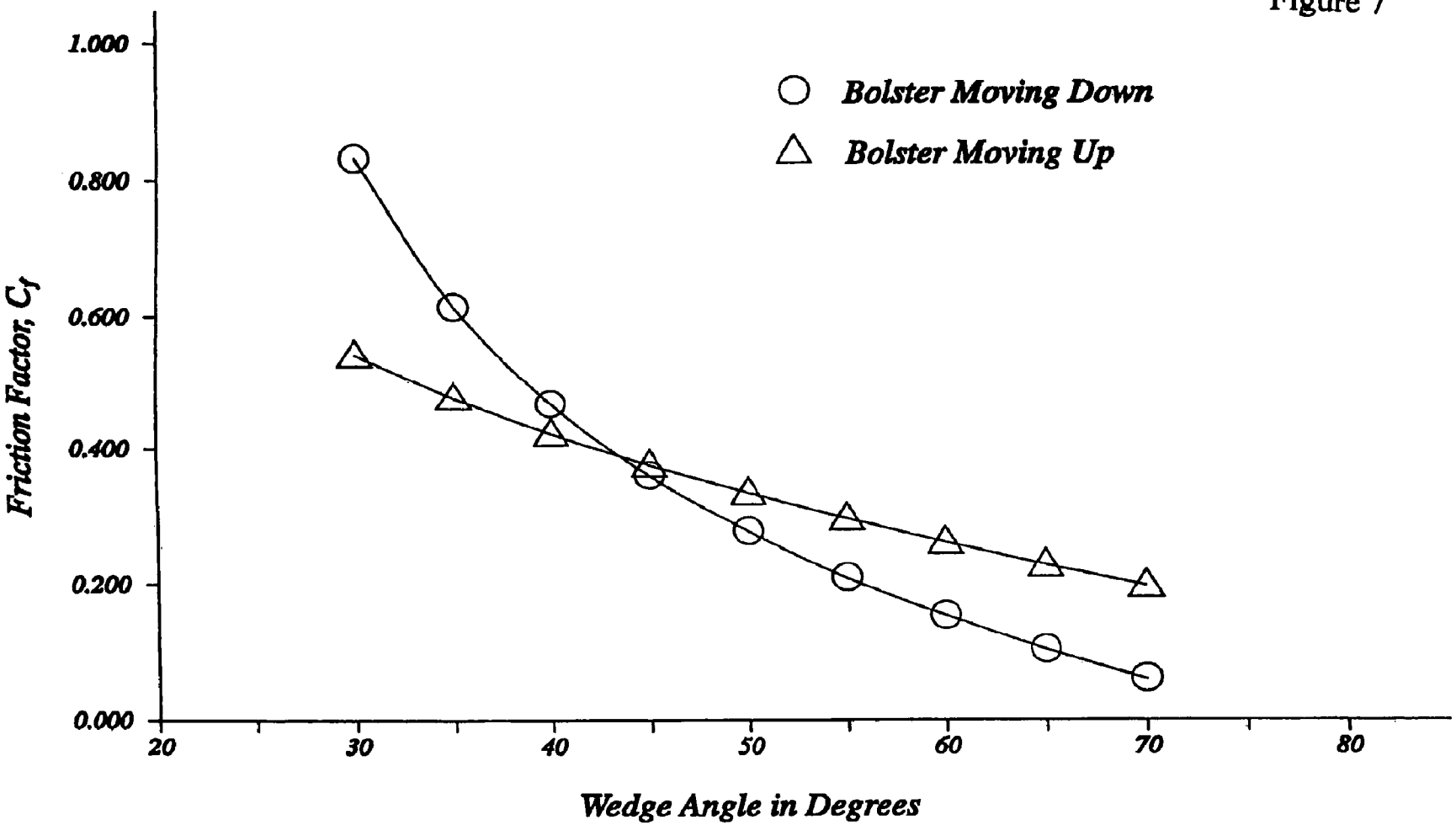
FIG. 7 shows a graph of Friction Factor for sliding dampers as a function of Wedge Angle, in upward and downward motion as an aid to explanation of the dampers of the truck of FIG. 5*a;*

Further, in typical friction damper wedges, the enclosed angle of the wedge tends to be somewhat less than 35 degrees measured from the vertical face to the sloped face against the bolster. As the wedge angle decreases toward 30 degrees, the tendency of the wedge to jam in place increases. Conventionally the wedge is driven by a single spring in a large group. The portion of the vertical spring force acting on the damper wedges can be less than 15% of the group total. In the embodiment of FIG. 5*b*, it is 50% of the group total (i.e., 4 of 8 equal springs). The wedge angle of wedges 440, 442 is significantly greater than 35 degrees. With reference again to FIG. 7, the use of more springs, or more precisely a greater portion of the overall spring stiffness, under the dampers, permits the enclosed angle of the wedge to be over 35 degrees, and advantageously larger, in the range of between roughly 37 to 40 or 45 degrees to roughly 60 or 65 degrees.

Where a softer suspension is used employing a relatively small number of large diameter springs, such as in a 2×4, 3×3, or 3×5 group as described in the detailed description of the invention herein, dampers may be mounted over each of four corner positions. In that case, the portion of spring force acting under the damper wedges may be in the 25-50% range for springs of equal stiffness. If the coils or coil groups are not of equal stiffness, the portion of spring force acting under the dampers may be in the range of perhaps 20% to 70%. The coil groups can be of unequal stiffness if inner coils are used in some springs and not in others, or if springs of differing spring constant are used.

The size of the spring group embodiment of FIG. 5*b* yields a side frame window opening having a width between the vertical columns of side frame 404 of roughly 33 inches. This is relatively large compared to existing spring groups, being more than 25% greater in width. Truck 400 has a correspondingly greater wheelbase length, indicated as WB. WB is advantageously greater than 73 inches, or, taken as a ratio to the track gauge width, is advantageously greater than 1.30 time the track gauge width. It is preferably greater than 80 inches, or more than 1.4 times the gauge width, and in one embodiment is greater than 1.5 times the track gauge width, being as great, or greater than, about 86 inches. Similarly, the side frame window is advantageously wider than tall, the measurement across the wear plate faces of the side frame columns being advantageously greater than 24", possibly in the ratio of greater than 8:7 of width to height, and possibly in the range of 28" or 32" or more, giving ratios of greater than 4:3 and greater than 3:2. The spring seat may have lengthened dimensions to correspond to the width of the side frame window, and a transverse width of 15½-17" or more.

Figure 6A:
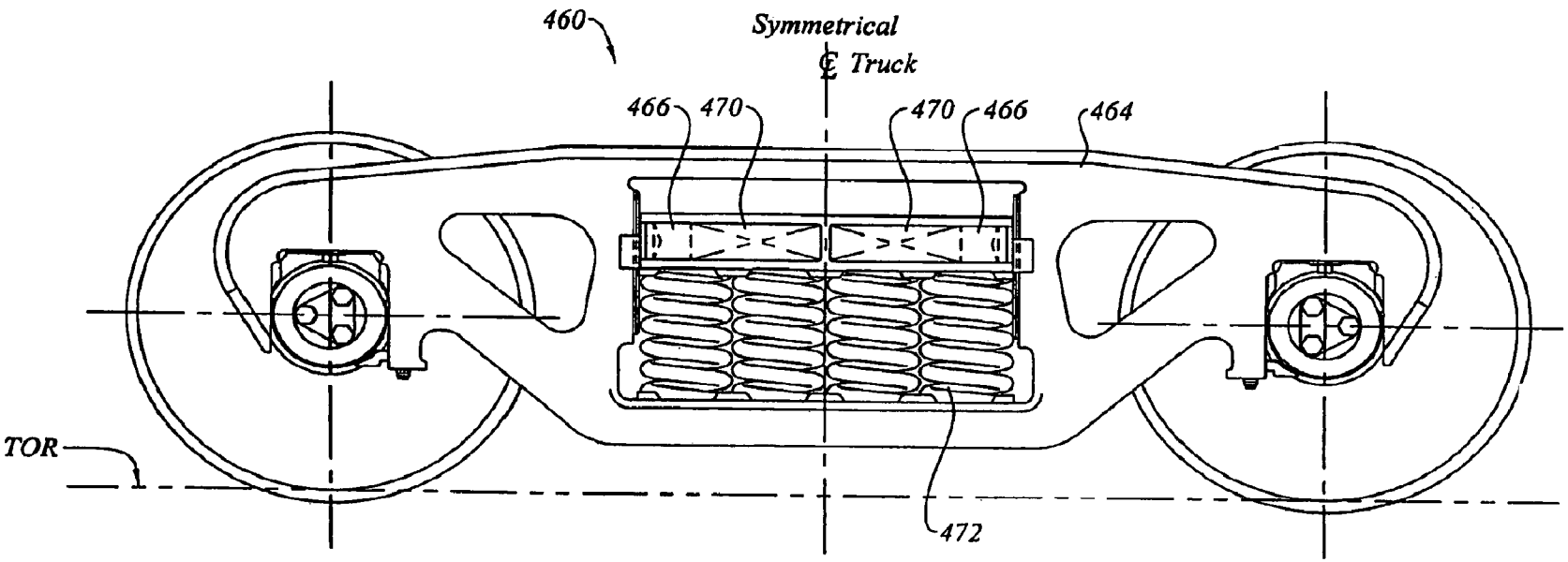
FIG. 6*a* shows a side view of an alternate three piece truck to that of FIG. 5*a;*
Figure 6B:
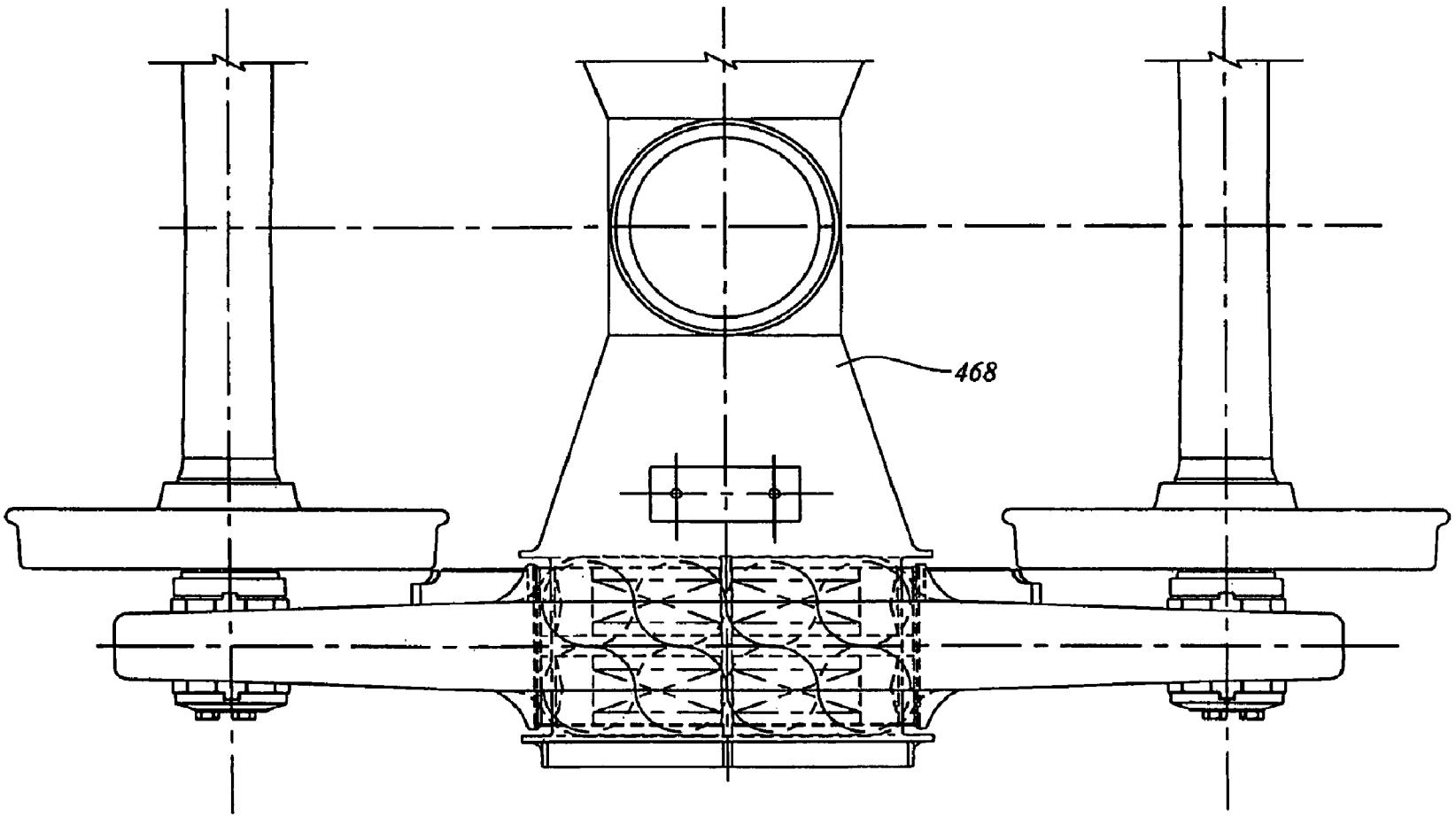
FIG. 6*b* shows a top view of half of the three piece truck of FIG. 6*a;*
Figure 6C:
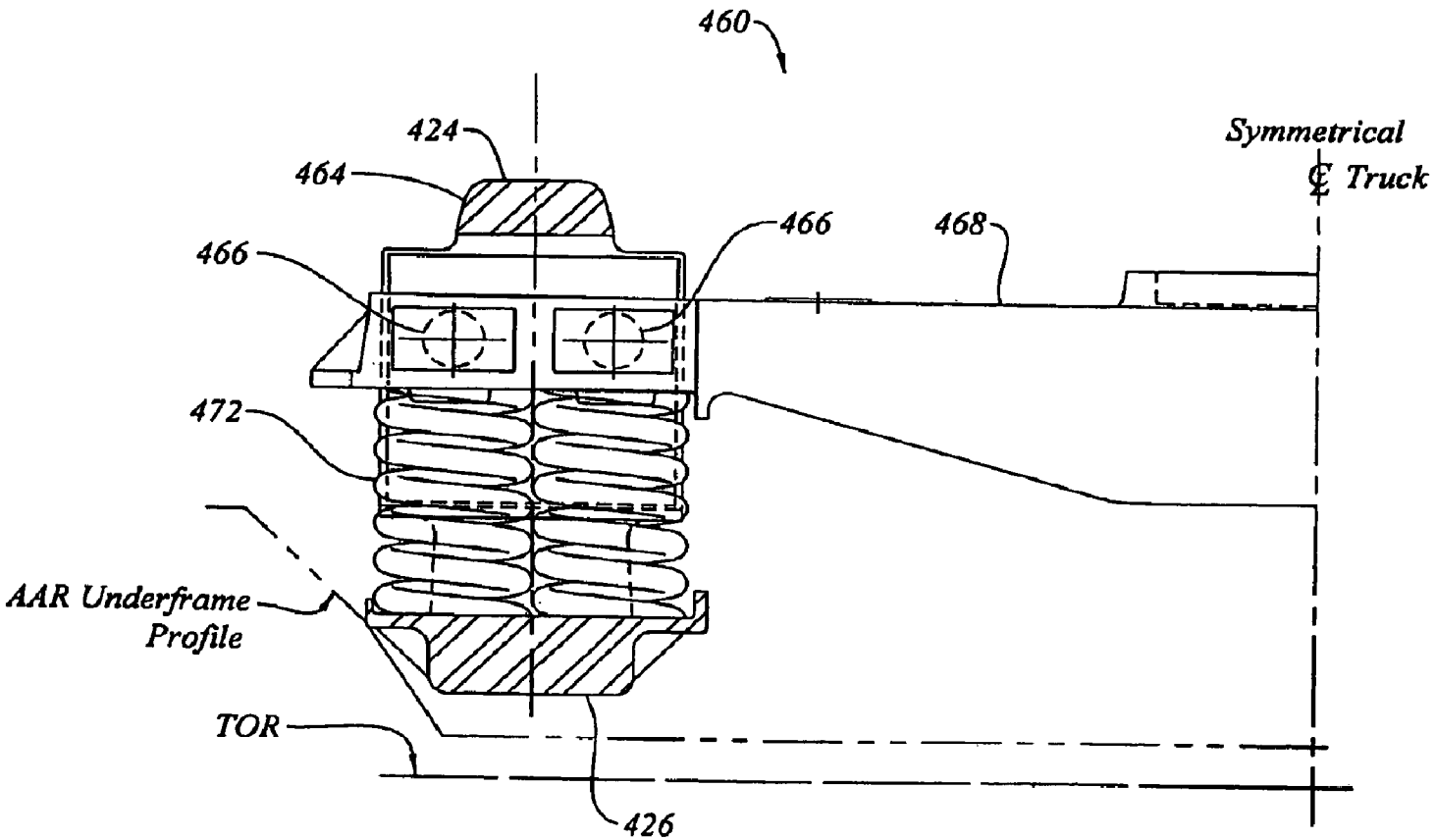
FIG. 6*c* shows a partial section of the three piece truck of FIG. 6*a* taken on '6*c*-6*c'*.

In FIGS. 6*a*, 6*b* and 6*c*, there is an alternate embodiment of soft spring rate, long wheelbase three piece truck, identified as 460. Truck 460 employs constant force inboard and outboard, fore and aft pairs of friction dampers 466 mounted in the distal ends of truck bolster 468. In this arrangement, springs 470 are mounted horizontally in pockets in the distal ends of truck bolster 468 and urge, or bias, each of the friction dampers 466 against the corresponding friction surfaces of the vertical columns of the side frames.

The spring force on friction damper wedges 440, 441, 442 and 443 varies as a function of the vertical displacement of truck bolster 402, since they are driven by the vertical springs of spring group 405. By contrast, the deflection of springs 470 does not depend on vertical compression of the main spring group 472, but rather is a function of an initial pre-load. Although the arrangement of FIGS. 6*a*, 6*b* and 6*c* still provides inboard and outboard dampers and independent springing of the dampers, the embodiment of FIG. 5*b* is preferred.

In the embodiments of FIGS. 1*a*, 1*b*, 2*a*, 2*b*, 3*a* and 3*b*, the ratio of the dead sprung weight, WD, of the rail car unit (being the weight of the car body plus the weight of the truck bolster) without lading to the live load, WL, namely the maximum weight of lading, be at least 1:1. It is advantageous that this ratio WD:WL lie in the range of 1:1 to 10:3. In one embodiment of rail car of FIGS. 1*a*, 1*b*, 2*a*, 2*b*, 3*a* and 3*b* the ratio can be about 1.2:1. It is more advantageous for the ratio to be at least 1.5:1, and preferable that the ratio be greater than 2:1.

Figures 8A, 8B:
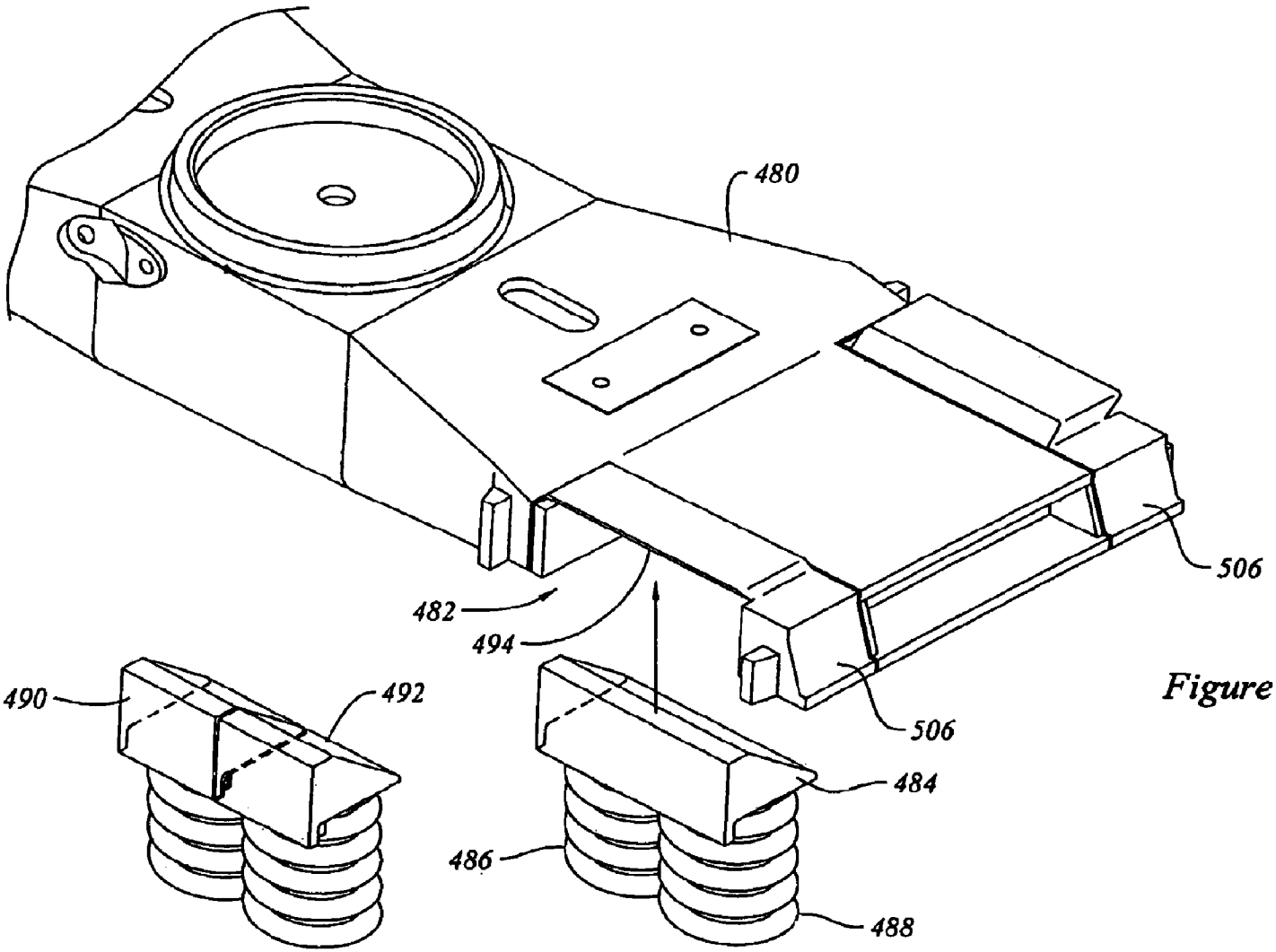
FIG. 8*a* shows an alternate version of the bolster of FIG. 5*e*, with a double sized damper pocket for seating a large single wedge having a welded insert.
FIG. 8*b* shows an alternate optional dual wedge for a truck bolster like that of FIG. 8*a;*

FIGS. 8*a* and 8*b*

FIGS. 8*a* and 8*b* show a partial isometric view of a truck bolster 480 that is generally similar to truck bolster 400 of FIG. 5*d*, except insofar as bolster pocket 482 does not have a central partition like web 452, but rather has a continuous bay extending across the width of the underlying spring group, such as spring group 436. A single wide damper wedge is indicated as 484. Damper 484 is of a width to be supported by, and to be acted upon, by two springs 486, 488 of the underlying spring group. In the event that bolster 400 may tend to deflect to a non-perpendicular orientation relative to the associated side frame, as in the parallelogramming phenomenon, one side of wedge 484 will tend to be squeezed more tightly than the other, giving wedge 484 a tendency to twist in the pocket about an axis of rotation perpendicular to the angled face (i.e., the hypotenuse face) of the wedge. This twisting tendency may also tend to cause differential compression in springs 486, 488, yielding a restoring moment both to the twisting of wedge 484 and to the non-square displacement of truck bolster 480 relative to the truck side frame. As there may tend to be a similar moment generated at the opposite spring pair at the opposite side column of the side frame, this may tend to enhance the self-squaring tendency of the truck more generally.

Also included in FIG. 8*b* is an alternate pair of damper wedges 490, 492. This dual wedge configuration can similarly seat in bolster pocket 482, and, in this case, each wedge 490, 492 sits over a separate spring. Wedges 490, 492 are vertically slidable relative to each other along the primary angle of the face of bolster pocket 482. When the truck move to an out of square condition, differential displacement of wedges 490, 492 may tend to result in differential compression of their associated springs, e.g., 486, 488 resulting in a restoring moment as above.

The sliding motion described above may tend to cause wear on the moving surfaces, namely (a) the side frame columns, and (b) the angled surfaces of the bolster pockets. To alleviate, or ameliorate, this situation, consumable wear plates 494 can be mounted in bolster pocket 482 (with appropriate dimensional adjustments) as in FIG. 8*b*. Wear plates 494 can be smooth steel plates, possibly of a hardened, wear resistant alloy, or can be made from a non-metallic, or partially non-metallic, relatively low friction wear resistant surface. Other plates for engaging the friction surfaces of the dampers can be mounted to the side frame columns, and indicated by item 496 in FIG. 14*a*.

Figure 16A:
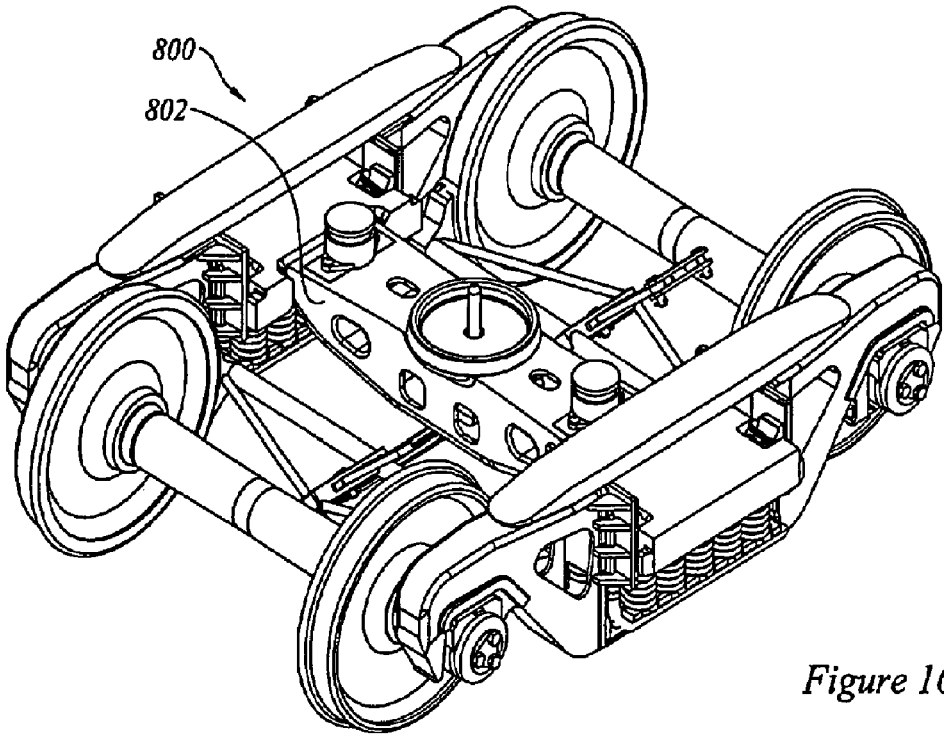
FIG. 16*a* shows an isometric view of an alternate railroad car truck to that of FIG. 5*a;*
Figure 16D:
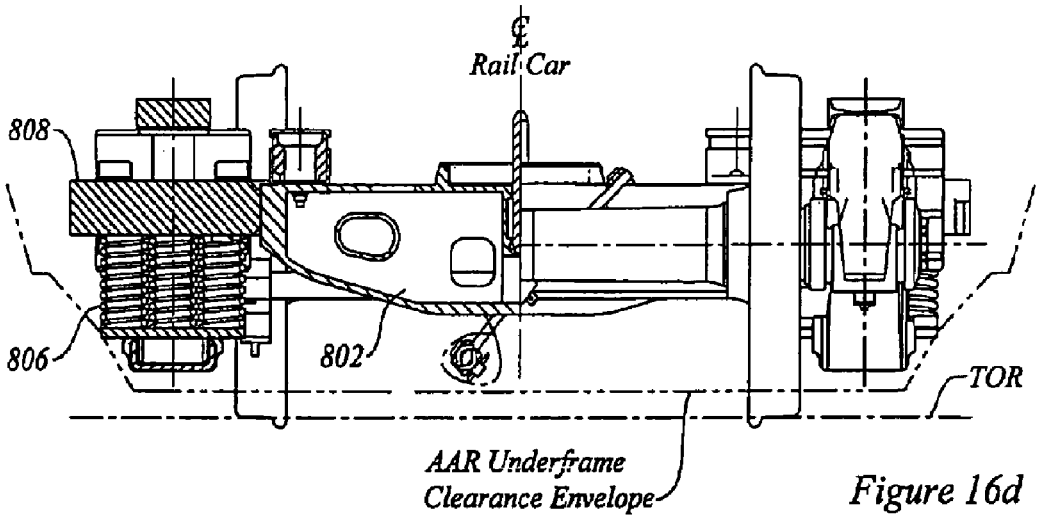
FIG. 16*d* shows an end view of the three piece truck of FIG. 16*a*.
Figure 16E:
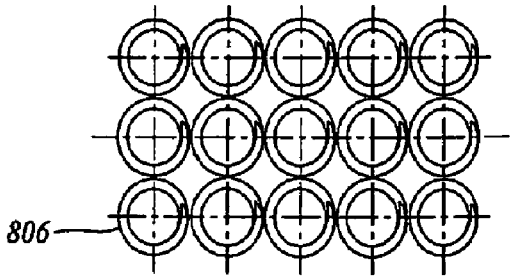
FIG. 16*e* shows a schematic of a spring layout for the truck of FIG. 16*a*.

For the purposes of this example, it has been assumed that the spring group is two coils wide, and that the pocket is, correspondingly, also two coils wide. The spring group could be more than two coils wide. The bolster pocket is assumed to have the same width as the spring group, but could be less wide. For two coils where in some embodiments the group may be more than two coils wide. A symmetrical arrangement of the dampers relative to the side frame and the spring group is desirable, but an asymmetric arrangement could be made. In the embodiments of FIGS. 5*a*, 8*a* and 16*a*, the dampers are in four cornered arrangements that are symmetrical both about the center axis of the truck bolster and about a longitudinal vertical plane of the side frame.

Figure 9:
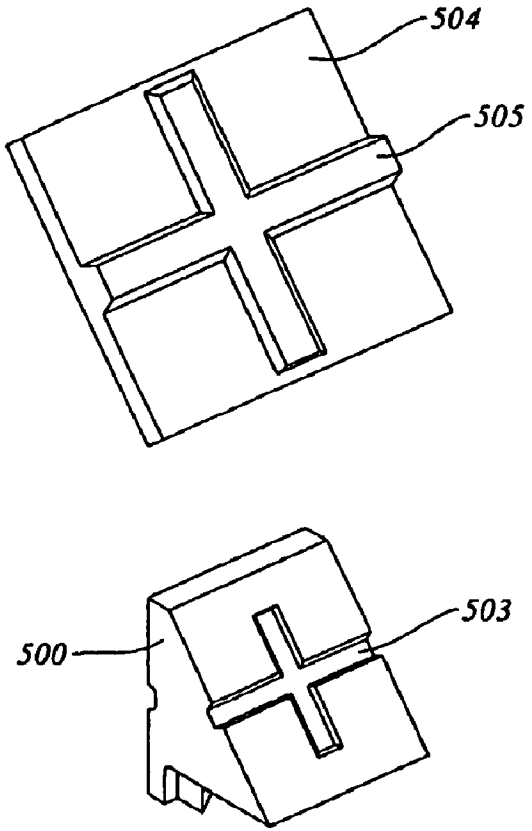
FIG. 9 shows an optional non-metallic wear surface arrangement for dampers such as used in the bolster of FIG. 8*b;*
Figure 9:
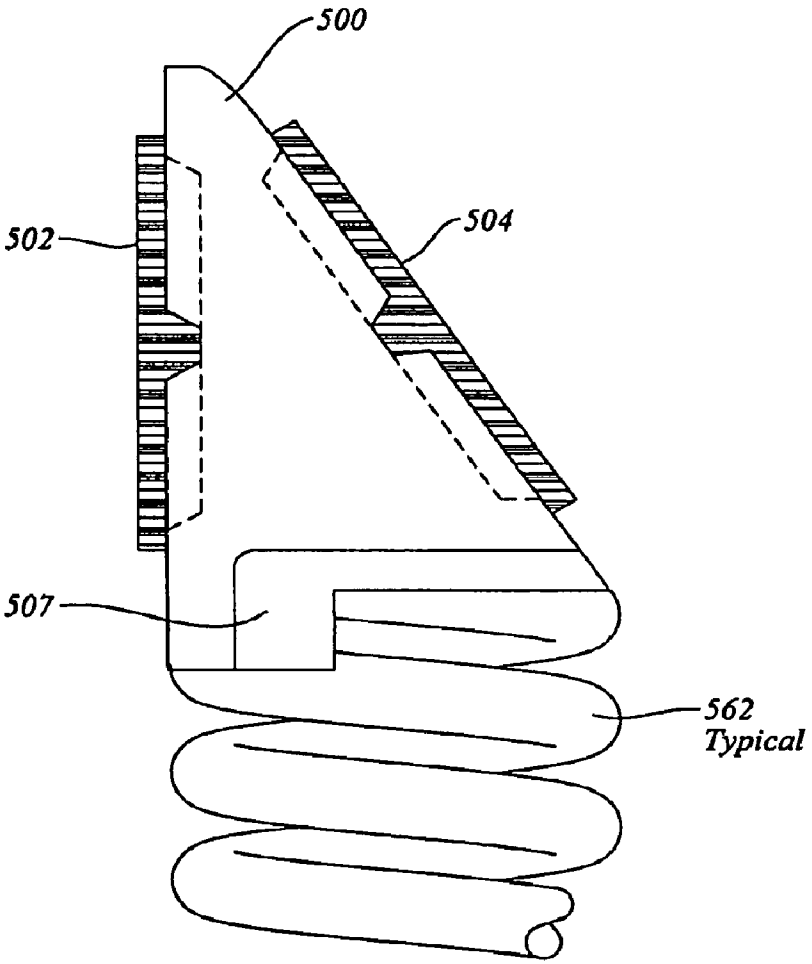

Similarly, the wedges themselves can be made from a relatively common material, such as a mild steel, and the given consumable wear face members in the nature of shoes, or wear members. Such an arrangement is shown in FIG. 9 in which a damper wedge is shown generically as 500. The replaceable, consumable wear members are indicated as 502, 504. The wedges and wear members have mating male and female mechanical interlink features, such as the cross-shaped relief 503 formed in the primary angled and vertical faces of wedge 500 for mating with the corresponding raised cross shaped features 505 of wear members 502, 504. Sliding wear member 502 is preferably made of a non-metallic, low friction material.

Although FIG. 9 shows a consumable insert in the nature of a wear plate, the entire bolster pocket can be made as a replaceable part, as in FIG. 8*a*. This bolster pocket can be made of a high precision casting, or can be a sintered powder metal assembly having desired physical properties. The part so formed is then welded into place in the end of the bolster, as at 506 indicated in FIG. 8*a*.

Figure 14A:
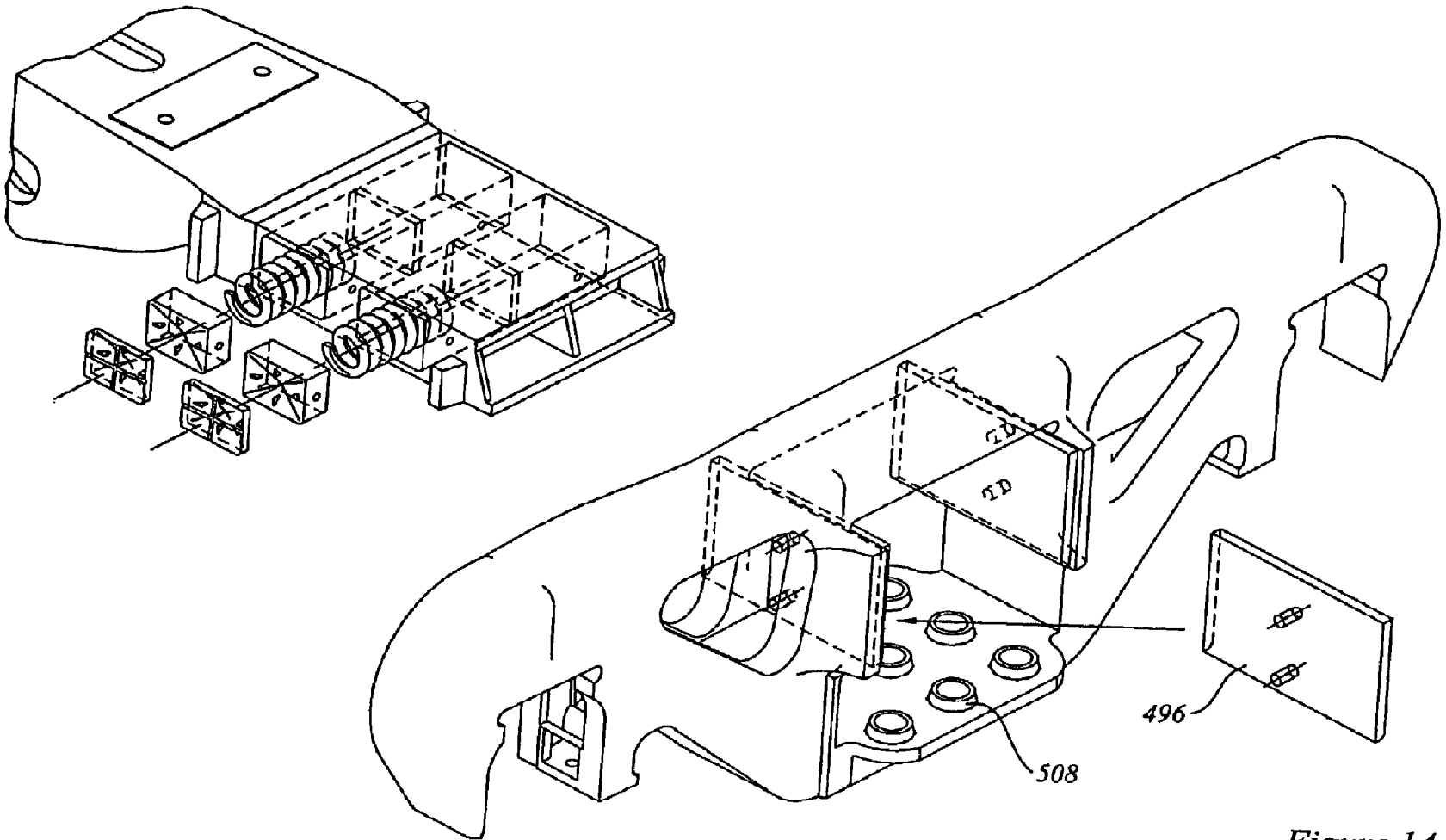
FIG. 14*a* shows an exploded isometric view of an alternate bolster and side frame assembly to that of FIG. 5*a*, in which horizontally acting springs drive constant force dampers.

The underside of the wedges described herein, wedge 500 being typical in this regard, has a seat, or socket 507, for engaging the top end of the spring coil, whichever spring it may be, spring 562 being shown as typically representative. Socket 507 serves to discourage the top end of the spring from wandering away from the intended generally central position under the wedge. A bottom seat, or boss for discouraging lateral wandering of the bottom end of the spring is shown in FIG. 14*a* as item 508.

Figure 8C:
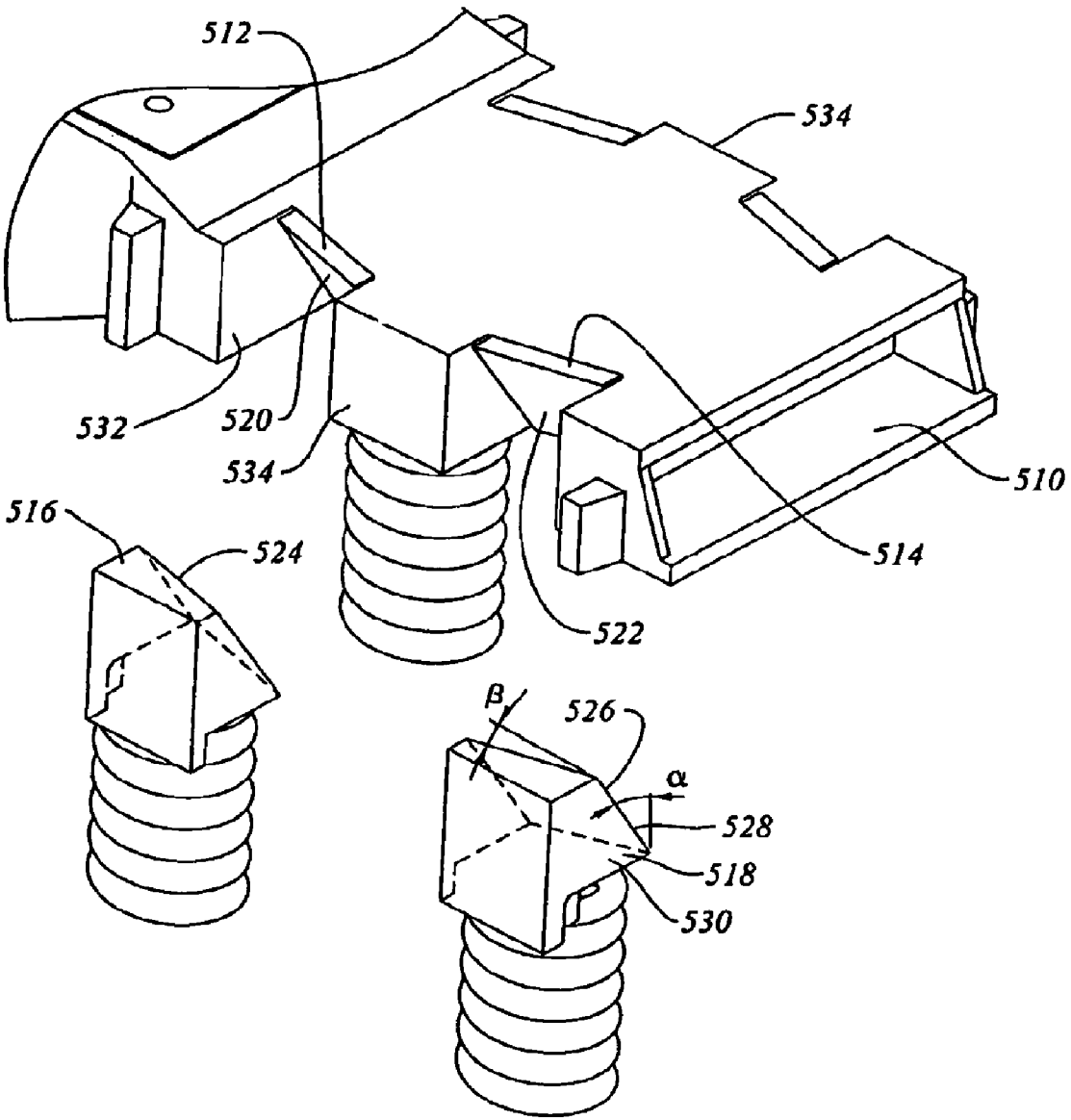
FIG. 8*c* shows an alternate bolster, similar to that of FIG. 5*a*, having a pair of spaced apart wedge pockets, and pocket inserts with both primary and secondary wedge angles.

Thus far only primary angles have been discussed. FIG. 8*c* shows an isometric view of an end portion of a truck bolster 510, generally similar to bolster 400. As with all of the truck bolsters shown and discussed herein, bolster 510 is symmetrical about the longitudinal vertical plane of the bolster (i.e., cross-wise relative to the truck generally) and symmetrical about the vertical mid-span section of the bolster (i.e., the longitudinal plane of symmetry of the truck generally, coinciding with the rail car longitudinal center line). Bolster 510 has a pair of spaced apart bolster pockets 512, 514 for receiving damper wedges 516, 518. Pocket 512 is laterally inboard of pocket 514 relative to the side frame of the truck more generally. Consumable wear plate inserts 520, 522 are mounted in pockets 512, 514 along the angled wedge face.

As can be seen, wedges 516, 518 have a primary angle a as measured between vertical sliding face 524, (or 526, as may be) and the angled vertex 528 of outboard face 530. For the embodiments discussed herein, primary angle a will tend to be greater than 40 degrees, and may typically lie in the range of 45-65 degrees, possibly about 55-60 degrees. This angle will be common to the slope of all points on the sliding hypotenuse face of wedge 516 (or 518) when taken in any plane parallel to the plane of outboard end face 530. This same angle a is matched by the facing surface of the bolster pocket, be it 512 or 514, and it defines the angle upon which displacement of wedge 516, (or 518) is intended to move relative to that surface.

A secondary angle β gives the inboard, (or outboard), rake of the hypotenuse surface of wedge 516 (or 518). The true rake angle can be seen by sighting along plane of the hypotenuse face and measuring the angle between the hypotenuse face and the planar outboard face 530. The rake angle is the complement of the angle so measured. The rake angle may tend to be greater than 5 degrees, may lie in the range of 10 to 20 degrees, and is preferably about 15 degrees. A modest angle is desirable.

When the truck suspension works in response to track perturbations, the damper wedges may tend to work in their pockets. The rake angles yield a component of force tending to bias the outboard face 530 of outboard wedge 518 outboard against the opposing outboard face of bolster pocket 514. Similarly, the inboard face of wedge 516 will tend to be biased toward the inboard planar face of inboard bolster pocket 512. These inboard and outboard faces of the bolster pockets are preferably lined with a low friction surface pad, indicated generally as 532. The left hand and right hand biases of the wedges may tend to keep them apart to yield the full moment arm distance intended, and, by keeping them against the planar facing walls, may tend to discourage twisting of the dampers in the respective pockets.

Bolster 510 includes a middle land 534 between pockets 512, 514, against which another spring 536 may work, such as might be found in a spring group that is three (or more) coils wide. However, whether two, three, or more coils wide, and whether employing a central land or no central land, bolster pockets can have both primary and secondary angles as illustrated in the example embodiment of FIG. 8*c*, with or without (though preferably with) wear inserts.

In the case where a central land, such as land 534 separates two damper pockets, the opposing wear plates of the side frame columns need not be monolithic. That is, two wear plate regions could be provided, one opposite each of the inboard and outboard dampers, presenting planar surfaces against which those dampers can bear. Advantageously, the normal vectors of those regions are parallel, and most conveniently those surfaces are co-planar and perpendicular to the long axis of the side frame, and present a clear, un-interrupted surface to the friction faces of the dampers.

Figure 8D:
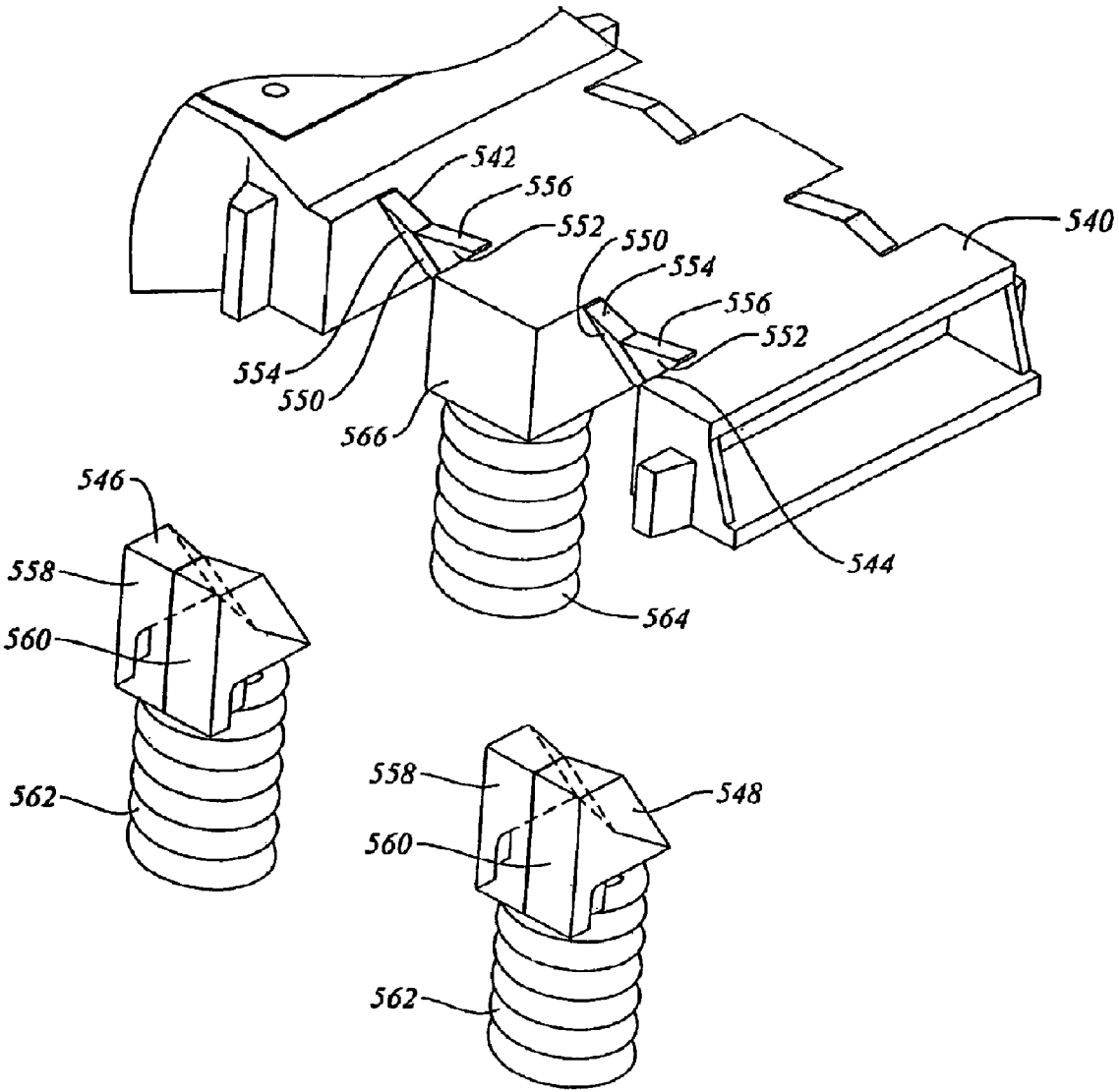
FIG. 8*d* shows an alternate bolster, similar to that of FIG. 8*c*, and split wedges.

The examples of FIGS. 8*a*, 8*b* and 8*c* are arranged in order of incremental increases in complexity. The Example of FIG. 8*d* again provides a further incremental increase in complexity. FIG. 8*d* shows a bolster 540 that is similar to bolster 510 except insofar as bolster pockets 542, 544 each accommodate a pair of split wedges 546, 548. Pockets 542, 544 each have a pair of bearing surfaces 550, 552 that are inclined at both a primary angle and a secondary angle, the secondary angles of surfaces 550 and 552 being of opposite hand to yield the damper separating forces discussed above. Surfaces 550 and 552 are also provided with linings in the nature of relatively low friction wear plates 554, 556. Each of pockets 542 and 544 accommodates a pair of split wedges 558, 560. Each pair of split wedges seats over a single spring 562. Another spring 564 bears against central land 566.

Figures 10A, 10B, 10C, 10D:
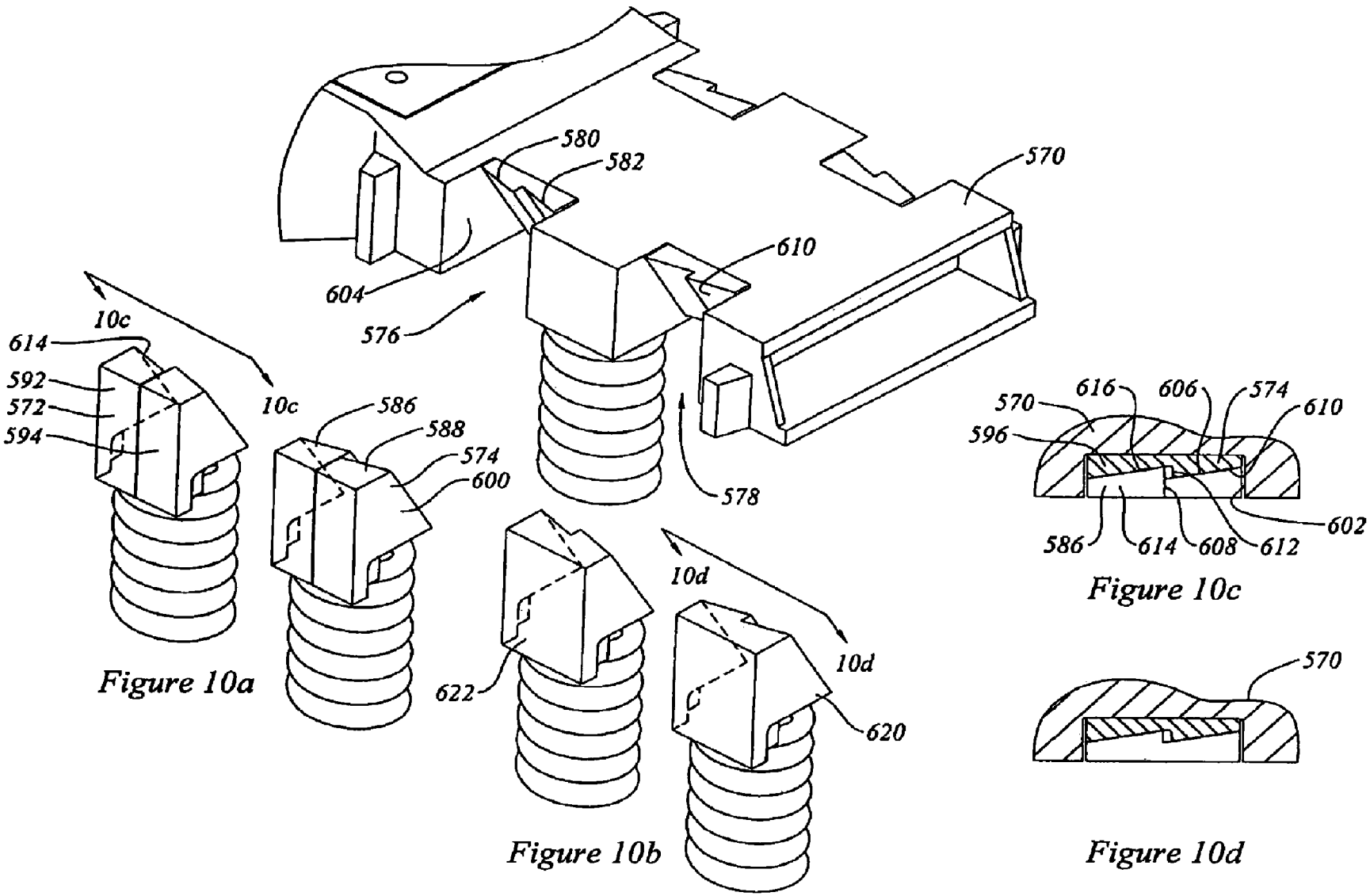
FIG. 10*a* shows a bolster similar to that of FIG. 8*c*, having a wedge pocket having primary and secondary angles and a split wedge arrangement for use therewith.
FIG. 10*b* shows an alternate stepped single wedge for the bolster of FIG. 10*a;*
FIG. 10*c* is a view looking along a plane on the primary angle of the split wedge of FIG. 10*a* relative to the bolster pocket.
FIG. 10*d* is a view looking along a plane on the primary angle of the stepped wedge of FIG. 10*b* relative to the bolster pocket.

The example of FIG. 10*a* shows a combination of a bolster 570 and biased split wedges 572, 574. Bolster 570 is the same as bolster 540 except insofar as bolster pockets 576, 578 are stepped pockets in which the steps, e.g., items 580, 582, have the same primary angle, and the same secondary angle, and are both biased in the same direction, unlike the symmetrical sliding faces of the split wedges in FIG. 8*d*, which are left and right handed. Thus the outboard pair of split wedges 584 has a first member 586 and a second member 588 each having primary angle a, and secondary angle β, and are of the same hand such that in use both the first and second members will tend to be biased in the outboard direction (i.e. toward the distal end of bolster 570). Similarly, the inboard pair of split wedges 590 has a first member 592 and a second member 594 each having primary angle a, and secondary angle β, except that the sense of secondary angle β is in the opposite direction such that members 592 and 594 will tend in use to be driven in the inboard direction (i.e., toward the truck center).

As shown in the partial sectional view of FIG. 10*c*, a replaceable monolithic stepped wear insert 596 is welded in the bolster pocket 580 (or 582 if opposite hand, as the case may be). Insert 596 has the same primary and secondary angles a, and β as the split wedges it is to accommodate, namely 586, 588 (or, opposite hand, 592, 594). When installed, and working, the more outboard of the wedges, 588 (or, opposite hand, the more inboard of the wedges 592) has a vertical and longitudinally planar outboard face 600 that bears against a similarly planar outboard face 602 (or, opposite hand, inboard face 604). These faces are preferably prepared in a manner that yields a relatively low friction sliding interface between them. In that regard, a low friction pad may be mounted to either surface, preferably the outboard surface of pocket 580. The hypotenuse face 606 of member 588 bears against the opposing outboard land 610 of insert 596. The overall width of outboard member 588 is greater than that of outboard land 610, such that the inboard planar face of member 588 acts as an abutment face to fend inboard member 586 off of the surface of the step 612 in insert 596.

In similar manner inboard wedge member 586 has a hypotenuse face 614 that bears against the inboard land portion 616 of insert 596. The total width of bolster pocket 580 is greater than the combined width of wedge members, such that a gap is provided between the inboard (non-contacting) face of member 586 and the inboard planar face of pocket 580. The same relationship, but of opposite hand, exists between pocket 582 and members 592, 594.

In an optional embodiment, a low friction pad, or surfacing, can be used at the interface of members 586, 588 (or 592, 594) to facilitate sliding motion of the one relative to the other.

In this arrangement, working of the wedges, i.e., members 586, 588 against the face of insert 596 will tend to cause both members to move in one direction, namely to their most outboard position. Similarly, members 592 and 594 will work to their most inboard positions. This may tend to maintain the wedge members in an untwisted orientation, and may also tend to maintain the moment arm of the restoring moment at its largest value, both being desirable results.

When a twisting moment of the bolster relative to the side frames is experienced, as in parallelogram deformation, all four sets of wedges will tend to work against it. That is, the diagonally opposite pairs of wedges in the outboard pocket of one side of the bolster and on the inboard pocket on the other side will be compressed, and the opposite side will be, relatively, relieved, such that a differential force will exist. The differential force will work on a moment arm roughly equal to the distance between the centers of the inboard and outboard pockets, or slightly more given the gap arrangement.

In the further alternative arrangement of FIGS. 10*b* and 10*d*, a single, stepped wedge 620 is used in place of the pair of split wedges e.g., members 586, 588. A corresponding wedge of opposite hand is used in the other bolster pocket.

Figures 11A, 11B, 11C, 11D:
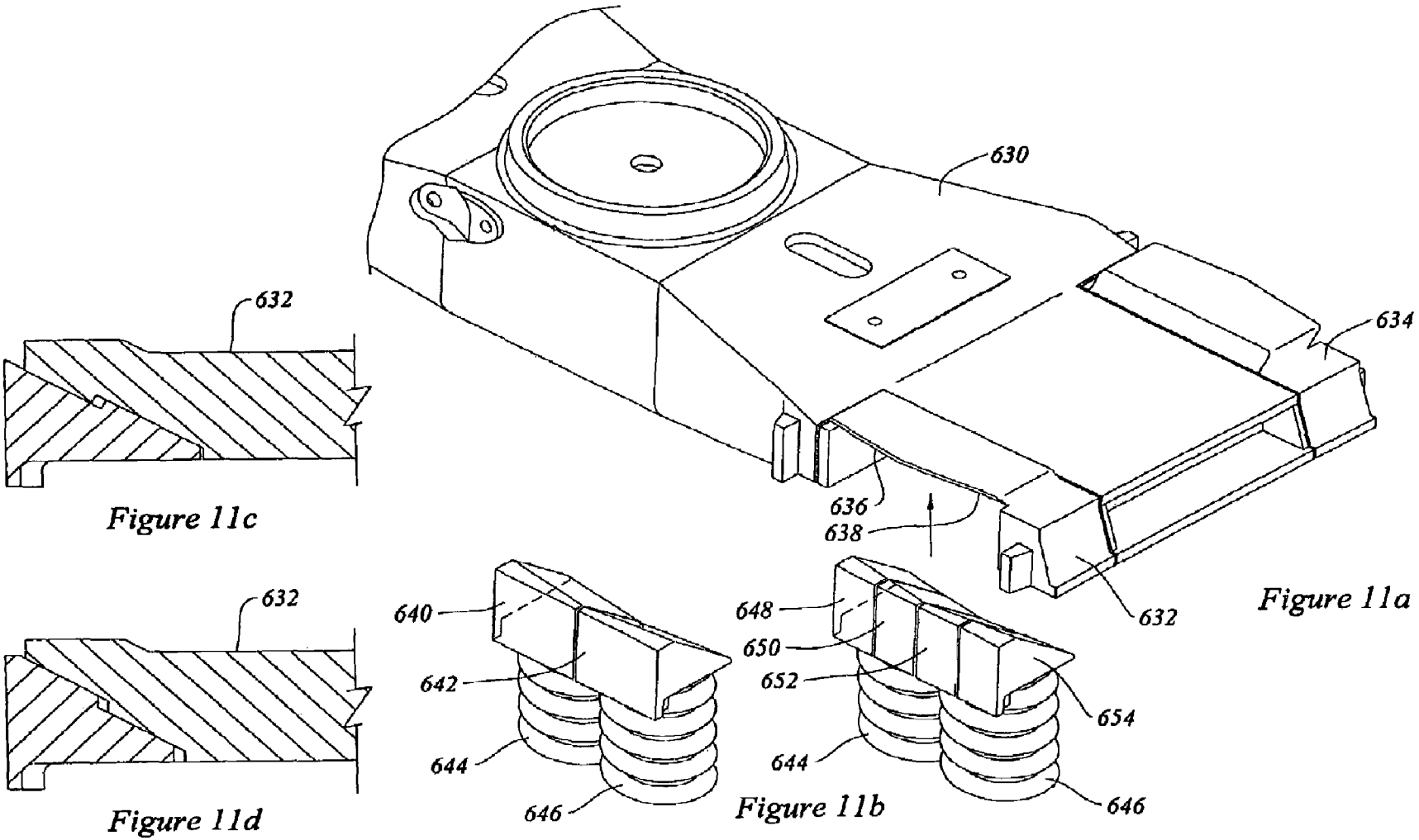
FIG. 11*a* shows an alternate bolster and wedge arrangement to that of FIG. 8*b*, having secondary wedge angles.
FIG. 11*b* shows an alternate, split wedge arrangement for the bolster of FIG. 11*a;*
FIG. 11*c* shows a cross-section of a stepped damper wedge for use with a bolster as shown in FIG. 11*a;*
FIG. 11*d* shows an alternate stepped damper to that of FIG. 11*c;*

In the further alternative embodiment of FIG. 11*a*, a truck bolster 630 has welded bolster pocket inserts 632 and 634 of opposite hands welded into accommodations in its distal end. In this instance, each bolster pocket has an inboard portion 636 and an outboard portion 638. Inboard and outboard portions 636 and 638 share the same primary angle a, but have secondary angles β that are of opposite hand. Respective inboard and outboard wedges are indicated as 640 and 642, and each seats over a vertically oriented spring 644, 646. In this case bolster 630 is similar to bolster 480 of FIG. 8*a*, to the extent that the bolster pocket is continuous—there is no land separating the inner and outer portions of the bolster pocket.

Bolster 630 is also similar to bolster 510 of FIG. 8*c*, except that rather than the bolster pockets of opposite hand being separated, they are merged without an intervening land.

In the further alternative of FIG. 11*b*, split wedge pairs 648, 650 (inboard) and 652, 654 (outboard) are employed in place of the single inboard and outboard wedges 640 and 642.

In some instances the primary angle of the wedge may be steep enough that the thickness of section over the spring might not be overly great. In such a circumstance the wedge may be stepped in cross section to yield the desired thickness of section as show in the details of FIGS. 11*c* and 11*d*.

Figure 12A:
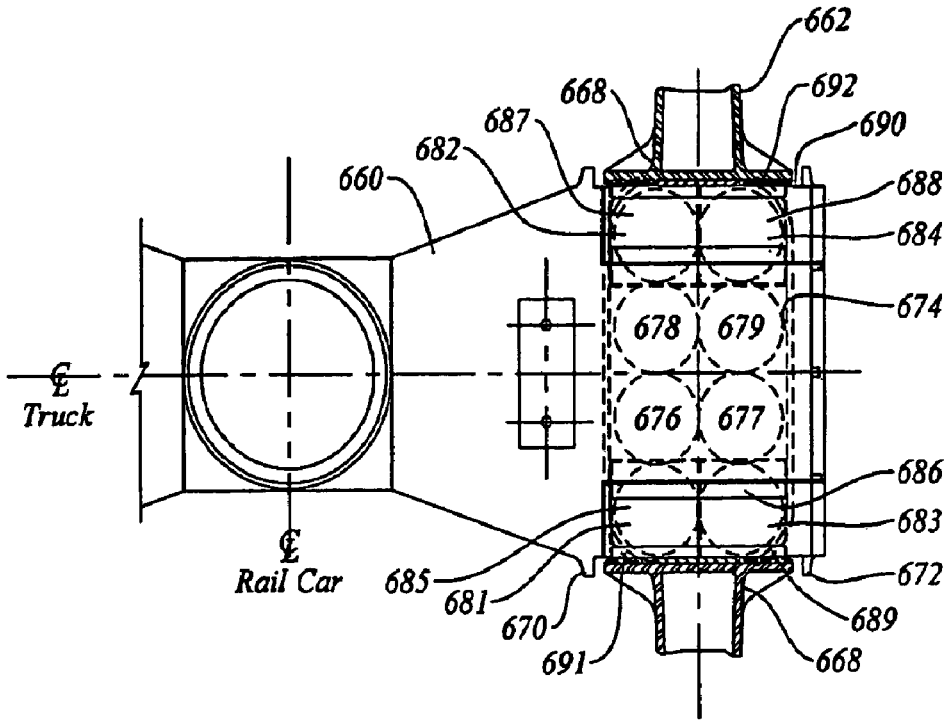
FIG. 12*a* is a section of FIG. 5*b* showing a replaceable side frame wear plate.
Figure 12B:
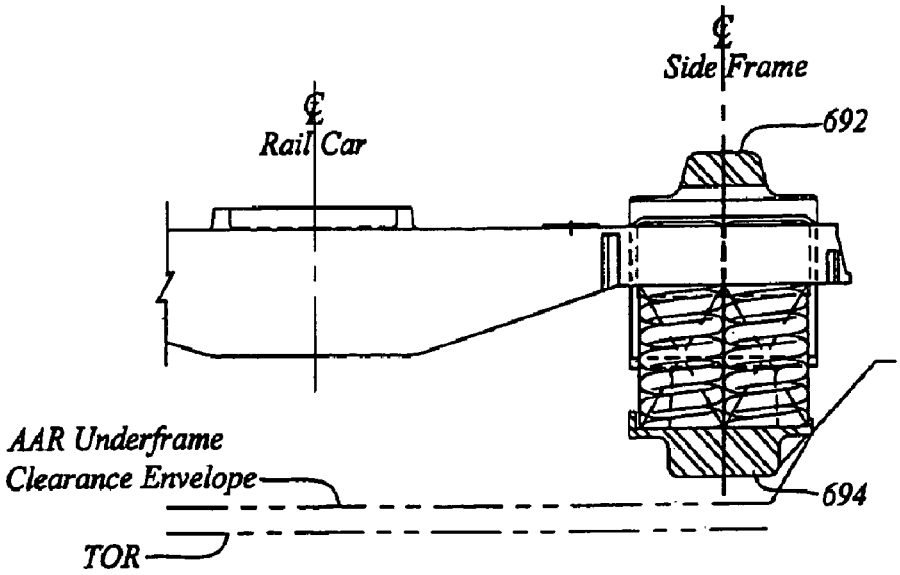
FIG. 12*b* is a sectional view of the side frame of FIG. 12*a* with the near end of the side frame sectioned and the nearer wear plate removed to show the location of the wear plate of FIG. 12*a;*

FIG. 12*a* shows the placement of a low friction bearing pad for bolster 480 of FIG. 8*a*. It will be appreciated that such a pad can be used at the interface between the friction damper wedges of any of the embodiments discussed herein. In FIG. 12*a*, the truck bolster is identified as item 660 and the side frame is identified as item 662. Side frame 662 is symmetrical about the truck centerline, indicated as 664. Side frame 662 has side frame columns 668 that locate between the inner and outer gibs 670, 672 of truck bolster 660. The spring group is indicated generally as 674, and has eight relatively large diameter springs arranged in two rows, being an inboard row and an outboard row. Each row has four springs in it. The four central springs 676, 677, 678, 679 seat directly under the bolster end 680. The end springs of each row, 681, 682, 683, 684 seat under respective friction damper wedges 685, 686, 687, 688. Consumable wear plates 689, 690 are mounted to the wide, facing flanges 691, 692 of the side frame columns, 688. As shown in FIG. 12*b*, plates 689, 690 are mounted centrally relative to the side frames, beneath the juncture of the side frame arch 692 with the side frame columns. The lower longitudinal member of the side frame, bearing the spring seat, is indicated as 694.

Figure 12C:
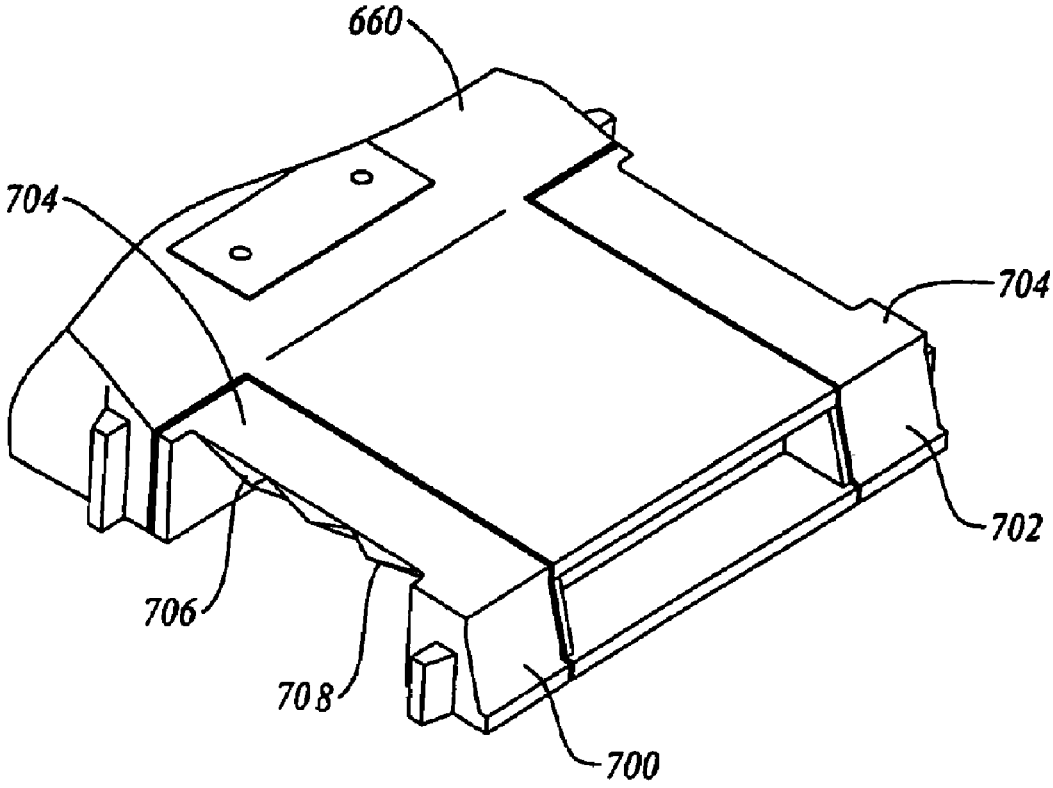
FIG. 12*c* shows a compound bolster pocket for the bolster of FIG. 12*a;*
Figure 12D:
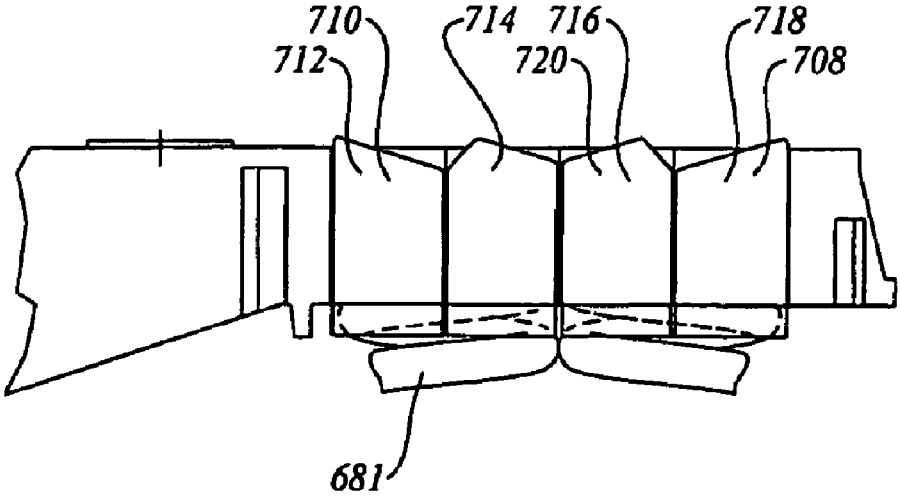
FIG. 12*d* shows a side view detail of the bolster pocket of FIG. 12*c*, as installed, relative to the main springs and the wear plate.
Figure 12F:
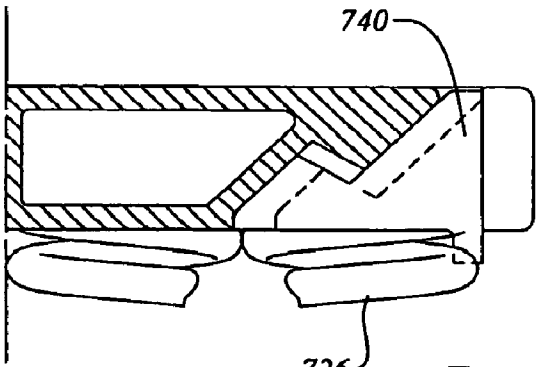
FIG. 12*f* shows an alternate, stepped steeper angle profile for the primary angle of the wedge of the bolster pocket of FIG. 12*d;*
Figure 12G:
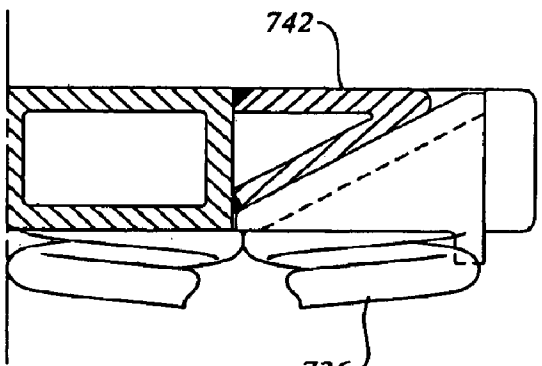
FIG. 12*g* shows a welded insert having a profile for mating engagement with the corresponding face of the bolster pocket of FIG. 12*d;*
Figure 12E:
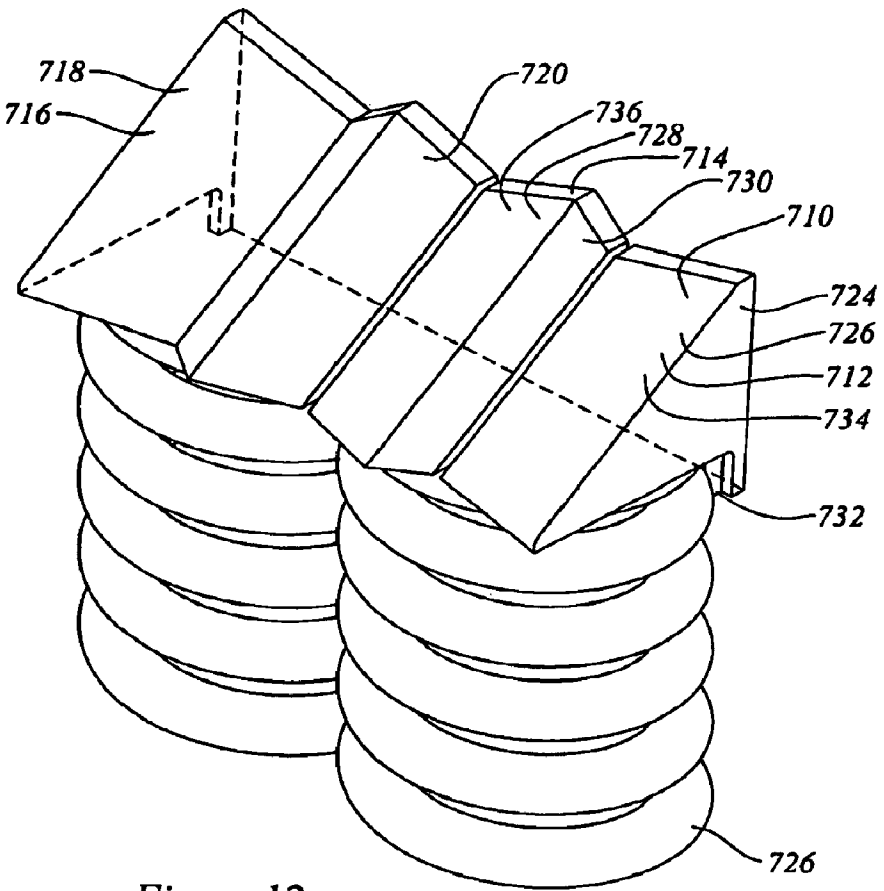
FIG. 12*e* shows an isometric view detail of a split wedge version and a single wedge version of wedges for use in the compound bolster pocket of FIG. 12*c;*

Referring now to FIGS. 12*c* and 12*e*, bolster 660 has a pair of left and right hand, welded-in bolster pocket assemblies 700, 702, each having a cast steel, replaceable, welded-in wedge pocket insert 704. Insert 704 has an inboard-biased portion 706, and an outboard-biased portion 708. Inboard end spring 682 (or 681) bears against an inboard-biased split wedge pair 710 having members 712, 714, and outboard end spring 684 (or 683) bears against an outboard-biased split wedge pair 716 having members 718, 720. As suggested by the names, the outboard-biased wedges will tend to seat in an outboard position as the suspension works, and the inboard-biased wedges will tend to seat in an inboard position.

Each insert portion 706, 708 is split into a first part and a second part for engaging, respectively, the first and second members of a commonly biased split wedge pair. Considering pair 710, inboard leading member 712 has an inboard planar face 724, that, in use, is intended slidingly to contact the opposed vertically planar face of the bolster pocket. Leading member 712 has a bearing face 726 having primary angle a and secondary angle β. Trailing member 714 has a bearing face 728 also having primary angle a and secondary angle β, and, in addition, has a transition, or step, face 730 that has a primary angle a and a tertiary angle ϕ.

Insert 704 has a corresponding an array of bearing surfaces having a primary angle a, and a secondary angle β, with transition surfaces having tertiary angle ϕ for mating engagement with the corresponding surfaces of the inboard and outboard split wedge members. As can be seen, a section taken through the bearing surface resembles a chevron with two unequal wings in which the face of the secondary angle β relatively broad and shallow and the face associated with tertiary angle ϕ is relatively narrow and steep.

In FIG. 12*e*, it can be seen that the sloped portions of split wedge members 718, 720 extend only partially far enough to overlie a coil spring 726. In consequence, wedge members 718 and 720 each have a base portion 728, 730 having a fore-and-aft dimension greater than the diameter of spring 726, and a width greater than half the diameter of spring 726. Each of base portions 728, 730 has a downwardly proud, roughly semicircular boss 732 for seating in the top of the coil of spring 726. The upwardly angled portion 734, 736 of each wedge member 718, 720 is extends upwardly of base portion 728, 730 to engage the matingly angled portions of insert 704.

In a further alternate embodiment, the split wedges can be replaced with stepped wedges 740 of similar compound profile, as shown in FIG. 12*f*. In the event that the primary wedge angle is relatively steep (i.e., greater than about 45 degrees when measured from the horizontal, or less than about 45 degrees when measured from the vertical). FIG. 12*g* shows a welded in insert 742 having a profile for mating engagement with the corresponding wedge faces.

Figure 13A:
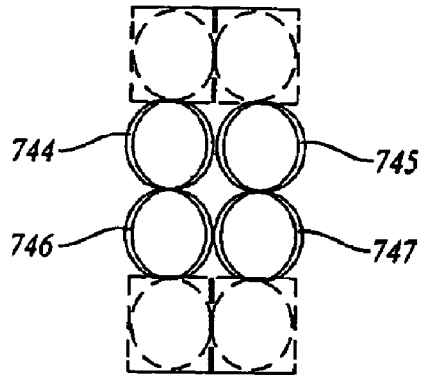
FIG. 13*a* shows an alternate spring arrangement to that of FIG. 12*a;*
Figure 13B:
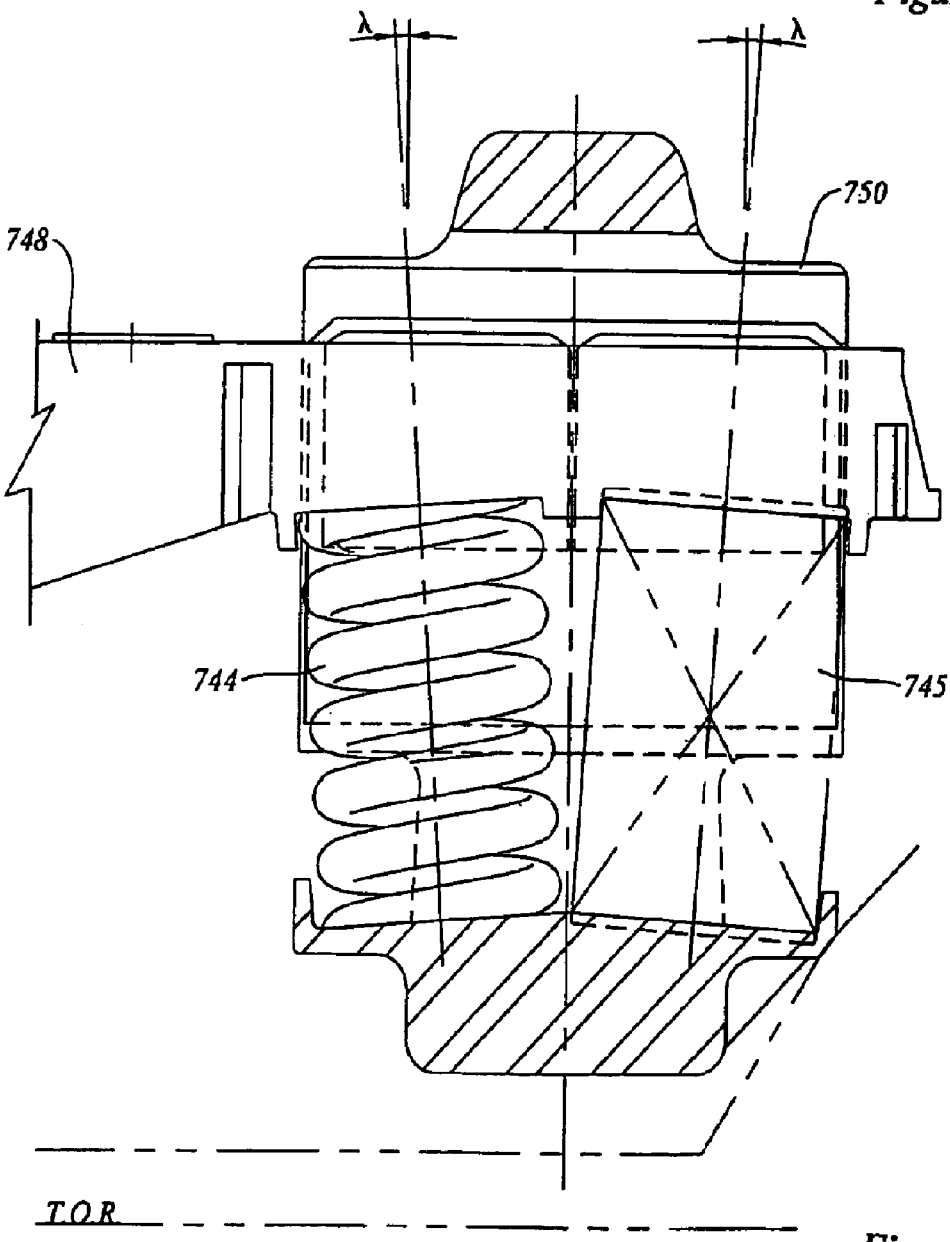
FIG. 13*b* shows mutually inclined springs on section '13*b*-13*b*' of FIG. 13*a;*

FIGS. 13*a* and 13*b* illustrate a further alternate embodiment, being generally similar to the 2×4 spring layout of the embodiment of FIG. 8*a*. However, in this example, while the damper arrangement is as in FIG. 8*a*, the central four springs 744, 745, 746, and 747 are installed in inboard and outboard pairs in spring seats in which the springs do not act on a vertical line (assuming no lateral translation of bolster 748 relative to side frame 750), but rather are splayed to act on a dihedral angle λ from the vertical, this splayed inclination tending to urge bolster 748 to a centered neutral position of lateral translation relative to side frame 750. The angle of splay is relatively modest, being in the range of 0 to 10 degrees from the vertical, and may be about 5 degrees.

Figure 14B:
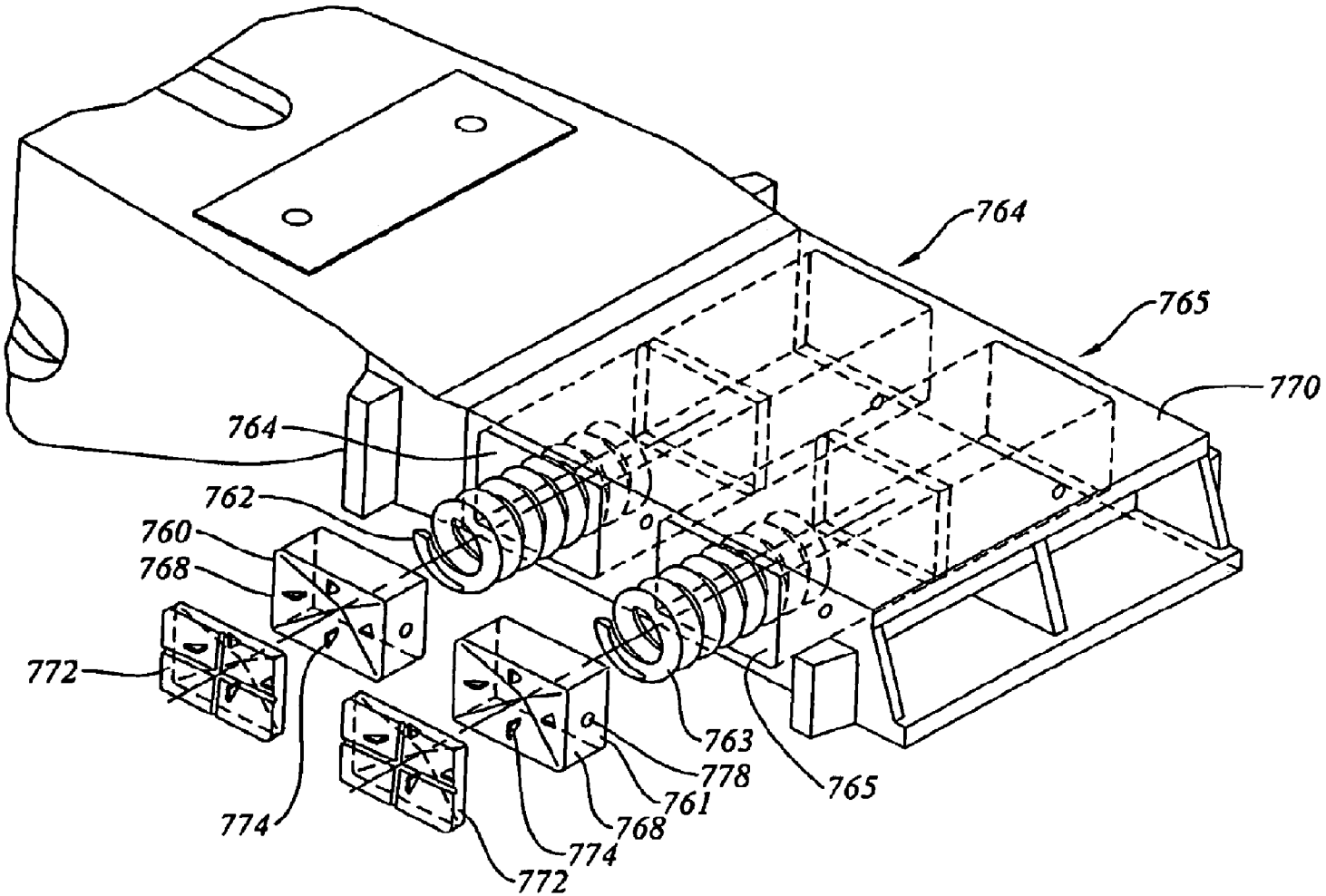
FIG. 14*b* shows a side-by-side double damper arrangement similar to that of FIG. 14*a;*

FIGS. 14*a* and 14*b* illustrate a bolster, side frame and damper arrangement in which dampers 760, 761 are independently sprung on horizontally acting springs 762, 763 housed in side-by-side pockets 764, 765 in the distal end of bolster 770. Although only two dampers are shown, it will be understood that a pair of dampers faces toward each of the opposed side frame columns. Dampers 760, 761 each include a block 768 and a consumable wear member 772, the block and wear member having male and female indexing features 774 to maintaining their relative position. An arrangement of this nature permits the damper force to be independent of the compression of the springs in the main spring group. A removable grub screw fitting 778 is provided in the spring housing to permit the spring to be pre-loaded and held in place during installation.

Figure 15:
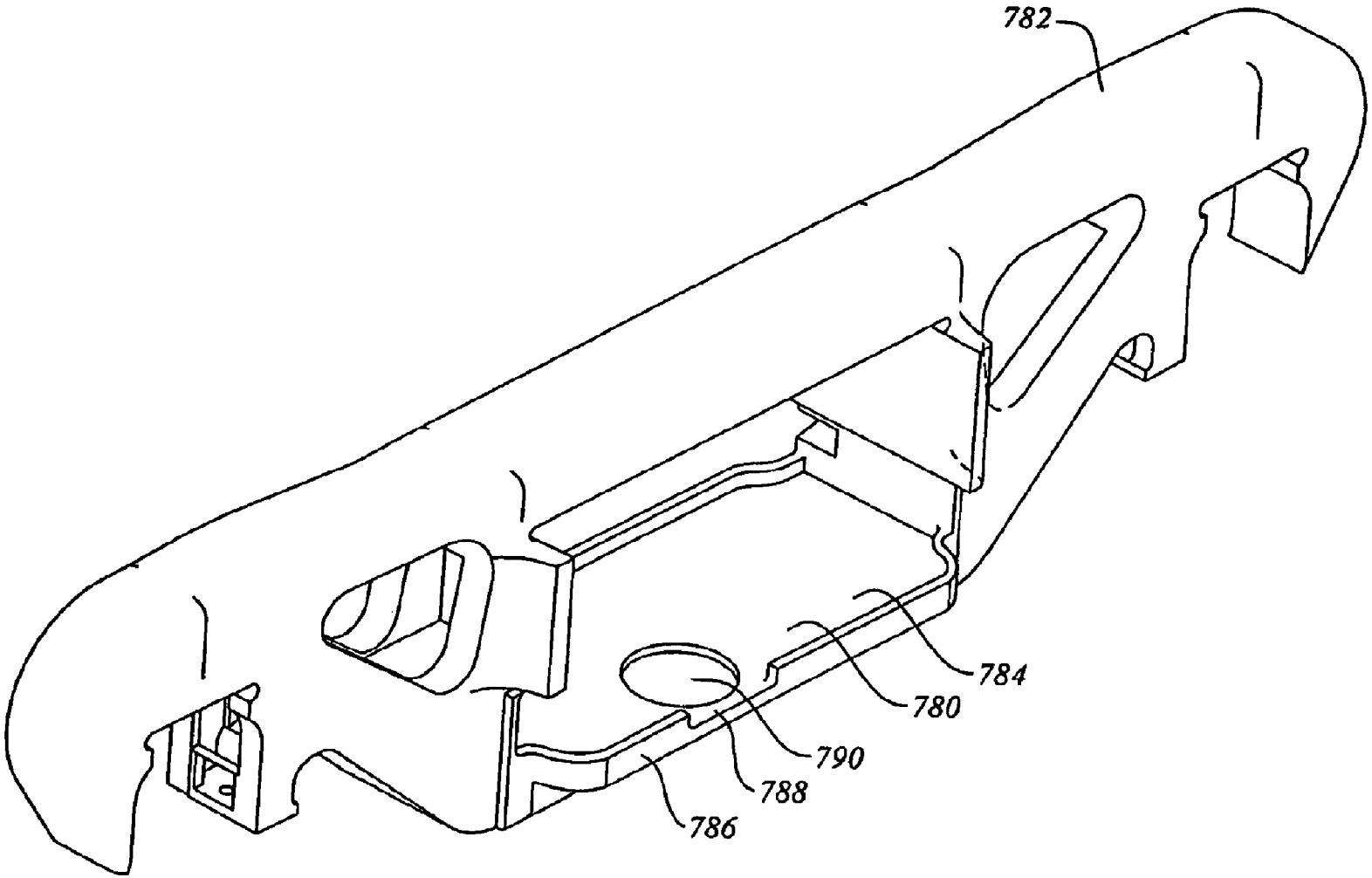
FIG. 15 shows an isometric view of an alternate spring seat basket for the truck of FIG. 5*a*, having a spring insertion access feature.

FIG. 15 shows a bottom spring seat 780 for a side frame 782. Bottom Spring seat 780 has a base portion 784 upon which to rest the springs of a spring group, such as those described above, and includes an upstanding peripheral retaining wall, 786. Retaining wall 786 has an opening, or gate 788 to permit springs to slide into place from the outside. The last spring slid in during installation, or the first spring out during removal, seats in a depression, or relief, or seat, 790, and is thereby discouraged from moving out through gate 788 while in operation.

Figure 16B:
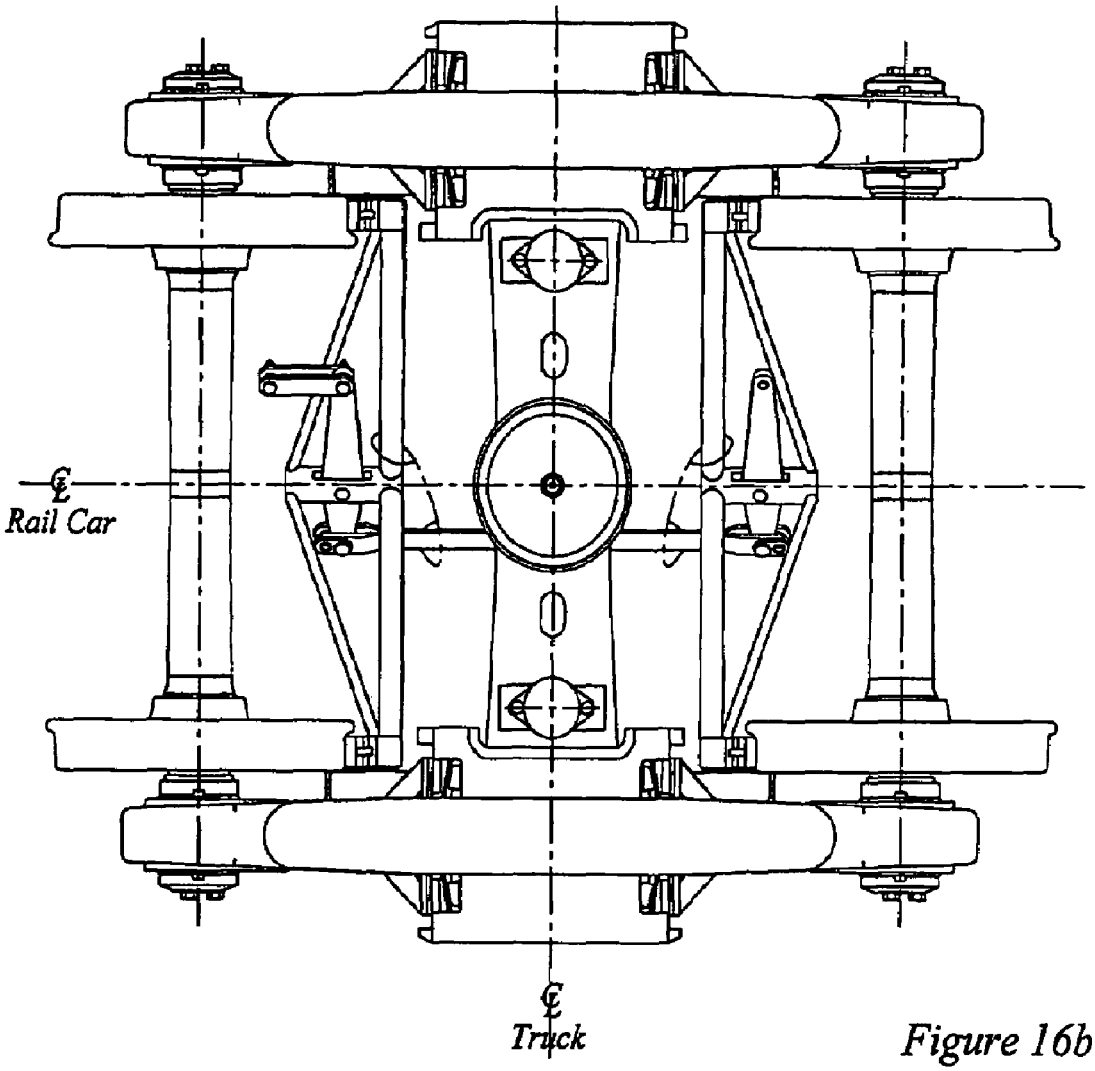
FIG. 16*b* shows a side view of the three piece truck of FIG. 16*a;*
Figure 16C:
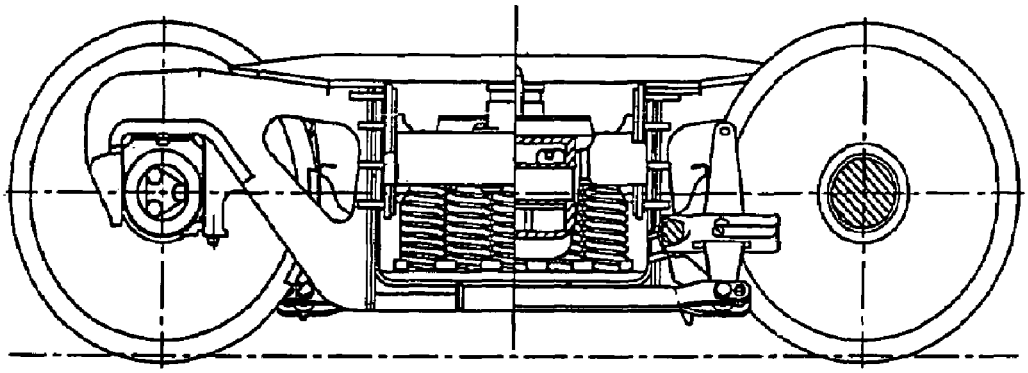
FIG. 16*c* shows a top view of the three piece truck of FIG. 16*a;*

FIGS. 16*a*, 16*b* and 16*c* show a preferred truck 800, having a bolster 802, a side frame 804, a spring group 806, and a damper arrangement 808. The spring group has a 5×3 arrangement, with the dampers being in a spaced arrangement generally as shown in FIG. 8*c*, and having a primary damper angle that may tend to be somewhat sharper given the smaller proportion of the total spring group that works under the dampers (i.e., 4/15 as opposed to 4/9 in FIG. 8*c*).

The embodiments described have natural vertical bounce frequencies that are less than the 4-6 Hz. range of freight cars more generally. In addition, a softening of the suspension to 3.0 Hz would be an improvement, yet the embodiments described herein, whether for individual trucks or for overall car response can employ suspensions giving less than 3.0 Hz in the unladen vertical bounce mode. That is, the fully laden natural vertical bounce frequency for one embodiment of rail cars of FIGS. 1*a*, 1*b*, 2*a*, 2*b*, 3*a* and 3*b* is 1.5 Hz or less, with the unladen vertical bounce natural frequency being less than 2.0 Hz, and advantageously less than 1.8 Hz. It is preferred that the natural vertical bounce frequency be in the range of 1.0 Hz to 1.5 Hz. The ratio of the unladen natural frequency to the fully laden natural frequency is less than 1.4:1.0, advantageously less than 1.3:1.0, and even more advantageously, less than 1.25:1.0.

In the embodiments described above, it is preferred that the spring group be installed without the requirement for pre-compression of the springs. However, where a higher ratio of dead sprung weight to live load is desired, additional ballast can be added up to the limit of the truck capacity with appropriate pre-compression of the springs. It is advantageous for the spring rate of the spring groups be in the range of 6,400 to 10,000 lbs/in per side frame group, or 12,000 to 20,000 lbs/in per truck in vertical bounce.

In the embodiments of FIGS. 5*a*, 8*a*, and 16*a* the gibs are shown mounted to the bolster inboard and outboard of the wear plates on the side frame columns. In the embodiments shown herein, the clearance between the gibs and the side plates is desirably sufficient to permit a motion allowance of at least ¾" of lateral travel of the truck bolster relative to the wheels to either side of neutral, advantageously permits greater than 1 inch of travel to either side of neutral, and more preferably permits travel in the range of about 1 or 1⅛" to about 1⅝ or 1 9/16" inches to either side of neutral, and in one embodiment against either the inboard or outboard stop.

In a related feature, in the embodiments of FIGS. 5*a*, 8*a* and 16*a*, the side frame is mounted on bearing adapters such that the side frame can swing transversely relative to the wheels. While the rocker geometry may vary, the side frames shown, by themselves, have a natural frequency when swinging of less than about 1.4 Hz, and preferably less than 1 Hz, and advantageously about 0.6 to 0.9 Hz. Advantageously, when combined with the lateral spring stiffness of a spring group in shear, the overall lateral natural frequency of the truck suspension, for an unladen car, may tend to be less than 1 Hz for small deflections, and preferably less than 0.9 Hz.

The most preferred embodiments of this invention combine a four cornered damper arrangement with spring groups having a relatively low vertical spring rate, and a relatively soft response to lateral perturbations. This may tend to give enhanced resistance to hunting, and relatively low vertical and transverse force transmissibility through the suspension such as may give better overall ride quality for high value low density lading, such as automobiles, consumer electronic goods, or other household appliances, and for fresh fruit and vegetables.

While the most preferred embodiments combine these features, they need not all be present at one time, and various optional combinations can be made. As such, the features of the embodiments of the various figures may be mixed and matched, without departing from the spirit or scope of the invention. For the purpose of avoiding redundant description, it will be understood that the various damper configurations can be used with spring groups of a 2×4, 3×3, 3:2:3, 3×5 or other arrangement. Similarly, although the discussion involves trucks for rail road cars for carrying low density lading, it applies to trucks for carrying relatively fragile high density lading such as rolls of paper, for example, where ride quality is an important consideration. Further, while the improved ride quality features of the damper and spring sets are most preferably combined with a low slack, short travel, set of draft gear, for use in a "No Hump" car, these features can be used in cars having conventional slack and longer travel draft gear.

The principles of the present invention are not limited to auto rack rail road cars, but apply to freight cars, more generally, including cars for paper, auto parts, household appliances and electronics, shipping containers, and refrigerator cars for fruit and vegetables. More generally, they apply to three piece freight car trucks in situations where improved ride quality is desired, typically those involving the transport of relatively high value, low density manufactured goods.

Various embodiments of the invention have now been described in detail. Since changes in and or additions to the above-described best mode may be made without departing from the nature, spirit or scope of the invention, the invention is not to be limited to those details.

What is claimed is:

1. A set of dampers for one end of a bolster of a railroad car truck, each such bolster having a complement of two such sets of dampers, the bolster being for mounting crosswise between first and second sideframes of the railroad car truck, wherein said set of dampers includes a first damper wedge, a second damper wedge, a third damper wedge, and a fourth damper wedge, each of said damper wedges having:

a first face for sliding engagement of a wear plate of a sideframe column;

a second face for engagement with a sloped face of a bolster pocket;

a third face defining a seat for a spring, said seat being of a size corresponding to a full coil spring;

a side face;

said first face, said seat, and said side face being square to each other;

said second face being sloped to correspond to the sloped face of the bolster pocket;

said side face and said second face meeting along a vertex;

said sloped face being angled to said first face and having a primary angle, alpha, with respect thereto, alpha being measured in the plane of said side face from vertical to the vertex between said side face and said sloped face, alpha being greater than 35 degrees;

said sloped face being angled cross-wise at a rake angle, beta; and said first and fourth damper wedges having left-handed rake angles, and said second and third damper wedges having right handed rake angles.

2. The set of dampers of claim 1 wherein alpha lies in the range of 37 to 45 degrees.

3. The set of dampers of claim 1 wherein said third face is of a size for seating a first spring that is larger than an AAR B432 spring.

4. The set of dampers of claim 1 wherein said third face also defines a seat for a spring nested within the first spring.

5. The set of dampers of claim 1 wherein said first face has a non-metallic surface.

6. The set of dampers of claim 1 wherein said second face has a non-metallic surface.

7. The set of dampers of claim 1 wherein said side face is a first side face, each said damper has a second side face, and said first and second side faces are parallel.

8. A combination of the set of dampers of claim 1 and a corresponding set of springs for driving said dampers, each of said sets of springs including at least a respective first spring of a size greater than an AAR B432 spring for engaging said spring seat of each of said damper wedges, and said seat accommodates said first spring when centered thereunder.

9. The combination of claim 8 and further including respective second springs nested inside of each of said first springs.

10. The combination of claim 9 wherein alpha lies in the range of 37 to 45 degrees, said springs mounted under said damper wedges are part of a first spring group, and said springs for mounting under said dampers have a total spring rate that is more than 15% of the total spring rate of all of the springs in the first spring group.

11. A combination of first and second sets of dampers according to claim 1 and a truck bolster for mounting cross-wise between first and second sideframes of a rail road freight car truck, said truck bolster having:

a center plate bowl;

first and second ends distantly outboard from said center plate bowl;

a longitudinal axis running centrally from end to end of said bolster;

said first end of said bolster having four bolster pockets formed thereat for accommodating said first set of dampers;

said second end of said bolster having four bolster pockets formed thereat for accommodating said second set of dampers;

said four bolster pockets at said first end of said bolster including first and second bolster pockets oriented to face toward a first sideframe column of the first sideframe, and third and fourth bolster pockets oriented to face toward an opposed, second sideframe column of the second sideframe;

said first bolster pocket being outboard of said second bolster pocket, and said third bolster pocket being outboard of said fourth bolster pocket, said bolster having a first partition located between said first and second bolster pockets, and a second partition located between said third and fourth bolster pockets;

each of said bolster pockets has a sidewall extending in a plane to which said longitudinal axis is normal; and said bolster pockets having respective sloped surfaces each having said primary angle, alpha, said primary angle alpha being measured in a planar cross-section of the bolster perpendicular to the length of the bolster between vertical and said sloped surface oriented to urge a damper engaged therewith toward one of the sideframe columns, alpha being greater than 35 degrees; and said rake angle beta, whereby said first, second, third, and fourth damper wedges can seat in mating engagement in said first, second, third and fourth bolster pockets respectively.

12. The combination of claim 11 wherein said partition includes a land defining a spring seat for receiving an upper end of a suspension spring of the truck.

13. The combination of claim 11 where each of said bolster pockets has a second sidewall, said second sidewall and said first sidewall being parallel.

14. The combination of claim 11 wherein said sloped face extends between said first and second sidewalls.

15. The combination of claim 11 wherein said angle alpha lies in the range of 37 to 45 degrees.

16. The combination of claim 11 wherein said sloped face also has a rake angle, beta, oriented cross-wise to said primary wedge angle alpha.

17. The combination of claim 11 wherein each of said bolster pockets is of a width corresponding to a coil spring of a size at least as a great as an AAR B432 spring.

18. The combination of claim 11 wherein each of said first, second, third and fourth bolster pockets is positioned to seat over a corner coil spring of a main spring group of the truck.

19. The combination of claim 11 wherein said truck bolster has a first bolster gib between said first bolster pocket of said first end and said center plate bowl, and a second gib mounted farther from said center plate bowl than said second bolster pocket, said first and second pockets being bracketed between said first and second gibs.

20. The combination of the truck bolster of claim 11 and the first sideframe, said first sideframe having friction wear plates mounted to said sideframe columns square to said bolster, said first and second, and third and fourth pockets being spanned by wear plates of said first sideframe.

21. The combination of the truck bolster of claim 19 and the first sideframe, said first sideframe being straddled by said first and second gibs; and said first and second gibs being spaced apart a distance leaving at least ¾" of travel of said bolster cross-wise relative to said first sideframe to either side of a central position.

22. The combination of the truck bolster of claim 19 and the first sideframe, said first sideframe having first and second friction wear plates mounted to said sideframes columns thereof, the first sideframe having a long dimension, said first and second wear plates being mounted square to the long dimension of the first sideframe, and having a width spanning said first and second, and third and fourth, bolster pockets respectively.

23. The combination of the truck bolster of claim 19 and a set of damper wedge sized to seat in said bolster pockets, and a main spring group for supporting the first end of said bolster, said main spring group including a first spring for driving each of the damper wedges seated in each of said first, second, third and fourth bolster pockets, and a second spring for nesting within each of said first springs, the spring having spring rates, and the sum of the spring rates of the first and second springs of all four dampers taken together amounts to at least 20% of the overall spring rate of the main spring group.

24. The combination of the set of dampers of claim 1 and a set of sideframe column wear plates for use with said set of dampers, said set of sideframe column wear plates including a first sideframe column wear plate having a planar surface against which said first and second damper wedges can bear, said first damper wedge and said second damper wedge having a combined width, and said planar surface being wider than said combined width of said first and second damper wedges.

25. The combination of claim 24 wherein each of said first and second damper wedges has a width corresponding to an associated coil spring diameter and said planar surface has a width greater than the sum of said widths of said dampers.

26. A combination of the set of dampers of claim 1, a spring group for seating under the first end of the bolster, and a sideframe column wear plate, the sideframe column wear plate having a planar surface for sliding engagement with the respective first faces of the first and second damper wedges, the spring group including first, second, third and fourth corner springs associated with said first, second, third and fourth damper wedges; and, when installed, said planar surface being wider than said spring group.

27. A combination of the subject matter of claim 11 and a set of sideframe column wear plates for use with said set of dampers, each said set of sideframe column wear plates including a first sideframe column wear plate having a planar surface against which said first and second damper wedges can both bear, said first damper wedge and said second damper wedge having a combined width, and said planar surface being sufficiently wide to span both of said first and second damper wedges as installed in said bolster.

28. A combination of the subject matter of claim 27 and a first group of coil springs for seating in a sideframe of the railroad car truck, said first group of coil springs including first, second third and fourth corner coil springs for installation under said first, second, third, and fourth damper wedges of said first sets of dampers, and other coil springs for installation in directly under and in contract directly with said first end of said bolster.

* * * * *